US008794167B2

(12) United States Patent
Takizawa et al.

(10) Patent No.: US 8,794,167 B2
(45) Date of Patent: Aug. 5, 2014

(54) SEWING MACHINE

(75) Inventors: Yoshichika Takizawa, Nagoya (JP); Tatsuhiro Kurashima, Nagoya (JP); Masayoshi Ono, Nagoya (JP)

(73) Assignee: NSD Corporation, Nagoya-shi (JP)

( * ) Notice: Subject to any disclaimer, the term of this patent is extended or adjusted under 35 U.S.C. 154(b) by 0 days.

(21) Appl. No.: 13/812,589

(22) PCT Filed: Jun. 23, 2011

(86) PCT No.: PCT/JP2011/064464

§ 371 (c)(1),
(2), (4) Date: Jan. 28, 2013

(87) PCT Pub. No.: WO2012/014610

PCT Pub. Date: Feb. 2, 2012

(65) Prior Publication Data

US 2013/0125802 A1 May 23, 2013

(30) Foreign Application Priority Data

Jul. 28, 2010 (JP) ..... 2010-169856
Mar. 28, 2011 (JP) ..... 2011-071144

(51) Int. Cl.
*D05B 49/00* (2006.01)
*D05B 47/00* (2006.01)

(52) U.S. Cl.
USPC ..... 112/242; 112/254

(58) Field of Classification Search
USPC ..... 112/241–250, 302, 254, 255
See application file for complete search history.

(56) References Cited

U.S. PATENT DOCUMENTS 4,215,641 A * 8/1980 Dobrjanskyj et al. ..... 112/278
4,590,879 A * 5/1986 Matsubara et al. ..... 112/278
4,949,657 A * 8/1990 Hanyu et al. ..... 112/470.12
5,345,887 A * 9/1994 Droste ..... 112/255
5,404,824 A * 4/1995 Hiraoka et al. ..... 112/254
7,513,203 B2 * 4/2009 Eklund ..... 112/302

* cited by examiner

*Primary Examiner* — Ismael Izaguirre
(74) *Attorney, Agent, or Firm* — Edwards Wildman Palmer LLP

(57) ABSTRACT

There is provided a needle thread tension controller that can control a magnitude of tension on a needle thread for each stitch, that can draw the needle thread with a slim chance of occurrence of a thread break, that easily, accurately detects occurrence of the thread break when the thread break has occurred, and that does not cause any excess or deficiency of a quantity of accumulated thread, which would otherwise be caused by drawing a needle thread. There are provided an upstream grip section 40 and a downstream grip section 60 for gripping a needle thread and a turning section 80 for turning the needle thread. In a torque control zone, rotating force is imparted to a turning arm in accordance with a torque value.

20 Claims, 48 Drawing Sheets

FIG. 6

ZONE POSITION DATA

| | STARTING PIONT | END POINT |
|---|---|---|
| TORQUE CONTROL ZONE (MAIN SPINDLE ANGLE) | $Z_1$ DEGREE | $Z_2$ DEGREE |
| POSITION CONTROL ZONE (MAIN SPINDLE ANGLE) | $Z_3$ DEGREE | $Z_4$ DEGREE |

FIG. 7

MAIN SPINDLE DATA (POSITION)

| TIME | MAIN SPINDLE ANGLE |
|---|---|
| $t_0$ | $a_0$ (=0) |
| $t_1$ | $a_1$ |
| $t_2$ | $a_2$ |
| . | . |
| . | . |
| . | . |
| . | . |
| . | . |
| $t_n$ | $a_n$ |

FIG. 9

NEEDLE THREAD CONTROL TORQUE DATA

| STITCH | TORQUE VALUE |
|---|---|
| STITCH 1 | $b_0$ |
| STITCH 2 | $b_1$ |
| . | . |
| . | . |
| . | . |
| . | . |
| . | . |
| . | . |
| STITCH n | $b_n$ |

FIG. 15

ANGLE CORRESPONDENCE DATA

| MAIN SPINDLE ANGLE | NEEDLE THREAD MOTOR ANGLE |
|---|---|
| $a_x$ | $C_n$ |
| $a_{x+1}$ | $C_{n-1}$ |
| $a_{x+2}$ | $C_{n-2}$ |
| $a_{x+3}$ | $C_{n-3}$ |
| . | . |
| . | . |
| . | . |
| $a_{y-3}$ | $C_3$ |
| $a_{y-2}$ | $C_2$ |
| $a_{y-1}$ | $C_1$ |
| $a_y$ | $C_0$ |

SEWING MACHINE

TECHNICAL FIELD

The present invention relates to a sewing machine (particularly to an embroidery sewing machine) and, particularly, to control of needle thread tension in a sewing machine.

BACKGROUND ART

As shown in FIG. 47, in a related-art sewing machine, a needle thread J runs out of a thread roll 98 wound around a needle thread bobbin and reaches a thread take-up lever 12*a* via a pretension component 96, a tension disc 95, a rotary tension component 94, and a tension spring (generally called a "high tension spring") 93 and subsequently a sewing needle 12*ba*.

The related-art sewing machine is also configured as shown in FIG. 48. A needle bar case 2314 that slides in a horizontal direction with respect to an arm 2312 has a needle bar case main body 2330 equipped with the thread take-up levers 12*a*, needle bars 12*b*, the tension springs 93, and others; and a needle thread adjustment member mounting section 2340 fixedly put on an upper surface of the needle bar case main body 2330. The needle thread adjustment member mounting section 2340 is equipped with the tension discs 95 and the rotary tension components 94 for adjusting tension of respective needle threads. Needle thread guides 1300 are placed above the respective tension discs 95, and needle thread guides 1302 are placed beneath the respective rotary tension components 94.

The related-art sewing machine is also equipped with a machine sewing thread feeding device described in connection with Patent Document 1. In relation to the machine sewing thread feeding device described in connection with Patent Document 1, the thread feeding device has a needle thread downstream gripper, an upper looper thread downstream gripper, and a lower looper thread downstream gripper. The needle thread downstream gripper grips a needle thread guided from a needle thread upstream gripper; the upper looper thread downstream gripper grips an upper looper thread guided from an upper looper thread upstream gripper; and the lower looper thread downstream gripper grips a lower looper thread guided from a lower looper thread upstream gripper. At the time of formation of a stitch, the needle thread downstream gripper is opened, whereupon the needle thread is drawn from the needle thread downstream gripper by a stitch forming device. During cloth feeding, the needle thread downstream gripper is closed. Similarly, at the time of formation of a stitch, the upper looper thread downstream gripper is opened, whereupon an upper looper thread is drawn from the upper looper thread downstream gripper by the stitch forming device. During cloth feeding, the upper looper thread downstream gripper is likewise closed. Moreover, at the time of formation of a stitch, the lower looper thread downstream gripper is also opened, whereupon a lower looper thread is drawn from the lower looper thread downstream gripper by the stitch forming device. During cloth feeding, the lower looper thread downstream gripper is closed. During feeding of a cloth, the upstream grippers are opened, and the downstream grippers are closed. A draw-in member moves while drawing a thread, thereby piling up the thread. On the contrary, during formation of a stitch, the upstream grippers are closed, and the downstream grippers are opened, the draw-in member moves to a position where the member does not draw the thread, and the thread is released.

The present applicants also filed the embroidery sewing machine described in connection with Patent Document 2.

RELATED ART DOCUMENT

Patent Document

Patent Document 1: Unexamined Japanese Patent Application Laid-Open No. 9-19583

Patent Document 2: Unexamined Japanese Patent Application Laid-Open No. 2010-178785

DISCLOSURE OF THE INVENTION

Problem that the Invention is to Solve

However, in the related-art configuration shown in FIG. 47, the needle thread J constantly undergoes frictional resistance developed in the tension disc 95 and frictional resistance developed in the rotary tension component 94. Since the frictional resistance is unstable (variable) as a resistance value, difficulty is encountered in controlling tension on the needle thread for each stitch. Moreover, when one head has a plurality of needle bars or when the sewing machine is a multi-head embroidery sewing machine, it is difficult to impart a same resistance value to a needle thread on a tension disc and a needle thread on a rotary tension component for each needle thread of one head. For these reasons, making tension exerted on respective needle threads uniform is difficult.

In the configuration shown in FIG. 47, the needle thread J is drawn from the thread roll 98 when the thread take-up lever 12*a* is pulled up. On this occasion, the needle thread J undergoes the frictional resistance developed in the tension disc 95 and the frictional resistance developed in the rotary tension component 94. Further, since the frictional resistance is unstable, the needle thread J cannot be smoothly drawn from the thread roll 98. Further, since the needle thread J is drawn when the take-up lever 12*a* has been pulled up, the needle thread J is drawn in a short period of time. The frictional resistance developed in the tension disc 95 and the frictional resistance developed in the rotary tension component 94 are exerted on the needle thread J; hence, the needle thread J may be cut by friction.

When the needle thread J has broken, the configuration shown in FIG. 47 can detect a threadbreak by means of non-rotation of the rotary tension component 94. However, slippage occurs between the rotary tension component 94 and the needle thread J. Therefore, there may be a case where the rotary tension component 94 will not rotate even when there is not occurrence of a thread break. For these reasons, the break of a needle thread cannot be accurately detected.

Moreover, in the machine sewing thread feeding device described in connection with Patent Document 1, only the draw-in membermoves, at the time of formation of a stitch, to the position where the thread is not drawn in. Accordingly, thread tension cannot be controlled. In an ordinary sewing machine, a period during which the thread take-up levers move upwards corresponds not to a period of formation of stitches but to a cloth feeding period. In the thread feeding device described in connection with Patent Document 1, since the downstream grippers are closed in the period during which the thread take-up levers ascend, controlling thread tension is originally impossible. In the thread feeding device described in connection with Patent Document 1, the draw-in member draws a given quantity of thread, and therefore an excess or deficiency may occur in the quantity of accumulated threads during cloth feeding operation depending on the quantity of thread consumed by each of stitches.

Accordingly, the problems that the present invention is to solve are to provide a needle thread tension controller that can control a magnitude of tension on a needle thread; in particular, tension on a needle thread for each stitch, make tension on the respective needle threads equal in the case of a multi-needle head or a multi-head embroidery sewing machine, and smoothly draw needle threads at the time of pulling of needle threads; that has a small possibility of breaking threads and that is easy to detect a thread break accurately when the thread break has occurred; and that does not cause any excess or deficiency of the quantity of accumulated thread, which would otherwise be caused by drawing a needle thread.

Means for Solving the Problem

The present invention has been conceived to solve the problem. In a first configuration, the present invention provides a sewing machine comprising: a thread take-up lever (12*a*, 12*a*-1 to 12*a*-9) formed in a swayable manner; a needle thread control section (30, 230) that is disposed at an upstream position on a needle thread path of the thread take-up lever and that includes an upstream grip section (40, 240, 1240) which includes an upstream grip section main body (41, 241, 1241) for pinching to thereby grip a needle thread and an upstream actuation section (50, 250) for switching, with respect to the upstream grip section main body, between a closed state in which the needle thread is gripped and an open state in which a needle thread is released from a gripped state, a downstream grip section (60, 260, 1260) which is disposed at a downstream position on a needle thread path of the upstream grip section and which includes a downstream grip section main body (61, 261, 1261) for pinching to thereby grip a needle thread and a downstream actuation section (70, 270) for switching, with respect to the downstream grip section main body, between a closed state in which the needle thread is gripped with respect to the downstream grip section main body and an open state in which the needle thread is released from a gripped state, and a turning section (80, 280, 1280) which turns the needle thread existing between the upstream grip section main body and the downstream grip section main body (or a position on the needle thread existing between the upstream grip section main body and the downstream grip section main body) and which has an turning arm (81, 281, 1281) contacting the needle thread (or "contacting the needle thread when turning the needle thread") and a needle thread motor (86, 286, 1286) for turning the turning arm; and a control section (90), in a control zone for each stitch, that—in a torque control zone including at least a portion of a zone from a bottom dead point to a top dead point of the thread take-up lever during which the thread take-up lever draws the needle thread with respect to processed fabric to be sewn with the needle thread—controls the needle thread motor in accordance with a torque value in such a way that tension is imparted to the needle thread against a direction in which the thread take-up lever draws the needle thread while the upstream grip section main body is closed and while the downstream grip section main body is opened, thereby imparting rotating force to the turning arm and that—in a position control zone which is at least a portion of a zone other than the torque control zone achieved while the upstream grip section main body is opened and while the downstream grip section main body is closed—controls the needle thread motor in accordance with angle position data pertaining to the needle thread motor in such a way that an angle of the needle thread motor returns to an initial angle position of the needle thread motor which is a rotational position of the needle thread motor, thereby imparting rotating force to the turning arm to thus draw the needle thread from an upstream position.

In the sewing machine having the first configuration, a needle thread is subjected to torque control in the torque control zone. Therefore, the magnitude of tension on the needle thread can be controlled. A torque value is set for each stitch, whereby torque control can be performed for each stitch. Tension on the needle thread can be controlled for each stitch, so that seam hardness can be controlled for each stitch.

Even in the case of a multi-needle head or when a stitch is formed from different needle threads, tension on the needle thread can be equally controlled by means of making torque values equal. Further, even in the case of a multi-head embroidery sewing machine, torque values employed in the torque control zone are made common to the heads, whereby tension on the needle threads exerted by the respective heads can be made equal.

Further, the needle thread control section is provided in place of the tension disc and the rotary tension component in the related-art sewing machine. As a result, in the position control zone where the needle thread is drawn, the upstream grip section main body becomes open. Frictional resistance attributable to the tension disc and the rotary tension component does not exist in an upstream position with respect to the turning arm of the turning section. Further, since the downstream grip section main body becomes closed, movements of the thread take-up lever will not pose any problem at the time of drawing of the needle thread. Consequently, the needle thread can be smoothly drawn from the thread roll, so that the risk of occurrence of a thread break can be made small.

If a break has occurred in the needle thread, the turning arm will not be pulled, in the torque control zone, in a direction opposite to the direction in which the rotating force of the needle thread motor is imparted when the thread take-up lever moves to its top dead center. Hence, occurrence of a thread break can be detected by detecting that the turning arm does not turn in a direction opposite to the direction in which the rotating force of the needle thread motor is imparted. Further, when there are not any thread breaks, the turning arm turns, in the torque control zone, in the direction opposite to the direction in which the needle thread motor imparts rotating force. Hence, occurrence of a thread break can be detected accurately.

In the position control zone, rotating force is imparted to the turning arm in accordance with angle position data pertaining to the needle thread motor such that the angle of the needle thread motor returns to the initial angle position of the needle thread motor that is a rotational position of the needle thread motor. The needle thread can therefore be drawn by an amount corresponding to a quantity of thread consumed as a result of pulling of the turning arm in the direction opposite to the direction in which the rotating force of the needle thread motor is imparted, so that an excess or deficiency of the quantity of accumulated thread, which would otherwise be caused by drawing a needle thread, will not occur.

In the first configuration, the thread take-up lever can also be taken as a "thread take-up lever (12*a*, 12*a*-1 to 12*a*-9) into which a needle thread (a needle thread to be inserted into a sewing needle) is inserted and that sways around the rotating center."

In a second configuration based on the first configuration, the sewing machine further comprises: an arm (312, 1312) making up an enclosure of the sewing machine; a needle bar case (314, 1314) that is provided so as to be slidable in a horizontal direction with respect to the arm and that includes first opening sections (316*b*, 1342*b*) made at positions between the upstream grip section main body and the downstream grip section main body in a vertical direction such that a leading end of the turning arm of the turning section can be exposed to the front side (or the "front side may also be opposite to the arm side"), a second opening section (316*a*, 1342*a*) which is provided above the first opening section and onto which the upstream magnet section fronts, and a third opening section (316*c*, 1342*c*) that is placed below the first opening sections and on which a downstream magnet section fronts; a plurality of needle bars (12*b*-1 to 12*b*-9) provided in a needle bar case; and needle thread supporting members (288, 1288) that each is provided in the needle bar case and that each supports the needle thread in the horizontal direction at the position of each of the first opening sections (or the needle thread supporting members can also be embodied as a "needle thread supporting members that each is provided in the needle bar case and horizontally support the needle thread with respect to the front side of each of the first opening sections"), wherein the thread take-up lever is placed while being exposed from a position in the needle bar case below the downstream grip section to a front; the turning arm is turned while remaining in contact with the needle thread supported by the needle thread supporting member, thereby turning the needle thread; the upstream grip section main body is placed on a front side of the needle bar case and, has plurality of upstream first plate-like sections (242-1 to 242-6, 1242*a*, 1404, 1422) which is formed into a shape of a plate from a magnetic substance; that is, a material attracted by the magnet and which is provided in the needle bar case and an upstream second plate-like section (244, 1244, 1408, 1426) which is provided at back side of the upstream first plate-like sections and on a front side of the second opening section and which is formed into a shape of a plate from a non-magnetic substance unattracted by the magnet; the upstream actuation section is a magnet section serving as the upstream magnet section and secured to the arm-side secured in the direction of the arm) at a back side of the upstream second plate-like section and switches between a closed state in which the upstream first plate-like section is attracted by magnetic force, to thus pinch and grip the needle thread between the upstream first plate-like section and the upstream second plate-like section and an open state in which attraction caused by the magnetic force is released to thereby release the needle thread from the gripped state; the downstream grip section main body is placed on a front side of the needle bar case and below the upstream grip section main body and has a plurality of downstream first plate-like sections (262-1 to 262-6, 1262*a*, 1414, and 1432) which are formed from a magnetic substance which is attracted by a magnet into a shape of a plate and which are provided in the needle bar case and a downstream second plate-like section (264, 1264, 1418, 1436) which is provided at back side of the downstream first plate-like sections and on a front side of the second opening section and which is formed into a shape of a plate from a non-magnetic substance unattracted by the magnet; and the downstream actuation section is a magnet section serving as the downstream magnet section and secured to the arm-side at a back side of the downstream second plate-like section and switches between a closed state in which the downstream first plate-like section is attracted by magnetic force, to thus pinch and grip the needle thread between the downstream first plate-like section and the downstream second plate-like section and an open state in which the needle thread is released from the gripped state by means of canceling attraction caused by the magnetic force.

When the structure including the upstream grip section, the downstream grip section, and the turning section is applied to a multi-needle head, the sewing machine can be configured by providing only one each of the upstream magnet section of the upstream grip section, the downstream magnet section of the downstream grip section, and the turning section. Accordingly, the sewing machine can be provided with an efficient structure while its manufacturing cost is curtailed.

In the second configuration, the configuration of the needle bar case can also be embodied as a "needle bar case (314, 1314) provided so as to be slidable with respect to the arm. In the needle bar case, a first opening section (316*b*, 1342*b*) is provided between the upstream grip section main body and the downstream grip section main body in the vertical direction on the front side that is opposite to the arm side, in such a way that the leading end of the turning arms of the turning section can be exposed from the interior of the needle bar case. A second opening section (316*a*, 1342*a*) on that the upstream magnet section fronts is provided at a position above the first opening section. A third opening section (316*c*, 1342*c*) on that the downstream magnet section fronts is provided at a position below the first opening section."

In a third configuration based on the first or second configuration, the control section performs control operation in accordance with torque data whose torque value is specified for each stitch in the torque control zone and detects, at a starting point of the position control zone, a current angle position of the needle thread motor in the position control zone, generates angle correspondence data which specify an angle of the needle thread motor from the current angle position to an initial angle position of the needle thread motor for each angle of a main spindle motor representing a rotational position of the main spindle motor which rotates a main spindle for transmitting power to the thread take-up lever, and controls a position of the needle thread motor to its angle of the needle thread motor corresponding to the angle of the main spindle motor as the angle of the main spindle motor changes as a result of rotation of the main spindle motor.

Since a torque value is specified for each stitch by means of the torque data, tension on the needle thread can be controlled on a per-stitch basis during torque control. During position control, angle correspondence data are prepared. Hence, angle position control of the needle thread motor can be performed in accordance with the angle correspondence data.

The following configuration can also be adopted. Specifically, there is provided a sewing machine comprising:

a thread take-up lever (12*a*, 12*a*-1 to 12*a*-6) that enables insertion of a needle thread to be inserted into a sewing needle and that sways around a rotating center;

a main spindle (22) that is rotated by a main spindle motor (20) and that transmits power to the thread take-up lever;

a needle thread control section (30, 230) that is provided at an upstream position along the needle tread and that includes an upstream grip section (40, 240) having an upstream grip section main body (41, 241) that pinches to thereby grip the needle thread and an upstream actuation section (50, 250) that switches, with respect to the upstream grip section main body, between a closed state in which the needle thread is gripped and an open state in which a needle thread is released from a gripped state, a downstream grip section (60, 260) which is disposed at a downstream position on a needle thread path of the upstream grip section and which has a downstream grip section main body (61, 261) for pinching to thereby grip the needle thread and a downstream actuation section (70, 270) for switching, with respect to the downstream grip section main body, between a closed state in which the needle thread is gripped and an open state in which the needle thread is released from a gripped state, and a turning section (80, 280) which turns a position on the needle thread located between the upstream grip section main body and the downstream grip section main body and which includes a turning arm (81, 281) remaining in contact with the needle thread and a needle thread motor (86, 286) for turning the turning arm; and a control section (90) that—in a torque control zone of control zone for each stitch including at least a portion of a zone from a bottom dead point to a top dead point of the thread take-up lever during which the thread take-up lever draws the needle thread with respect to processed fabric to be sewn with the needle thread—controls the needle thread motor in accordance with a torque value in such a way that tension is imparted to the needle thread against a direction in which the thread take-up lever draws the needle thread in accordance with torque data which are generated from embroidery data and whose torque value is specified for each stitch, while the upstream grip section main body is closed and while the downstream grip section main body is opened, thereby imparting rotating force to the turning arm and that—in a position control zone of control zone for each stitch which is at least a portion of a zone other than the torque control zone achieved while the upstream grip section main body is opened and while the downstream grip section main body is closed—detects at a starting point of the position control zone a current angle position of the needle thread motor which is a rotational position of the needle thread motor while the upstream grip section main body is opened and while the downstream grip section main body is closed, generates angle correspondence data which specify an angle of the needle thread motor from the current angle position to an initial angle position of the needle thread motor for each angle of the main spindle transmitting power to the thread take-up lever, and controls a position of the needle thread motor to its angle corresponding to the angle of the main spindle motor as the angle of the main spindle motor changes as a result of rotation of the main spindle motor in such a way that the angle of the needle thread motor returns to an initial angle position of the needle thread motor, to thus impart rotating force to the turning arm and draw a needle thread from an upstream position.

In a fourth configuration, there is provided a sewing machine comprising: an arm (312, 1312) making up an enclosure of the sewing machine;

a needle bar case (314, 1314) that is provided so as to be slidable in a horizontal direction with respect to the arm and that includes first opening sections (316*b*, 1342*b*) made at positions between an upstream grip section main body and a downstream grip section main body in a vertical direction such that a leading end of a turning arm of a turning section can be exposed to the front side (or a front side that is on the other side with reference to the arm side), a second opening section (316*a*, 1342*a*) which is provided above the first opening section and on which an upstream magnet section fronts, and a third opening section (316*c*, 1342*c*) which is provided below the first opening section and onto which the downstream magnet section fronts; a plurality of thread take-up levers (12*a*-1 to 12*a*-9) that are provided on a front side of the needle bar case in an exposed fashion and that are provided at downstream positions on needle thread paths with respect to a downstream grip section in a swayable manner; a plurality of needle bars (12*b*-1 to 12*b*-9) provided in the needle bar case; an upstream grip section (240, 1240) that has the upstream grip section main body (241, 1241) that is placed on a front side of the needle bar case, that pinches to thereby grip the needle thread, and that has upstream first plate-like sections (242-1 to 242-6, 1242*a*, 1404, 1422) which is formed from a magnetic substance that is a material attracted by the magnet, and which is provided for the respective needle bars and an upstream second plate-like section (244, 1244, 1408, 1426) which is provided at back side of the upstream first plate-like sections and on a front side of the second opening section and which is formed from a non-magnetic substance unattracted by the magnet, and an upstream magnet section (250, 1250) that is secured to the arm side and that switches between a closed state in which the needle thread is pinched and gripped between the upstream first plate-like section and the upstream second plate-like section by means of attracting the upstream first plate-like section from a back side of the upstream second plate-like section by means of magnetic force and an open state in which the needle thread is released from the gripped state by canceling attraction caused by magnetic force; the downstream grip section (260, 1260) that is provided at a downstream position along the needle thread path of the upstream grip section and that has a downstream grip section main body (261, 1261) which is placed at a position on a front side of the needle bar case below the upstream grip section main body, which pinches to thereby grip the needle thread, and which has downstream first plate-like sections (262-1 to 262-6, 1262*a*, 1414, 1432) which is formed from a magnetic substance that is a material attracted by the magnet, and which is provided for the respective needle bars and a downstream second plate-like section (264, 1264, 1418, and 1436) which is provided at back side of the downstream first plate-like sections and on a front side of the second opening section and that is formed from a non-magnetic substance unattracted by the magnet, and a downstream magnet section (270, 1270) which is secured to the arm side and which switches between a closed state in which the needle thread is pinched to thereby grip between the downstream first plate-like section and the downstream second plate-like section by means of attracting the downstream first plate-like section from a back side of the downstream second plate-like section by magnetic force and an open state in which the needle thread is released from a gripped state by canceling attraction caused by the magnetic force; needle thread supporting members (288, 1288) that each is provided in the needle bar case and that each supports the needle thread in its horizontal direction at the position of each of the first opening sections (the needle thread supporting members can also be expressed as being provided in the needle bar case and each supporting the needle thread on the front side of each of the first opening sections in the horizontal direction); a turning section (280, 1280) that turns the needle thread existing between the upstream grip section main body and the downstream grip section main body (or "a position on the needle thread located between the upstream grip section main body and the downstream grip section main body") and that has the turning arm (281, 1281) which contacts the needle thread supported by the needle thread supporting member and a needle thread motor (286, 1286) which is secured to the arm side and which turns the turning arm (this can also be expressed as "the turning section contacting the needle thread supported by the needle thread supporting member when the needle thread is turned"); and a control section (90), in a control zone for each stitch, that—in a torque control zone including at least a portion of a zone from a bottom dead point to a top dead point of the thread take-up lever during which the thread take-up lever draws the needle thread with respect to processed fabric to be sewn with the needle thread—controls the needle thread motor in accordance with a torque value in such a way that tension is imparted to the needle thread against a direction in which the thread take-up lever draws the needle thread in accordance with torque data which are generated from embroidery data and whose torque value is specified for each stitch, while the upstream grip section main body is closed and while the downstream grip section main body is opened, thereby imparting rotating force to the turning arm in an upward direction and that—in a position control zone which is at least a portion of a zone other than the torque control zone achieved while the upstream grip section main body is opened and while the downstream grip section main body is closed—detects at a starting point of the position control zone a current angle position of the needle thread motor which is a rotational position of the needle thread motor, generates angle correspondence data which specify an angle of the needle thread motor from the current angle position to an initial angle position (this can also be expressed as an "initial position corresponding to the top dead center of the turning arm") of the needle thread motor for each angle of a main spindle motor representing a rotational position of the main spindle motor (20) which rotates a main spindle (22) for transmitting power to the thread take-up levers and the needle bars, controls a position of the needle thread motor to its angle corresponding to the angle of the main spindle motor as the angle of the main spindle motor changes as a result of rotation of the main spindle motor in such a way that the angle of the needle thread motor returns to an initial angle position of the needle thread motor, to thus impart rotating force to the turning arm in an upward direction and draw a needle thread from an upstream position, turns the turning arm downward so as to recede to a receded position (this can also be expressed as "the turning arm being turned downwardly and then receded to a receded position") (or as "the turning arm being turned downwardly and then receded to a receded position that is lower than a location where the turning arm contacts the needle thread supported by the needle thread supporting member") when processing proceeds to control of a next stitch and when a needle thread to be selected is changed, and slides the needle bar case, thereby letting the upstream magnet section, the downstream magnet section, and the turning arm come to a position of the selected needle thread.

In the sewing machine having the fourth configuration, a needle thread is subjected to torque control in the torque control zone. Therefore, the magnitude of tension on the needle thread can be controlled. Since the magnitude of tension is controlled in accordance with torque data whose torque values are specified for each stitch, torque control can be performed for each stitch. Consequently, tension on the needle thread can be controlled for each stitch, so that seam hardness can be controlled for each stitch.

In a multi-needle head having a plurality of needle bars, even when a stitch is formed from different needle threads, tension on the needle thread can be equally controlled by means of making torque values in the needle thread control torque data equal. Further, even in the case of a multi-head embroidery sewing machine, needle thread control torque data employed in the torque control zone are made common to the heads, whereby tension on the needle threads exerted by the respective heads can be made equal.

Further, the needle thread control section is provided in place of the tension disc and the rotary tension component in the related-art sewing machine. As a result, in the position control zone where the needle thread is drawn, the upstream grip section main body becomes open. Frictional resistance attributable to the tension disc and the rotary tension component does not exist in an upstream position with respect to the turning arm of the turning section. Further, the downstream grip section main body becomes closed. Consequently, movements of the thread take-up lever will not hinder when the needle thread is drawn; hence, the needle thread can be smoothly drawn from the thread roll, so that the risk of occurrence of a thread break can be made small.

If a break has occurred in the needle thread, the turning arm will not be pulled in a downward direction that is a direction opposite to the direction in which the rotating force of the needle thread motor is imparted when the thread take-up lever moves to its top dead center in the torque control zone. Hence, occurrence of a thread break can be detected by detecting that the turning arm has not turned downwardly. Further, when there are not any thread breaks, the turning arm turns downwardly in the torque control zone. Hence, occurrence of a thread break can be detected accurately.

In the position control zone, a current angle of the needle thread motor is detected, and angle correspondence data for controlling a position of the needle thread motor to its initial angle position are prepared. There is performed control operation for returning the needle thread motor to its initial angle position by means of position control in accordance with the angle correspondence data. In the torque control zone, the needle thread can therefore be drawn by only the amount corresponding to a quantity of thread consumed as a result of pulling of the turning arm, so that an excess or deficiency of the quantity of accumulated thread, which would otherwise be caused by drawing a needle thread, will not occur.

When the structure including the upstream grip section, the downstream grip section, and the turning section is applied to a multi-needle head, the sewing machine can be configured by providing only one each of the upstream magnet section of the upstream grip section, the downstream magnet section of the downstream grip section, and the turning section. Accordingly, the sewing machine can be provided with an efficient structure while its manufacturing cost is curtailed.

In the fourth configuration, the configuration of the needle bar case (314, 1314) can also be embodied as a "needle bar case provided so as to be slidable with respect to the arm. In the needle bar case, first opening sections (316*b*, 1342*b*) are provided at respective positions between the upstream grip section main body and the downstream grip section main body in the vertical direction on the front side that is opposite to the arm side, in such a way that a leading end of a turning arm of a turning section can be exposed from the interior of the needle bar case. A second opening section (316*a*, 1342*a*) on that an upstream magnet section fronts is provided at a position above the first opening section. A third opening section (316*c*, 1342*c*) on that a downstream magnet section fronts is provided at a position below the first opening section." In the fourth configuration, the configuration of the thread take-up lever can also be embodied as a "thread take-up lever (12*a*-1 to 12*a*-9) that is provided at a position on the needle bar case below a downstream grip section so as to become exposed to the front side and that permits insertion of the needle thread to be inserted into a sewing needle and that sways around the rotating center."

The fourth configuration can also be modified as follows. Specifically, the sewing machine can also be configured by comprising:

an arm (312) making up an enclosure of the sewing machine;

a plurality of thread take-up levers (12*a*-1 to 12*a*-6) that are provided on the arm, into which needle threads to be inserted into respective sewing needles are inserted, and that sway around a rotating center;

a needle bar case (314) that is provided so as to be slidable with respect to the arm and that includes a first opening section (316*b*) made at positions between an upstream grip section main body and a downstream grip section main body on a front side opposite to the arm side in a vertical direction such that a leading end of a turning arm of a turning section can be exposed from inside of the needle bar case and a second opening section (316*d*) provided below the downstream grip section main body making up the downstream grip section and on the front side so as to enable the thread take-up lever to be exposed from inside of the needle bar case;

a plurality of needle bars (12*b*-1 to 12*b*-6) provided in the needle bar case;

an upstream grip section (240) including the upstream grip section main body (241) which is placed on a front side of the needle bar case, which pinches to thereby grip the needle thread, and which includes a plurality of upstream first plate-like sections (242-1 to 242-6) formed into a shape of a plate from a magnetic substance that is a material which is attracted by the magnet, an upstream second plate-like section (244) which is placed on a back side of the upstream first plate-like sections and which is formed in the form of the plate from a non-magnetic substance unattracted by the magnet, and a mounting member (246) for attaching in a hanging fashion the upstream first plate-like sections and the upstream second plate-like section to the needle bar case, and an upstream magnet section (250) which is provided on the arm and on a back side of the upstream second plate-like section and which switches between a closed state in which the needle thread is pinched and gripped between the upstream first plate-like sections and the upstream second plate-like section by attracting the upstream first plate-like sections with magnetic force and an open state in which the needle thread is released from a gripped state by canceling magnetic attraction;

a downstream grip section (260) placed at a downstream position on the needle thread path of the upstream grip section and including the downstream grip section main body (261) which are placed on the front side of the needle bar case and below the upstream grip section main body, which pinches to thereby grip the needle thread, and which includes a plurality of downstream first plate-like sections (262-1 to 262-6) formed into a shape of a plate from a magnetic substance that is a material which is attracted by a magnet, a downstream second plate-like section (264) which is placed on a back side of the downstream first plate-like sections and which is formed in the form of the plate from a non-magnetic substance unattracted by the magnet, and a mounting member (266) for attaching in a hanging fashion the downstream first plate-like sections and the downstream second plate-like section to the needle bar case, and a downstream magnet section (270) which is placed on the arm facing a back side of the downstream second plate-like section and which switches between a closed state in which the needle thread is pinched and gripped between the downstream first plate-like sections and the downstream second plate-like section by attracting the upstream first plate-like sections with magnetic force and an open state in which the needle thread is released from the gripped state by canceling magnetic attraction;

needle thread supporting members (288) which each supports the needle thread on the front side of each of the first opening sections in a horizontal direction when viewed from the front;

the turning section (280) which turns a position on the needle thread located between the upstream grip section main body and the downstream grip section main body and which includes the turning arm (281) which contacts the needle thread supported by the needle thread supporting member, and a needle thread motor (286) which is provided on the arm and which turns the turning arm; and a control section (90), in a control zone for each stitch, that—in a torque control zone including at least a portion of a zone from a bottom dead point to a top dead point of the thread take-up lever during which the thread take-up lever draws the needle thread with respect to processed fabric to be sewn with the needle thread controls the needle thread motor in accordance with a torque value in such a way that tension is imparted to the needle thread against a direction in which the thread take-up lever draws the needle thread while the upstream grip section main body is closed and while the downstream grip section main body is opened in accordance with torque data which are prepared from embroidery data and whose torque value is specified for each stitch, thereby imparting rotating force to the turning arm in an upward direction, and that—in a position control zone which is at least a portion of a zone other than the torque control zone achieved while the upstream grip section main body is held in an open state and the downstream grip section main body is held in a closed state detects at a starting point of the position control zone a current angle position of the needle thread motor which is a rotational position of the needle thread motor, generates angle correspondence data which specify an angle of the needle thread motor from a current angle position to an initial angle position of the needle thread motor for each angle of a main spindle motor, i.e., a rotational position of the main spindle motor (20) which rotates a main spindle (22) for transmitting power to the thread take-up lever and the needle bar, controls the position of the needle thread motor to an angle of the needle thread motor corresponding to the angle of the main spindle motor as an angle of the main spindle motor changes as a result of rotation of the main spindle motor, in such a way that the angle of the needle thread motor returns to the initial angle position of the needle thread motor, thereby imparting rotating force to the turning arm in an upward direction to draw the needle thread from an upstream position, and lets the turning arm recede to a receded position lower than an initial position of the turning arm and the needle bar case slide when processing proceeds to control of a next stitch and when a needle thread to be selected is changed, so that the upstream magnet section, the downstream magnet section, and the turning arm come to a position of the selected needle thread.

In a fifth configuration based on the second or fourth configuration, the sewing machine is characterized in that the needle thread is guided downward after passing through spacing between the upstream first plate-like section and the upstream second plate-like section of the upstream grip section main body, reaches the needle thread supporting member while a path of the needle thread is inverted by a first needle thread path inverting member (290, 1290) provided on the needle bar case, is guided downwardly from the needle thread supporting member and subsequently passes through spacing between the downstream first plate-like section and the downstream second plate-like section in the downstream grip section main body, reaches the thread take-up lever while a path of the needle thread is inverted by a second needle thread path inverting member (292, 1337) provided in the needle bar case, and reaches a sewing needle attached to the needle bar while being guided downward from the thread take-up lever.

In a sixth configuration based on the fifth configuration, the first needle thread path inverting member has a main body section (ga-1) having a cylindrical peripheral and a base end section (ga-2) which continually extends from a base end of the main body section and which is formed so as to have a diameter smaller than a diameter of the main body section; an indentation section (1343*b*) used for inserting an end section of the base-end section side of the main body section and a hole section (1343*a*) which continually extends from the indentation section and which is used for inserting the base end section are formed at positions on the needle bar case where the first needle thread path inverting member and the second needle thread path inverting member are to be attached; the base end section is inserted into the hole section; and an end section of the base-end section side of the main body section is inserted into the indentation section.

Since the ends on the base-end section side of the main body section are inserted and buried in the respective indentation sections, a possibility of the needle thread being caught by spacing between the base end of the main body section and a surface of the needle bar case can be eliminated.

A seventh configuration based on the second, fourth, fifth, or sixth configuration is characterized in that first guide members (252, 254, 1252, 1254) set above and below the upstream first plate-like section on the needle bar case are placed at positions that differ from each other in a horizontal direction in the upstream grip section main body; each of the needle thread paths existing between the upstream first plate-like section and the upstream second plate-like section is formed obliquely with respect to a vertical direction; second guide members (272, 274, 1272, 1274) set above and below the downstream first plate-like section on the needle bar case are placed at positions that differ from each other in a horizontal direction in the downstream grip section main body; and each of the needle thread paths existing between the downstream first plate-like section and the downstream second plate-like section is formed obliquely with respect to a vertical direction.

In the upstream grip section main body, the needle thread path on the back side of the first plate-like section can be assured in an elongated manner, so that the needle thread can be gripped between the first plate-like section and the second plate-like section more reliably. In the downstream grip section main body, the needle thread path on the back side of the third plate-like section can be assured in an elongated manner, so that the needle thread can be gripped between the third plate-like section and the fourth plate-like section more reliably.

An eighth configuration based on the seventh configuration is characterized in that each of the first guide members and the second guide members has a main body section (ga-1) having a cylindrical peripheral and a base end section (ga-2) which continually extends from a base end of the main body section and which is formed so as to have a diameter smaller than a diameter of the main body section; an indentation section (1343*b*) used for inserting an end section of the base-end section side of the main body section and a hole section (1343*a*) which continually extends from the indentation section and which is used for inserting the base end section are formed at positions on the needle bar case where the first guide members and the second guide members are to be attached; the base end section is inserted into the hole section; and an end section on the base-end section side of the main body section is inserted into the indentation section.

Since the ends on the base-end section side of the main body section are inserted and buried in the respective indentation sections, a possibility of the needle thread being caught by spacing between the base end of the main body section and the surface of the needle bar case can be eliminated.

A ninth configuration based on the second, fourth, fifth, sixth, seventh, or eighth configuration is characterized in that the needle bar case has a needle bar case main body (1330) that is provided with the thread take-up levers and the needle bars and that is provided so as to be slidable with respect to the arm and a plate-like plate section (1341) provided on an upper surface of the needle bar case main body; and the plate section has the first opening sections, the second opening section, the third opening section, the upstream grip section, the downstream grip section, and the needle thread supporting member.

Therefore, as long as the related-art sewing machine is equipped with the plate section including the first opening sections, the second opening section, the third opening section, the upstream grip section, the downstream grip section, and the needle thread supporting member, in place of the needle thread adjustment member mount section having the tension disc and the rotary tension component, the configuration of the related-art sewing machine can be utilized. Hence, manufacturing cost can be curtailed.

A tenth configuration based on the second, fourth, fifth, sixth, seventh, eighth, or ninth configuration is characterized in that a magnet section/motor supporting member (1360) that supports the upstream magnet section, the downstream magnet section, and the needle thread motor, and is secured to the arm.

An eleventh configuration based on the second, fourth, fifth, sixth, seventh, eighth, or ninth configuration is characterized by further comprising a magnet section/motor supporting member (1370) that supports the upstream magnet section, a downstream magnet section, and the needle thread motor, and a sliding support member (1350, 1352) that is provided in the needle bar case and that slidably supports the magnet section/motor supporting member in a horizontal direction when viewed from the front, and a slide regulation member (1380) that is secured to the arm and that regulates horizontal sliding action of the magnet section/motor supporting member, to thus horizontally position the supporting member; and the upstream magnet section, the downstream magnet section, and the needle thread motor are fixedly provided on the arm side as a result of horizontal sliding action of the magnet section/motor supporting member being regulated by the slide regulation member.

In the eleventh configuration, when the magnet section/motor supporting member is attached to the sewing machine, the magnet section/motor supporting member is adjusted to an appropriate position while being slid along the sliding support member, the slide regulation member regulates horizontal sliding action of the magnet section/motor supporting member, whereby the upstream magnet section, the downstream magnet section, and the needle thread motor are secured to the arm side. Therefore, horizontal positions of the magnet section/motor supporting member can be finely adjusted, and horizontal positions of the upstream magnet section, the downstream magnet section, and the turning arm can be finely adjusted.

Moreover, a twelfth configuration based on the second, fourth, fifth, sixth, seventh, eighth, ninth, tenth, or eleventh configuration is characterized by further comprising an upstream first plate-like section supporting members (1401) that each has a first shaft section (1401*c*) to be inserted into a hole section of the upstream first plate-like section (1404) and that is provided on a front side of the needle bar case, an upstream coiled springs (1402) into each of which the first shaft section is to be inserted, and an upstream protective plate-like sections (1406) that each is secured to a leading end of the first shaft section and that is formed from a non-magnetic substance unattracted by the magnet, wherein the upstream first plate-like section is provided with the hole section used for inserting the first shaft section; the upstream second plate-like section remains in contact with a surface of the upstream protective plate-like section that is on the other side with respect to the upstream first plate-like section; the upstream first plate-like section is provided between the upstream coiled spring and the upstream protective plate-like section while the first shaft section remains inserted into the hole section; and the upstream first plate-like section is driven toward the upstream protective plate-like section by means of the upstream coiled spring; and further comprising a downstream first plate-like section supporting members (1411) that each has a second shaft section (1411*c*) to be inserted into the hole section of a downstream first plate-like section (1414) and that is provided on a front side of the needle bar case, a downstream coiled springs (1412) into each of which the second shaft section is to be inserted, and a downstream protective plate-like sections (1416) that each is secured to a leading end of the second shaft section and that is formed from a non-magnetic substance unattracted by the magnet, wherein the downstream first plate-like section is provided with the hole section used for inserting the second shaft section; the downstream second plate-like section remains in contact with a surface of the downstream protective plate-like section that is on the other side with respect to the downstream first plate-like section; the downstream first plate-like section is provided between the downstream coiled spring and the downstream protective plate-like section while the second shaft section remains inserted into the hole section; and the downstream first plate-like section is driven toward the downstream protective plate-like section by means of the downstream coiled spring.

Therefore, the upstream first plate-like section and the upstream protective plate-like section are driven toward the upstream second plate-like section by means of the upstream coiled spring. Even when the upstream first plate-like section is unattracted by the upstream magnet section, the upstream first plate-like section remains in contact with the upstream protective plate-like section, and the upstream protective plate-like section remains in contact with the upstream second plate-like section. Accordingly, vibration sound, which would otherwise arise as a result of repeated opening/closing of the upstream grip section main body or as a result of vibration of a head, can be prevented. Likewise, the downstream first plate-like section and the downstream protective plate-like section are driven toward the downstream second plate-like section by means of the downstream coiled spring. Even when the downstream first plate-like section is unattracted by the downstream magnet section, the downstream first plate-like section remains in contact with the downstream protective plate-like section, and the downstream protective plate-like section remains in contact with the downstream second plate-like section. Accordingly, vibration sound, which would otherwise arise as a result of repeated opening/closing of the downstream grip section main body or as a result of vibration of a head, can be prevented.

The upstream protective plate-like section (the downstream protective plate-like section) is interposed between the upstream second plate-like section (the downstream second plate-like section) and the needle thread. Therefore, abrasion of the upstream second plate-like section (the downstream second plate-like section), which would otherwise be caused as a result of the needle thread contacting the upstream second plate-like section (the downstream second plate-like section), can be prevented.

A thirteenth configuration based on the second, fourth, fifth, sixth, seventh, eighth, ninth, tenth, or eleventh configuration is characterized by further comprising an upstream sliding members (1421) that each is inserted into a position above the second opening section on the needle bar case and that each is provided so as to be slidable along a direction of an axis line of the upstream sliding member and an upstream driving members (1424) that each drives upstream sliding member to a back side of the needle bar case, wherein the upstream first plate-like section (1422) is provided while hanging on the upstream sliding member, and an upstream press operation member (1362) for pressing the upstream sliding member corresponding to the upstream first plate-like section which is attracted by the upstream magnet section in a direction opposite to a driving direction of the upstream driving member is provided on the arm side; and further comprising a downstream sliding members (1431) that each is inserted into a position above the third opening section on the needle bar case and that each is provided for each of the upstream first plate-like sections so as to be slidable in an axial direction of the downstream sliding member and a downstream driving members (1434) that each drives the downstream sliding member to the back side of the needle bar case, wherein the downstream first plate-like section (1432) is provided while hanging on the downstream sliding member, and a downstream press operation member (1364) for pressing the downstream sliding member corresponding to the downstream first plate-like section which is attracted by the downstream magnet section in a direction opposite to a driving direction of the downstream driving member is provided on the arm side.

Consequently, the upstream first plate-like sections corresponding to the needle bars other than the selected needle bar are pressed toward the upstream second plate-like section. Hence, sound, which would otherwise occur when the upstream first plate-like sections contacting the upstream second plate-like section, does not arise, nor does vibration sound attributable to head vibration arise. Moreover, since the upstream first plate-like section corresponding to the selected needle bar is not pressed to the back side by the upstream press operation member, so that the needle thread can be sufficiently released from a gripped state. Likewise, the downstream first plate-like sections corresponding to the needle bars other than the selected needle bar are pressed toward the downstream second plate-like section. Hence, sound, which would otherwise occur when the downstream first plate-like sections contacting the downstream second plate-like section, does not arise, nor does vibration sound attributable to head vibration arise. Moreover, since the downstream first plate-like section corresponding to the selected needle bar is not pressed to the back side by the downstream press operation member, so that the needle thread can be sufficiently released from a gripped state.

A fourteenth configuration is characterized by a sewing machine comprising: an arm (1312) making up an enclosure of the sewing machine; a needle bar housing case (1330) that is disposed so as to be slidable in a horizontal direction with respect to the arm and that houses a plurality of needle bars (12*b*-1 to 12*b*-9); a tabular plate section (1341) that is disposed on an upper surface of the needle bar housing case and that is provided with first opening sections (1342*b*) placed at positions between an upstream grip section main body and a downstream grip section main body in a vertical direction such that a leading end of a turning arm of a turning section can be exposed to the front side (or a "front side opposite to the arm side"), a second opening section (1342*a*) which is provided above the respective first opening sections and on which an upstream magnet section fronts, and a third opening section (1342*c*) that is provided below the first opening section and on which a downstream magnet section fronts; a plurality of thread take-up levers (12*a*-1 to 12*a*-9) that are axially supported by the needle bar housing case in a swayable manner, that are provided on a front side of the needle bar housing case in an exposed fashion, and that are provided at downstream positions on needle thread paths with respect to a downstream grip section; an upstream grip section (1240) that has the upstream grip section main body (1241) that is placed on a front side of the plate section, that pinches to thereby grip a needle thread, and has upstream first plate-like sections (1242*a*, 1404, 1422) which is formed from a magnetic substance that is a material attracted by the magnet, and which is provided for the respective needle bars, and an upstream second plate-like section (1244, 1408, 1426) which is placed on a front side of the second opening section while facing a back side of the upstream first plate-like section and which is formed from a non-magnetic substance unattracted by the magnet, and the upstream magnet section (1250) that is secured to the arm side and that switches between a closed state in which the needle thread is pinched and gripped between the upstream first plate-like section and the upstream second plate-like section by means of attracting the upstream first plate-like section from a back side of the upstream second plate-like section by magnetic force and an open state in which the needle thread is released from the gripped state by canceling attraction caused by magnetic force; the downstream grip section (1260) that is placed at a downstream position along a needle thread path of the upstream grip section and has a downstream grip section main body (1261) which is placed below the upstream grip section main body on a front side of the plate section, which pinches to thereby grip the needle thread, and which has downstream first plate-like sections (1262*a*, 1414, 1432) which is formed from a magnetic substance that is a material attracted by a magnet and which is provided for respective needle bars, and a downstream second plate-like section (1264, 1418, 1436) which is placed on a front side of the second opening section while facing a back side of the downstream first plate-like section and formed from a non-magnetic substance unattracted by the magnet, and the downstream magnet section (1270) which is secured to the arm side and which switches between a closed state in which the needle thread is pinched and gripped between the downstream first plate-like section and the downstream second plate-like section by means of attracting the downstream first plate-like section from a back side of the downstream second plate-like section by magnetic force and an open state in which the needle thread is released from a gripped state by canceling attraction caused by the magnetic force; needle thread supporting members (1288) (this can also be expressed as a "needle thread supporting members that each is placed on the plate section and supports the needle thread on the front side of each of the first opening sections and in the horizontal direction") that each is provided in the plate section and that each supports the needle thread in its horizontal direction at the position of each of the first opening sections; the turning section (1280) that turns the needle thread existing between the upstream grip section main body and the downstream grip section main body (this can also be expressed as "a position on the needle thread existing between the upstream grip section main body and the downstream grip section main body") and that has the turning arm (1281) which contacts the needle thread supported by the needle thread supporting member and a needle thread motor (1286) which is secured to the arm side and which turns the turning arm (this can also be expressed as a "turning arm that contacts a needle thread supported by the needle thread supporting member when the needle thread is turned"); and a control section (90), min a control zone for each stitch, that—in a torque control zone including at least a portion of a zone from one dead point to another dead point of the thread take-up lever during which the thread take-up lever draws the needle thread with respect to processed fabric to be sewn with the needle thread—controls the needle thread motor in accordance with a torque value in such a way that tension is imparted to the needle thread against a direction in which the thread take-up lever draws the needle thread in accordance with torque data which are generated from embroidery data and whose torque value is specified for each stitch, while the upstream grip section main body is closed and while the downstream grip section main body is opened, thereby imparting rotating force to the turning arm in an upward direction, and that in a position control zone which is at least a portion of a zone other than the torque control zone achieved while the upstream grip section main body is opened and while the downstream grip section main body is closed—detects at a starting point of the position control zone a current angle position of the needle thread motor which is a rotational position of the needle thread motor, generates angle correspondence data which specify an angle of the needle thread motor from the current angle position to an initial angle position of the needle thread motor (this can also be expressed as an "initial position that is one corresponding to the top dead center of the turning arm") for each angle of a main spindle motor (20) representing a rotational position of the main spindle motor which rotates a main spindle (22) for transmitting power to the thread take-up lever and the needle bar, controls a position of the needle thread motor to its angle corresponding to the angle of the main spindle motor as the angle of the main spindle motor changes as a result of rotation of the main spindle motor in such a way that the angle of the needle thread motor returns to an initial angle position of the needle thread motor, to thus impart rotating force to the turning arm in an upward direction and draw a needle thread from an upstream position, turns the turning arm downward so as to recede to a receded position (this can also be expressed as "the turning arm is turned and receded to a lower receded position") (or "the turning arm is turned downward so as to recede to a receded position located below a position where the turning arm contacts the needle thread supported by the needle thread supporting member") when processing proceeds to control of a next stitch and when a needle thread to be selected is changed, and slides the needle bar housing case, thereby letting the upstream magnet section, the downstream magnet section, and the turning arm come to a position of the selected needle thread.

In the sewing machine having the fourteenth configuration, a needle thread is subjected to torque control in the torque control zone. Therefore, a magnitude of tension on the needle thread can be controlled. Since the magnitude of tension is controlled according to torque data whose torque value is specified for each stitch, torque control can be performed for each stitch. The tension on the needle thread can be controlled for each stitch, so that seam hardness can be controlled on a per-stitch basis.

In a multi-needle head having a plurality of needle bars, even when a stitch is formed from different needle threads, tension on the needle thread can be equally controlled by means of making torque values in the needle thread control torque data equal to each other. Further, even in the case of a multi-head embroidery sewing machine, the needle thread control torque data employed in the torque control zone are made common to the heads, whereby tension on the needle threads exerted by the respective heads can be made equal.

Further, the needle thread control section is provided in place of the tension disc and the rotary tension component in the related-art sewing machine. As a result, in the position control zone where the needle thread is drawn, the upstream grip section main body becomes open. Frictional resistance attributable to the tension disc and the rotary tension component does not exist in an upstream position with respect to the turning arm of the turning section. Further, the downstream grip section main body becomes closed. Consequently, movements of the thread take-up lever will not hinder when the needle thread is drawn; hence, the needle thread can be smoothly drawn from the thread roll, so that the risk of occurrence of a thread break can be made small.

If a break has occurred in the needle thread, the turning arm will not be pulled, in a downward direction that is a direction opposite to the direction in which the rotating force of the needle thread motor is imparted when the thread take-up lever moves to its top dead center in the torque control zone. Hence, occurrence of a thread break can be detected by detecting that the turning arm does not turn downwardly. Further, when there are not any thread breaks, the turning arm turns downwardly in the torque control zone. Hence, occurrence of a thread break can be detected accurately.

In the position control zone, a current angle of the needle thread motor is detected, and angle correspondence data used for controlling the position of the needle thread motor to its initial angle position are generated. There is performed control operation for returning the needle thread motor to its initial angle position by means of position control in accordance with the angle correspondence data. In the torque control zone, the needle thread can therefore be drawn by only the amount corresponding to a quantity of thread consumed as a result of pulling of the turning arm, so that an excess or deficiency of the quantity of accumulated thread, which would otherwise be caused by drawing a needle thread, will not occur.

When the structure including the upstream grip section, the downstream grip section, and the turning section is applied to a multi-needle head, the sewing machine can be configured by providing only one each of the upstream magnet section of the upstream grip section, the downstream magnet section of the downstream grip section, and the turning section. Accordingly, the sewing machine can be provided with an efficient structure while its manufacturing cost is curtailed.

In the fourteenth configuration, the thread take-up lever can also be implemented as "a plurality of thread take-up levers (12*a*-1 to 12*a*-9) that are provided in the needle bar housing case in a swayable manner so as to be exposed to the front from positions below the downstream grip section and that permit insertion of needle threads to be inserted into respective sewing needles."

In the second, fourth, and fourteenth configurations, the upstream first plate-like section is preferably placed in such a way that spacing between the upstream first plate-like section and the upstream second plate-like section becomes variable, and the downstream first plate-like section is preferably placed in such a way that spacing between the downstream first plate-like section and the downstream second plate-like section becomes variable. In the second, fourth, and fourteenth configuration, the needle thread supporting member is provided in a one-to-one correspondence with the needle thread. Each of the needle thread supporting members includes a first circular-arc member formed approximately concentrically with the rotating center of the needle thread motor; a second circular-arc member formed, on the other side with respect to the axis line of the output shaft, approximately concentrically with the rotating center of the needle thread motor while spaced apart from the first circular-arc member; and a connecting member for connecting a lower end of the first circular-arc member to a lower end of the second circular-arc member. Specifically, the pair of needle thread supporting members is preferably placed while spaced apart from each other in the horizontal direction.

A configuration 14-1 based on the fourteenth configuration can also be characterized in that the needle thread is guided downward after passing through spacing between the upstream first plate-like section and the upstream second plate-like section of the upstream grip section main body, reaches the needle thread supporting member while a path of the needle thread is inverted by a first needle thread path inverting member (1290) provided on the plate section, is guided downwardly from the needle thread supporting member and subsequently passes through spacing between the downstream first plate-like section and the downstream second plate-like section in the downstream grip section main body, reaches the thread take-up lever while a path of the needle thread is inverted by a second needle thread path inverting member (1292) provided in the needle bar case, and reaches a sewing needle attached to the needle bar while being guided downward from the thread take-up lever.

A configuration 14-2 based on the configuration 14-1 can also be characterized in that the first needle thread path inverting member has a main body section (ga-1) having a cylindrical peripheral and a base end section (ga-2) which continually extends from a base end of the main body section and which is formed so as to have a diameter smaller than a diameter of the main body section and that an indentation section (1343*b*) used for inserting an end of the base-end section side of the main body section and a hole section (1343*a*) which continually extends from the indentation section and which is used for inserting the base end section are formed at positions on the plate section where the first needle thread path inverting member and the second needle thread path inverting member are to be attached; and that the base end section is inserted into the hole section; and that an end section on the base-end section side of the main body section is inserted into the indentation section.

A configuration 14-3 based on the configuration 14, 14-1, or 14-2 can also be characterized in that a mounting member is attached to a substantial center of the upper area of the upstream first plate-like section of the upstream grip section main body in its horizontal direction; that the first guide members (1252, 1254) set above and below the upstream first plate-like section on the plate section are placed at positions that differ from each other in the horizontal direction in the upstream grip section main body; that each of the needle thread paths existing between the upstream first plate-like section and the upstream second plate-like section is formed obliquely with respect to a vertical direction; that second guide members (1272, 1274) set above and below the downstream first plate-like section on the plate section are placed at positions that differ from each other in the horizontal direction in the downstream grip section main body; and that each of the needle thread paths existing between the downstream first plate-like section and the downstream second plate-like section is formed obliquely with respect to the vertical direction.

A configuration 14-4 based on the configuration 14-3 can also be characterized in that each of the first guide members and the second guide members has a main body section (ga-1) having a cylindrical peripheral and a base end section (ga-2) which continually extends from a base end of the main body section and which is formed so as to have a diameter smaller than a diameter of the main body section and that an indentation section (1343*b*) used for inserting an end section of the base-end section side of the main body section and a hole section (1343*a*) which continually extends from the indentation section and which is used for inserting the base end section are formed at positions on the needle bar case where the first guide members and the second guide members are to be attached; and that the base end section is inserted into the hole section; and that an end section on the base-end section side of the main body section is inserted into the indentation section.

A configuration 14-5 based on the fourteenth configuration, the configuration 14-1, the configuration 14-2, the configuration 14-3, or the configuration 14-4 can also be characterized in that a magnet section/motor supporting member (1360) that supports the upstream magnet section, the downstream magnet section, and the needle thread motor is secured to the arm.

A configuration 14-6 based on the fourteenth configuration, the configuration 14-1, the configuration 14-2, the configuration 14-3, or the configuration 14-4 can also be characterized by further comprising a magnet section/motor supporting member (1370) that supports the upstream magnet section, the downstream magnet section, and the needle thread motor and a sliding support member (1350, 1352) that is provided in the plate section and/or the needle bar housing case and that slidably supports the magnet section/motor supporting member so as to be slidable in a horizontal direction when viewed from the front, and a slide regulation member (1380) that is secured to the arm and that regulates horizontal sliding action of the magnet section/motor supporting member, to thus horizontally position the magnet section/motor supporting member, wherein the upstream magnet section, the downstream magnet section, and the needle thread motor are fixedly provided on an arm side as a result of horizontal sliding action of the magnet section/motor supporting member being regulated by the slide regulation member.

A configuration 14-7 based on the fourteenth configuration, the configuration 14-1, the configuration 14-2, the configuration 14-3, the configuration 14-4, the configuration 14-5, or the configuration 14-6 can also be characterized by further comprising an upstream first plate-like section supporting members (1401) that each is provided on a front side of the plate section and that has a first shaft section to be inserted into a hole section of the upstream first plate-like section and, an upstream coiled springs (1402) into each of which the first shaft section is to be inserted, and an upstream protective plate-like sections (1406) that each is secured to a leading end of the first shaft section and that is formed from a non-magnetic substance unattracted by the magnet, wherein the upstream first plate-like section is provided with the hole section used for inserting the first shaft section; the upstream second plate-like section remains in contact with a surface of the upstream protective plate-like section that is on the other side with respect to the upstream first plate-like section; the upstream first plate-like section is provided between the upstream coiled spring and the upstream protective plate-like section while the first shaft section remains inserted into the hole section; and the upstream first plate-like section is driven toward the upstream protective plate-like section by means of the upstream coiled spring; and further comprising a downstream first plate-like section supporting members (1411) that each has a second shaft section which is provided on a front side of the needle bar case and which is to be inserted into a hole section of a downstream first plate-like section, a downstream coiled springs (1412) into each of which the second shaft section is to be inserted, and a downstream protective plate-like sections (1416) that each is secured to a leading end of the second shaft section and that is formed from a non-magnetic substance unattracted by the magnet, wherein the downstream first plate-like section is provided with the hole section used for inserting the second shaft section; the downstream second plate-like section remains in contact with a surface of the downstream protective plate-like section that is on the other side with respect to the downstream first plate-like section; the downstream first plate-like section is provided between the downstream coiled spring and the downstream protective plate-like section while the second shaft section remains inserted into the hole section; and the downstream first plate-like section is driven toward the downstream protective plate-like section by means of the downstream coiled spring.

A configuration 14-8 based on the fourteenth configuration, the configuration 14-1, the configuration 14-2, the configuration 14-3, the configuration 14-4, the configuration 14-5, or the configuration 14-6 can also be characterized by further comprising an upstream sliding members (1421) that each is inserted into a position above the second opening section on the plate section and that each is provided so as to be slidable along a direction of an axis line of the upstream sliding member and an upstream driving members (1424) that each drives the upstream sliding member to a back side of the plate section, wherein the upstream first plate-like section is provided while hanging on the upstream sliding member, and an upstream press operation member (1362) for pressing the upstream sliding member corresponding to the upstream first plate-like section which is attracted by the upstream magnet section in a direction opposite to a driving direction of the upstream driving member is provided on the arm side; and further comprising a downstream sliding members (1431) that each is inserted into a position above the third opening section on the plate section and that each is provided for each of the upstream first plate-like sections so as to be slidable in an axial direction of the downstream sliding member and a downstream driving members (1434) that each drives the downstream sliding member to the back side of the plate section, wherein the downstream first plate-like section is provided while hanging on the downstream sliding member, and a downstream press operation member (1364) for pressing the downstream sliding member corresponding to the downstream first plate-like section which is attracted by the downstream magnet section in a direction opposite to a driving direction of the downstream driving member is provided on the arm side.

A fifteenth configuration based on the second configuration, the fourth configuration, the fifth configuration, the sixth configuration, the seventh configuration, the eighth configuration, the ninth configuration, the tenth configuration, the eleventh configuration, the twelfth configuration, the thirteenth configuration, or the fourteenth configuration can also be characterized in that the needle thread supporting member supports a needle thread on the front side of the first opening sections.

A sixteenth configuration based on the third configuration, the fourth configuration, or the fourteenth configuration can also be characterized in that during torque control performed in the torque control zone, a value of a torque deviation is calculated from a torque value in the torque data and a torque value based on a current value fed to the needle thread motor during torque control performed in the torque control zone, and an electric current is fed to the needle thread motor in accordance with the calculated torque deviation.

A seventeenth configuration based on the third configuration, the fourth configuration, the fourteenth configuration, or the sixteenth configuration can also be characterized by further comprising a motor angle detection section for detecting a rotational position of the needle thread motor, wherein position control is performed during position control performed in the position control zone along operation control steps including: a reading step of reading an angle of the needle thread motor from the angle correspondence data during position control performed in the position control zone, a speed data calculation step of calculating an amount of change per unit time in angle data read in the reading step, to thus calculate speed data, a torque data calculation step of detecting an amount of change per unit time in the speed data calculated in the speed data calculation step, to thus calculate torque data; a location deviation calculation step of calculating a value of a location deviation from the angle data read in the reading step and the motor angle data read by the motor angle detecting section, a speed deviation calculation step of calculating a value of a speed deviation from the calculated value of the location deviation, the calculated speed data, and the amount of change per unit time in motor angle detected by the angle detection section, a torque deviation calculation step of calculating a value of a torque deviation from the calculated value of the speed deviation, the calculated torque data, and a value of torque based on a current value fed to the motor, and a current feeding step of feeding an electric current to the motor in accordance with the calculated value of the toque deviation.

An eighteenth configuration based on any one of the first configuration to the seventeenth configuration is characterized in that the control section detects a main spindle angle in accordance with zone data in which a starting point and an end point of the torque control zone and a starting point and an end point of the position control zone are specified as information about a main spindle angle that is a rotational position of the main spindle motor, thereby determining the torque control zone and the position control zone.

A nineteenth configuration based on any one of the first configuration to the eighteenth configuration is characterized in that the starting point of the position control zone corresponds to any location in a zone from the other dead point to the one dead point of the thread take-up lever and is in front of a top dead point of a shuttle, and the end point of the position control zone corresponds to any location in a zone from the one dead point to the other dead point of the thread take-up lever.

A twentieth configuration based on any one of the first configuration to the nineteenth configuration is characterized in that a zone in which an electric current is not fed to the needle thread motor is set between the end point of the torque control zone and the starting point of the position control zone; a zone during which an electric current is not fed to the needle thread motor is set between the end point of the position control zone and the starting point of the torque control zone; the upstream grip section main body is switched to a closed state, and the downstream grip section main body is switched to an open state at the end point of the position control zone; and the upstream grip section main body is switched to the open state, and the downstream grip section main body is switched to a closed state at the end point of the torque control zone. Specifically, a current supply halt time is set in order to perform switching between torque control and position control after switching between opening and closing of the upstream grip section main body and switching between opening and closing of the downstream grip section main body have been performed without fail. In each of the configurations, the magnet section is specifically an electromagnet.

Advantages of the Invention

In the sewing machine of the present invention, a needle thread is subjected to torque control in the torque control zone. Therefore, the magnitude of tension on the needle thread can be controlled. Since torque values are specified for each stitch, torque can be controlled for each stitch. Consequently, tension on the needle thread can be controlled for each stitch, so that seam hardness can be controlled for each stitch.

Even in the case of a multi-needle head or when a stitch is formed from different needle threads, tension on the needle thread can be equally controlled by means of making torque values equal to each other. Further, even in the case of a multi-head embroidery sewing machine, torque values employed in the torque control zone are made common to the heads, whereby tension on the needle threads exerted by the respective heads can be made equal.

Further, the needle thread control section is provided in place of the tension disc and the rotary tension component in the related-art sewing machine. As a result, in the position control zone where the needle thread is drawn, the upstream grip section main body becomes open. Frictional resistance attributable to the tension disc and the rotary tension component does not exist in an upstream position with respect to the turning arm of the turning section. Further, since the downstream grip section main body becomes closed, movements of the thread take-up lever will not pose any problem when the needle thread is drawn. Consequently, the needle thread can be smoothly drawn from the thread roll, so that the risk of occurrence of a thread break can be made small.

If a break has occurred in the needle thread, the turning arm will not be pulled, in the torque control zone, in a direction that is a direction opposite to the direction in which the rotating force of the needle thread motor is imparted when the thread take-up lever moves to its top dead center. Hence, occurrence of a thread break can be detected by detecting that the turning arm does not turn in the direction opposite to the direction in which the rotating force of the needle thread motor is imparted. Further, when there are not any thread breaks, the turning arm turns, in the torque control zone, in the direction opposite to the direction in which the needle thread motor imparts rotating force. Hence, occurrence of a thread break can be detected accurately.

In the position control zone, rotating force is imparted to the turning arm in accordance with angle position data pertaining to the needle thread motor such that the angle of the needle thread motor returns to its initial angle position which is a rotational position of the needle thread motor. Hence, the needle thread can be drawn by only the amount corresponding to a quantity of thread consumed as a result of the turning arm having been pulled in the direction opposite to the direction in which the rotating force of the needle thread motor is imparted. Therefore, an excess or deficiency of the quantity of accumulated thread, which would otherwise be caused by drawing a needle thread, will not occur.

BRIEF DESCRIPTION OF THE DRAWINGS

FIG. 6 It is an explanatory view showing a configuration of zone position data.

FIG. 7 It is an explanatory view showing main spindle data.

FIG. 9 It is an explanatory view showing needle thread control torque data.

FIG. 15 It is an explanatory view showing angle correspondence data.

EMBODIMENTS FOR IMPLEMENTING THE INVENTION

In the present invention, a magnitude of tension on a needle thread can be controlled. In particular, the magnitude of tension imparted to the needle threads when thread take-up levers are upwardly actuated can be controlled. Further, solution of drawbacks; namely, providing a needle thread tension controller that does not cause an excess or deficiency of the quantity of accumulated thread, which would otherwise be caused by drawing a needle thread, is realized as follows.

First Embodiment

Figure 1:
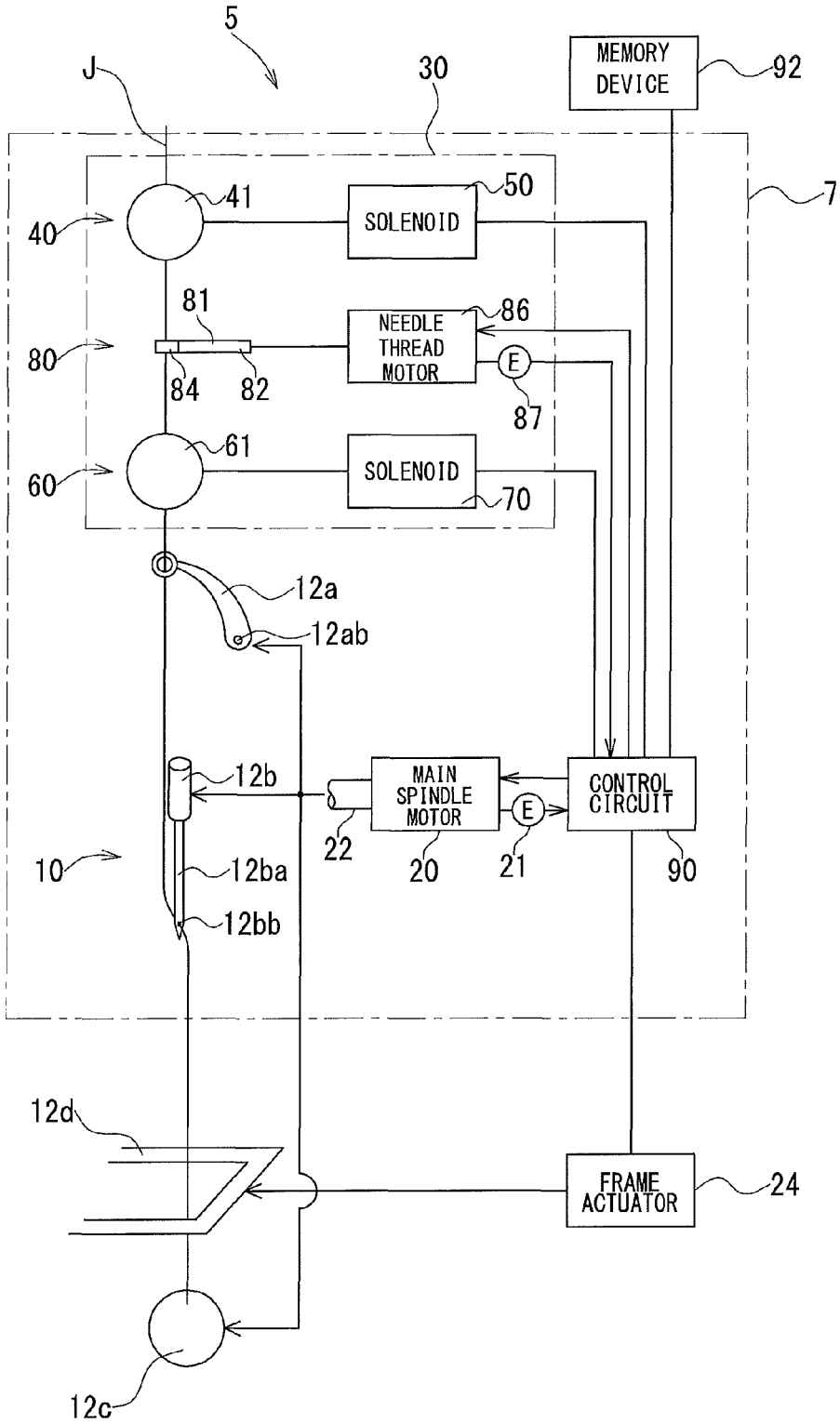
FIG. 1 It is an explanatory view showing a configuration of a sewing machine of a first embodiment.
Figure 2:
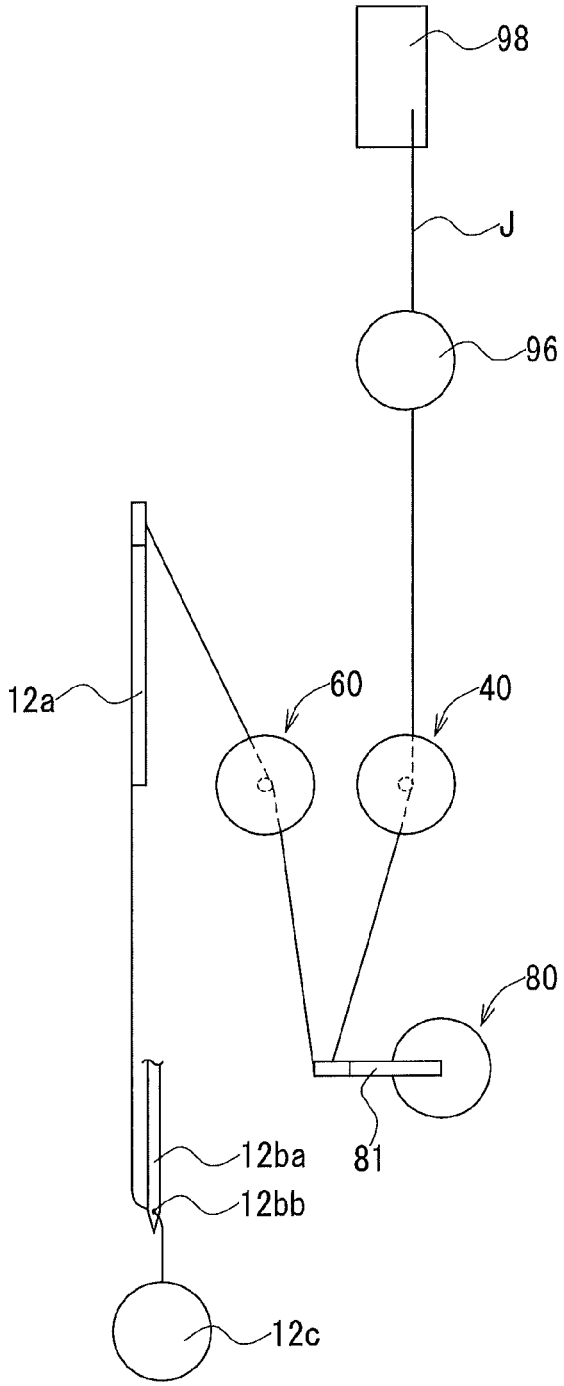
FIG. 2 It is an explanatory view of a principal part of the sewing machine of the first embodiment.
Figure 3:
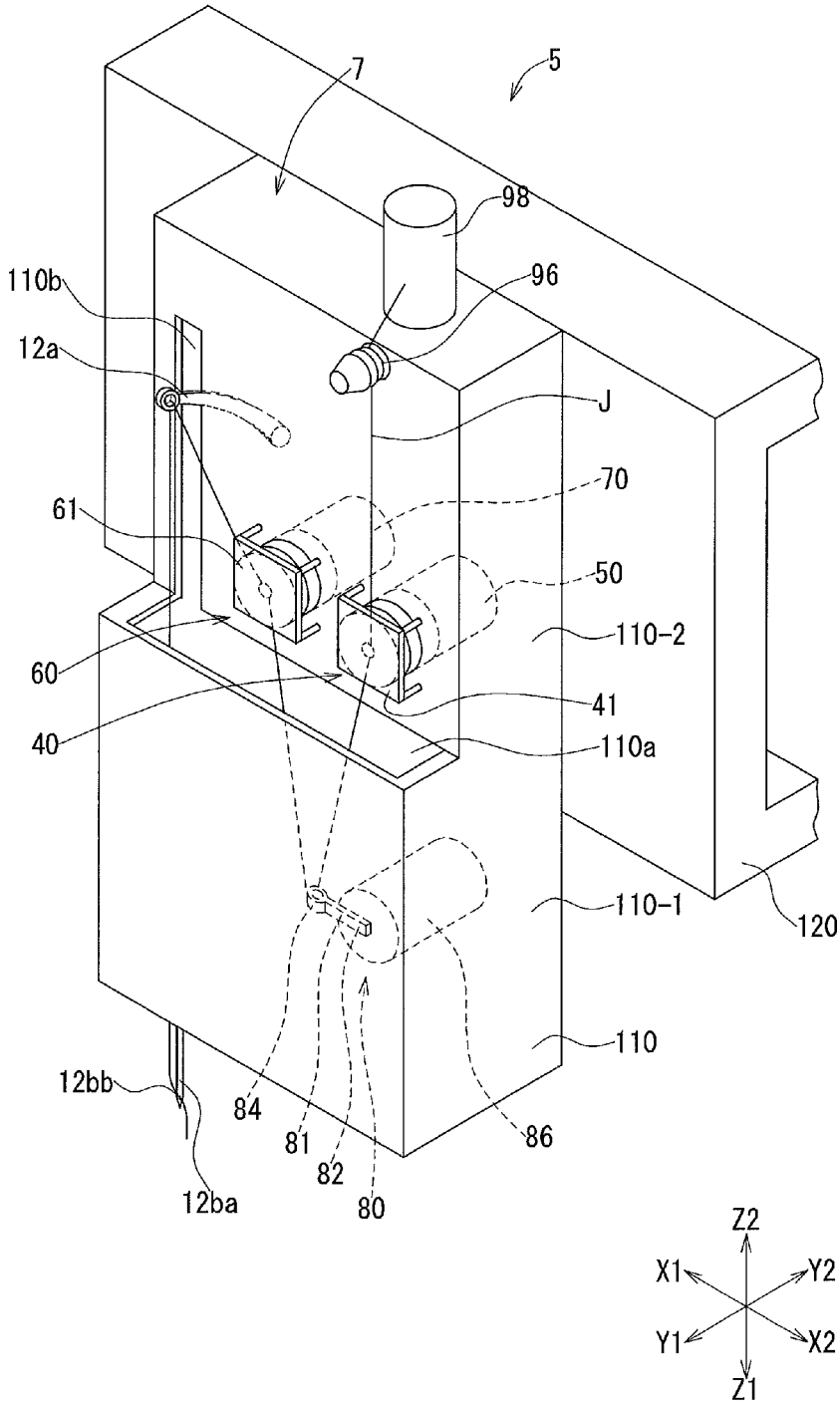
FIG. 3 It is a perspective view of the sewing machine of the first embodiment.

A sewing machine 5 described in connection with a first embodiment of the present invention is constituted as shown in FIGS. 1 through 5. The sewing machine 5 has a head 7, a shuttle 12*c*, a sewing frame (also called a "holding frame" or "embroidery frame") 12*d*, a frame actuator 24, and a memory device 92. FIG. 2 is a drawing conceptually showing a principal part of the sewing machine 5. FIG. 3 specifically shows details of FIG. 2.

The head 7 is positioned above an approximately tabular sewing machine table (not shown). A frame 120 (see FIGS. 3 and 4) stands upright on an upper surface of the sewing machine table, and the head 7 is put on a front side (a Y1 side) of the frame 120.

Figure 4:
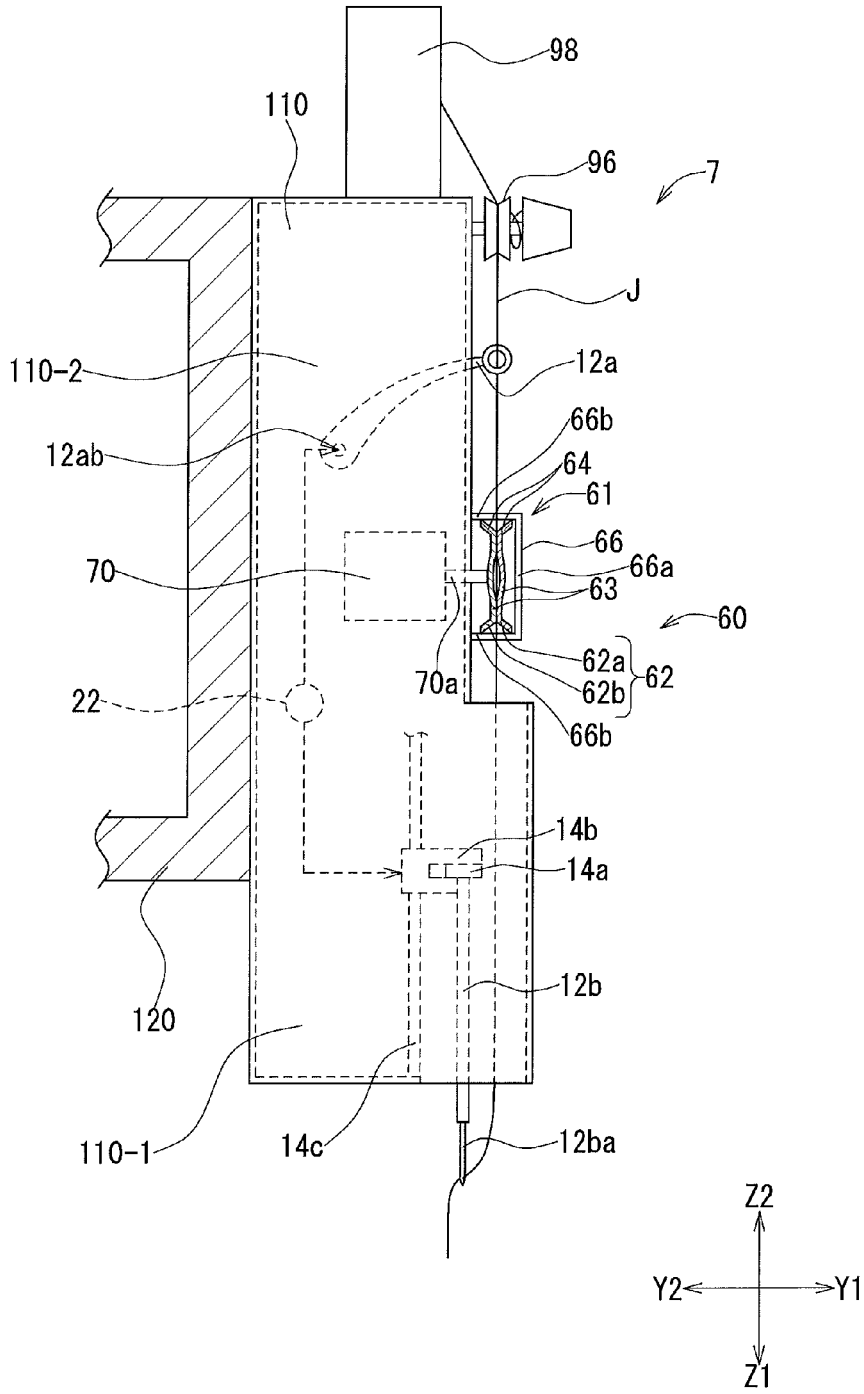
FIG. 4 It is a left side elevation view of the sewing machine of the first embodiment.

The head 7 is constituted as shown in FIG. 1, FIG. 3, and FIG. 4 and includes a machine element group 10, a main spindle motor 20, a main spindle 22, a needle thread control section 30, a control circuit 90, a pretension component 96, and a thread roll 98 wound around a needle thread bobbin, and a case 110.

Figure 18:
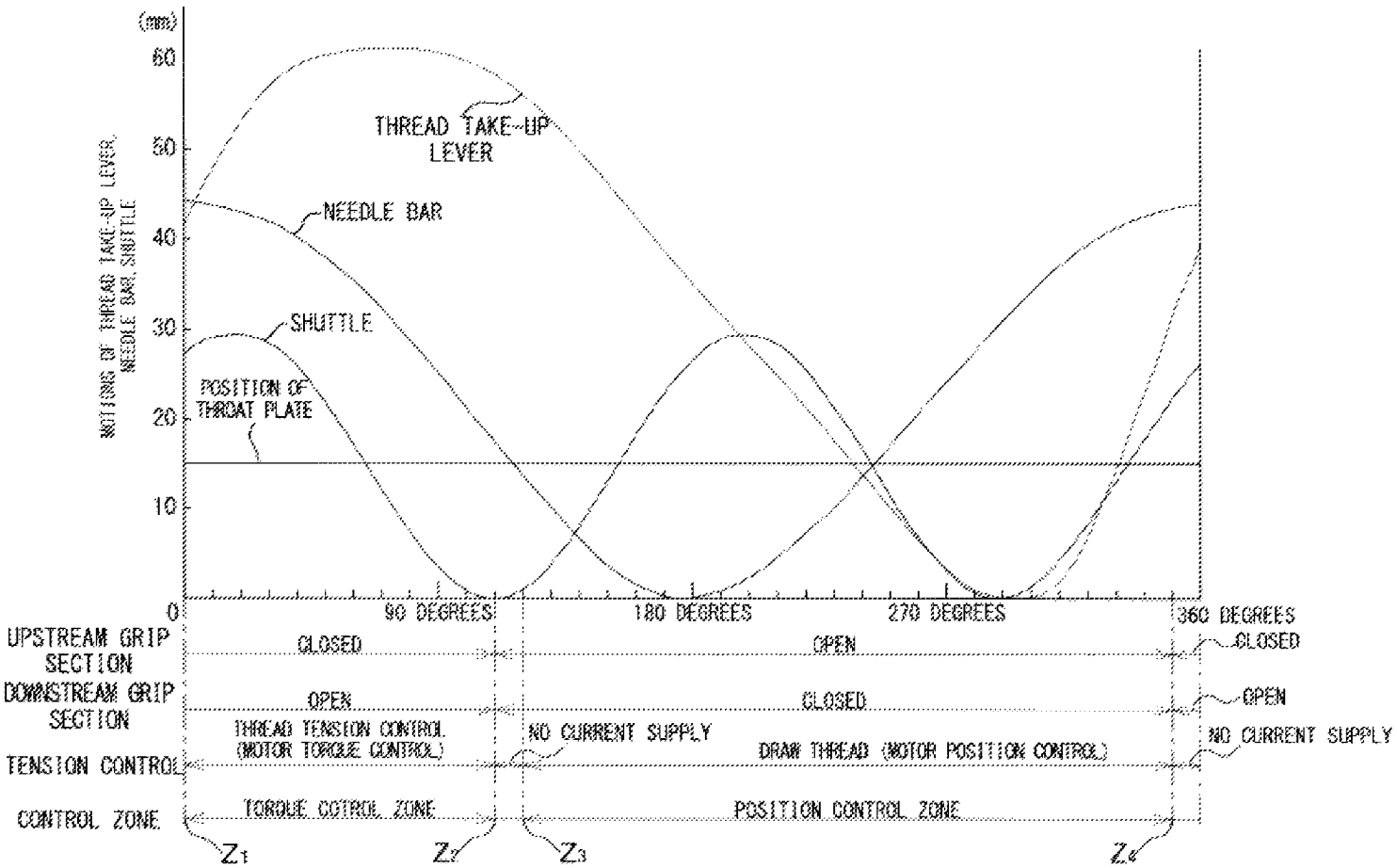
FIG. 18 It is an explanatory view showing operation of the sewing machine of the first embodiment and operation of a sewing machine of a second embodiment.

The machine element group 10 is comprised of machine elements actuated in the head 7. A thread take-up lever 12*a*, a needle bar 12*b*, and a presser foot (not shown) are provided as the machine elements. The respective machine elements, such as the thread take-up lever 12*a*, the needle bar 12*b*, and the presser foot, and the shuttle 12*c* are actuated by transmitting rotating force of the main spindle 22 byway of power transmission means, like a cam mechanism or a belt mechanism, as in the case of the related-art sewing machine. Specifically, as shown in FIG. 18, the position of the thread take-up lever 12*a*, the position of the needle bar 12*b*, and the position of the shuttle 12*c* (a position between a top dead center and a bottom dead center) are specified according to a spindle angle (i.e., a rotational position of the main spindle 22); to be exact, an angle of the main spindle motor 20 (specifically, a rotational position of the main spindle motor 20).

The thread take-up lever 12*a* is formed so as to be able to sway around an axis line in a horizontal direction (a direction X1-X2) with respect to the case 110. The thread take-up lever 12*a* turns between a bottom dead center (one dead center) and a top dead center (the other dead center). Specifically, the thread take-up lever 12*a* is axially supported by the case 110 so as to sway around a rotating center (that can also be referred to as a swaying center) 12*ab*. A needle thread to be inserted into a sewing needle 12*ba* is inserted into the thread take-up lever 12*a*.

The needle bar 12*b* is also provided so as to be movable in the vertical direction. The sewing needle 12*ba* (a needle thread is inserted into a pin hole 12*bb* of the sewing needle 12*ba*) is fixedly provided at a lower end of the needle bar 12*b*. A needle bar connecting stud 14*a* is fixedly provided at an upper end of the needle bar 12*b*. Further, a needle bar actuation member 14*b* is engaged with the needle bar connecting stud 14*a*. A base needle bar 14*c* positioned in the vertical direction is inserted into the needle bar actuation member 14*b*. The needle bar actuation member 14*b* is formed so as to be movable in the vertical direction along the base needle bar 14*c*. Rotating force of the main spindle 22 is transmitted by the power transmission means, whereby the needle bar actuation member 14*b* is vertically actuated. The needle bar 12*b* is thereby moved in the vertical direction.

The presser foot is linked to the needle bar 12*b* and moves up and down in synchronism with vertical actuation of the needle bar 12*b*.

The main spindle motor 20 rotates the main spindle 22, and rotating force of the main spindle 22 is transmitted by means of a predetermined power transmission mechanism, thereby actuating the respective machine elements, such as the thread take-up lever 12*a*, the needle bar 12*b*, and the presser foot, and the shuttle 12*c*. The main spindle motor 20 is constituted so as to rotate in one direction, whereby the main spindle 22 also rotates in one direction. The spindle angle represents the rotational position of the main spindle 22 and is synonymous with the rotational position of the main spindle motor 20 (i.e., the rotational position of an output shaft of the main spindle motor 20).

The needle thread control section 30 is for drawing a needle thread from the thread roil 98 and controlling tension exerted on the needle thread. The needle thread control section 30 has an upstream grip section 40, a downstream grip section 60, and a turning section 80.

Incidentally, the upstream grip section 40 has a grip section main body (an upstream grip section main body) 41 and a solenoid (an upstream actuation section) 50. As a result of actuation of the solenoid 50, the grip section main body 41 grips and fixes a needle thread. The grip section main body 41 is placed at a position on the front side of the case 110 that is beneath the pretension component 96 and above an opening section 110*a*. The solenoid 50 is put on a back side of the grip section main body 41 and in the case 110.

The downstream grip section 60 has a grip section main body (a downstream grip section main body) 61 and a solenoid (a downstream actuation section) 70. As a result of actuation of the solenoid 70, the grip section main body 61 grips and fixes the needle thread. The grip section main body 61 is placed adjacently to the upstream grip section 40 along the horizontal direction; namely, on a part of the upstream grip section 40 closer to the thread take-up lever 12*a*. The solenoid 70 is placed on a back side of the grip section main body 61 and in the case 110.

Since each of the upstream grip section 40 and the downstream grip section 60 has an analogous structure, an explanation is now given by means of taking the downstream grip section 60 as an example. The grip section main body 61 of the downstream grip section 60 has a tension disc group 62 and a supporting section 66.

In the tension disc group 62, a tension disc 62*a* and a tension disc 62*b* are placed opposite each other, so that the needle thread can be pinched between the pair of tension discs 62*a* and 62*b*. The pair of tension discs 62*a* and 62*b* has an approximately-circular-tabular (specifically a shape of a disc-shaped plate whose center protrudes outside) main body 63 and a tension disc frame 64 that upwardly extends at a slant from a circumferential edge of the main body 63. The tension disc 62*a* and the tension disc 62*b* face each other in such a way that the tension disc frame 64 faces the outside.

Each of the supporting sections 66 supports the corresponding tension disc group 62 and has a plate-like section 66*a* and rods 66*b*. The plate-like section 66*a* assumes the shape of a square plate (a square shape each side of which is greater than a diameter of the tension discs 62*a* and 62*b*). The tension disc 62*a* is fixedly placed on a back side of the plate-like section 66*a*. Specifically, in the present embodiment, the tension disc 62*a* is attached so as to be nonrotatable. The rods 66*b* are fixedly provided at respective four corners of the plate-like section 66*a*. Ends of the respective rods 66*b* distant from the plate-like section 66*a* are secured to the front side of the case 110.

The solenoid 70 is supported in the case 110. The tension disc 62*b* is fixed to a leading end of a shaft portion 70*a* of the solenoid 70. The shaft portion 70*a* of the solenoid 70 is moved to the front side by activation of the solenoid 70, whereby the tension disc 62*b* is pushed toward the tension disc 62*a*. The needle thread J is gripped by means of the pair of tension discs 62*a* and 62*b*, whereupon the needle thread J is fixed. A state in which the solenoid 70 is activated is taken as a closed state of the grip section main body 61. In the meantime, the needle thread J gripped between the pair of tension discs 62*a* and 62*b* is released by deactivating the solenoid 70. As mentioned above, a state in which the solenoid 70 remains deactivated is taken as an open state of the grip section main body 61.

In the downstream grip section 60, the needle thread J drawn from the thread roll 98 remains pinched between the pair of tension discs 62*a* and 62*b*. In a state in which the solenoid 70 remains inactive, tension is not exerted on the needle thread pinched between the pair of tension discs 62*a* and 62*b*. Meanwhile, when the solenoid 70 is activated, the needle thread J becomes fixedly pinched between the tension disc 62*a* and the tension disc 62*b*. As above, the solenoid 70 working as a downstream actuation section is switched between a closed state in which the needle thread is gripped against the grip section main body 61 and an open state in which the needle thread is released. When the grip section main body 41 becomes closed, the gripped needle thread J is fixed. On the other hand, when the grip section main body 41 is opened, the needle thread J is released from the fixed state.

Since the upstream grip section 40 has a same structure as that of the downstream grip section 60, its detailed explanation is omitted. The grip section main body 41 is structurally same to the grip main body 61, and the solenoid 50 also has a structure same to that of the solenoid 70. Specifically, when the solenoid 50 is activated, the needle thread J is gripped by means of the pair of tension discs, whereupon the grip section main body 41 is closed. On the contrary, when the solenoid 50 is released from the activated state, a grip effected by the pair of tension disc is canceled, whereupon the grip section main body 41 is opened. As above, the solenoid 50 acting as an upstream actuation section is switched between a closed state in which the needle thread is gripped against the grip section main body 41 and an open state in which the needle thread is released from the gripped state. When the grip section main body 61 is closed, the gripped needle thread J is fixed. By contrast, when the grip section main body 61 is opened, the needle thread J is released from the fixed state.

The solenoid is taken as an example device for switching each of the grip section main bodies 41 and 61 between the open state and the closed state. Another device (an actuator) that performs reciprocal movements can also be used.

The turning section 80 is placed at a downstream position with respect to the upstream grip section 40 in a direction of feed of a needle thread and an upstream position with respect to the downstream grip section 60 in the direction of feed of a needle thread. Specifically, the turning section 80 is placed below the upstream grip section 40 and the downstream grip section 60 and within the case 110.

The turning section 80 has a turning arm 81 and a needle thread motor 86 that turns the turning arm 81. The turning arm 81 has a rod-shaped main body section 82 and a tubular portion 84 provided at one leading end of the main body section 82. An output shaft of the needle thread motor 86 is secured to the other end of the main body section 82. The tubular portion 84 assumes a cylindrical shape (can also assume an approximately cylindrical shape) and is built in such a way that an axis line of the tubular portion 84 is parallel to a plane formed from a circle concentric to the output shaft of the motor and contacts the concentric circle. The turning section 80 is placed at such a position that the tubular portion 84 of the turning arm 81 is situated beneath the position between the grip section main body 41 and the grip section main body 61. A position of the tubular portion 84 of the turning arm 81 (or approximately) coincides with an intermediate position between the pair of tension discs of the grip section main body 41 and the pair of tension discs of the grip section main body 61 with respect to a front-back direction of the tubular portion 84. As mentioned above, the turning section 80 turns the needle thread situated between the grip section main body 41 and the grip section main body 61 [or may turn a part (or position) of a needle thread situated between the grip section main body 41 and the grip section main body 61].

The control circuit 90 is a circuit for controlling operation of the main spindle motor 20, the needle thread motor 86, the solenoid 50, and the solenoid 70 and controls operation of respective sections in accordance with the data stored in the memory device 92. Specifically, the control circuit 90 generates main spindle data (see FIG. 7) in accordance with the embroidery data read from the memory device 92, controlling the main spindle motor 20 in accordance with the thus-generated main spindle data.

In accordance with the embroidery data read from the memory device 92, the control circuit 90 generates needle thread control torque data (see FIG. 9). In a torque control zone, the needle thread motor 86 is subjected to torque control in accordance with the needle thread control torque data. In a position control zone, the control circuit 90 generates angle correspondence data, such as that shown in FIG. 15, and performs position control in accordance with the angle correspondence data.

In a zone ranging from an end point of the position control zone to an end point of the torque control zone, the control circuit 90 controls the solenoid 50 so as to close the upstream grip section 40, controlling the solenoid 70 so as to open the downstream grip section 60. In the meantime, in a zone ranging from the end point of the torque control zone to the endpoint of the position control zone, the control circuit 90 controls the solenoid 50 so as to open the upstream grip section 40, controlling the solenoid 70 so as to close the downstream grip section 60.

Figure 5:
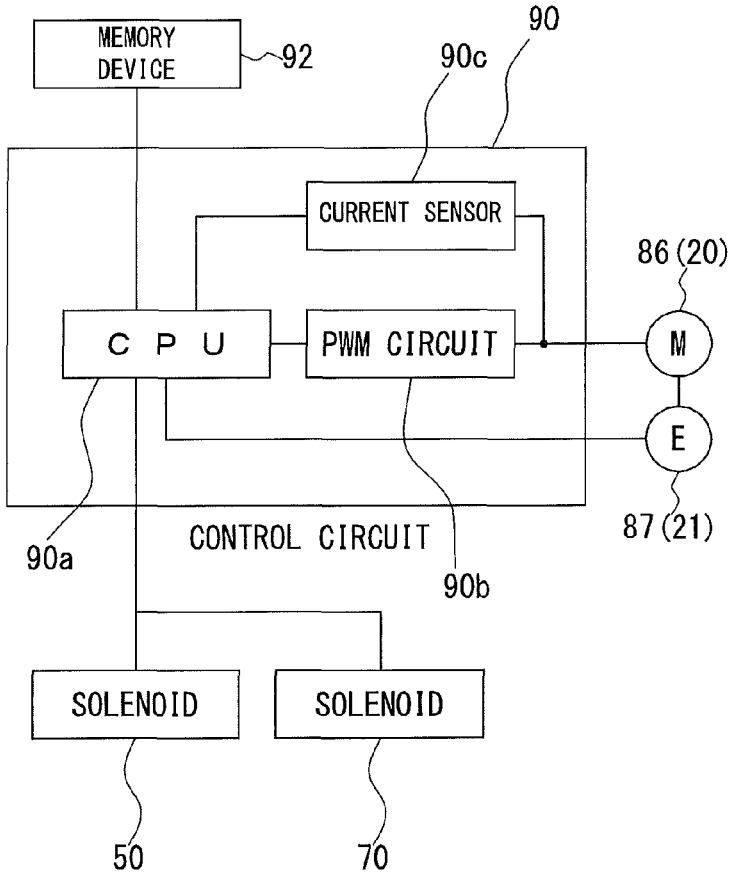
FIG. 5 It is an explanatory view of a principal part of the sewing machine of the first embodiment.

Specifically, as shown in FIG. 5, the control circuit 90 has a CPU 90*a*, a PWM (Pulse Width Modulation) circuit 90*b*, and a current sensor 90*c*. In accordance with data from the memory device 92, the CPU 90*a* outputs to the PWM circuit 90*b* data pertaining to a current value to be fed to the motor. The PWM circuit 90*b* converts an amplitude of the current value output from the CPU 90*a* into a pulse signal having a constant amplitude and feeds the pulse signal to the main spindle motor 20 and the needle thread motor 86. The current sensor 90*c* converts a pulse signal output from the PWM circuit 90*b* into a current value, multiplies the current value by a constant to calculate a torque value, and outputs the torque value to the CPU 90*a*.

Figure 16:
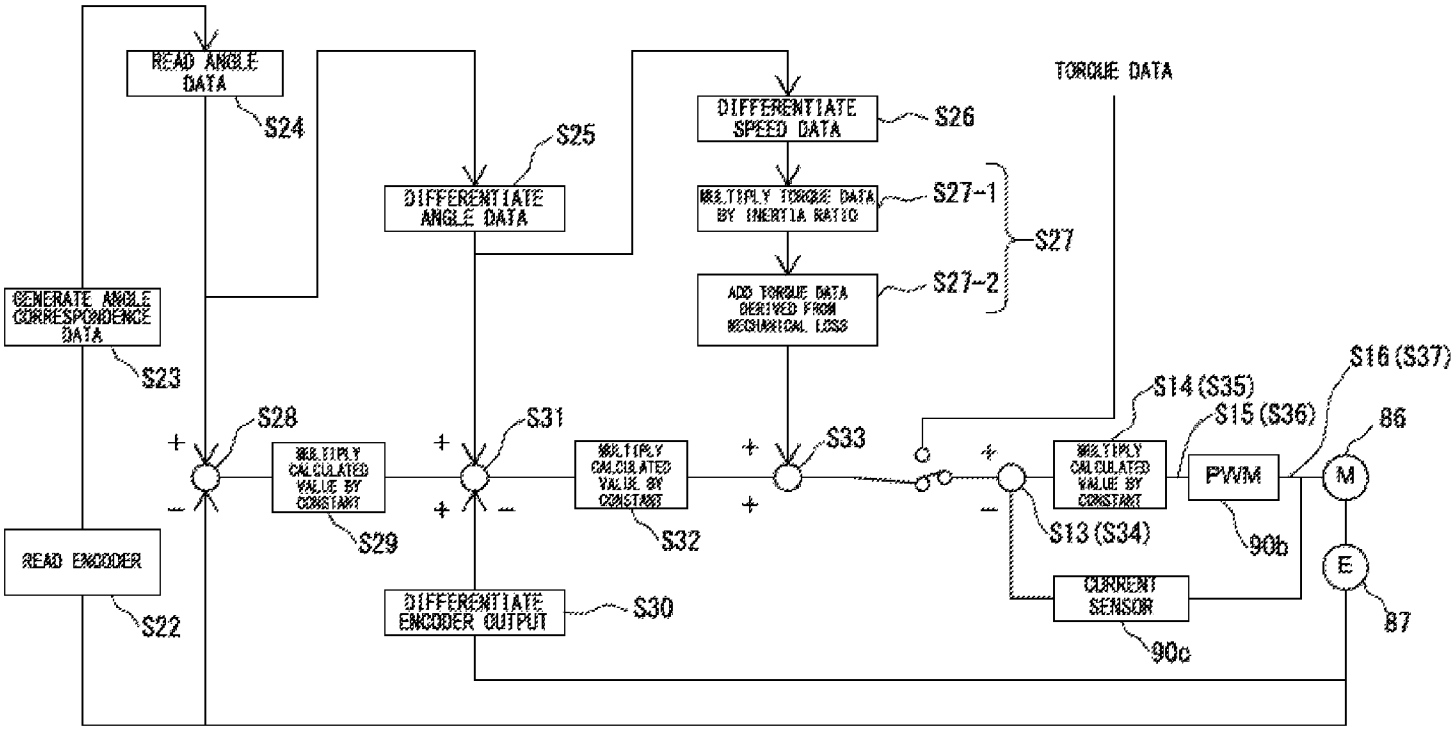
FIG. 16 It is a functional section diagram showing a method for controlling the needle thread motor.
Figure 21:
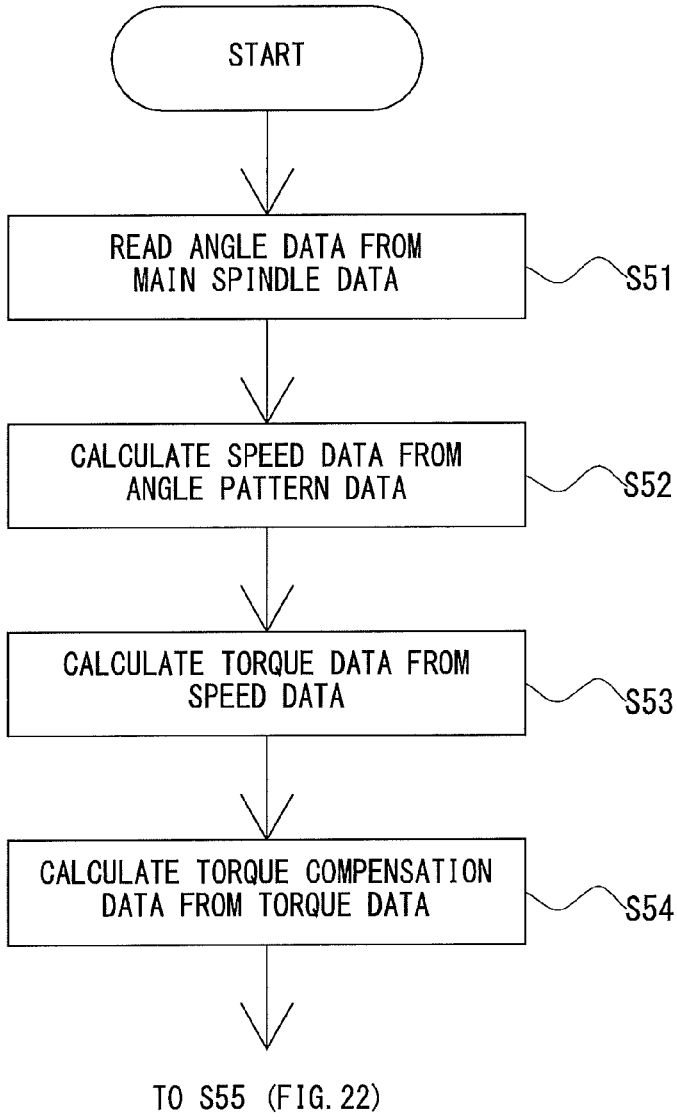
FIG. 21 It is a flowchart showing a method for controlling a main spindle motor.
Figure 22:
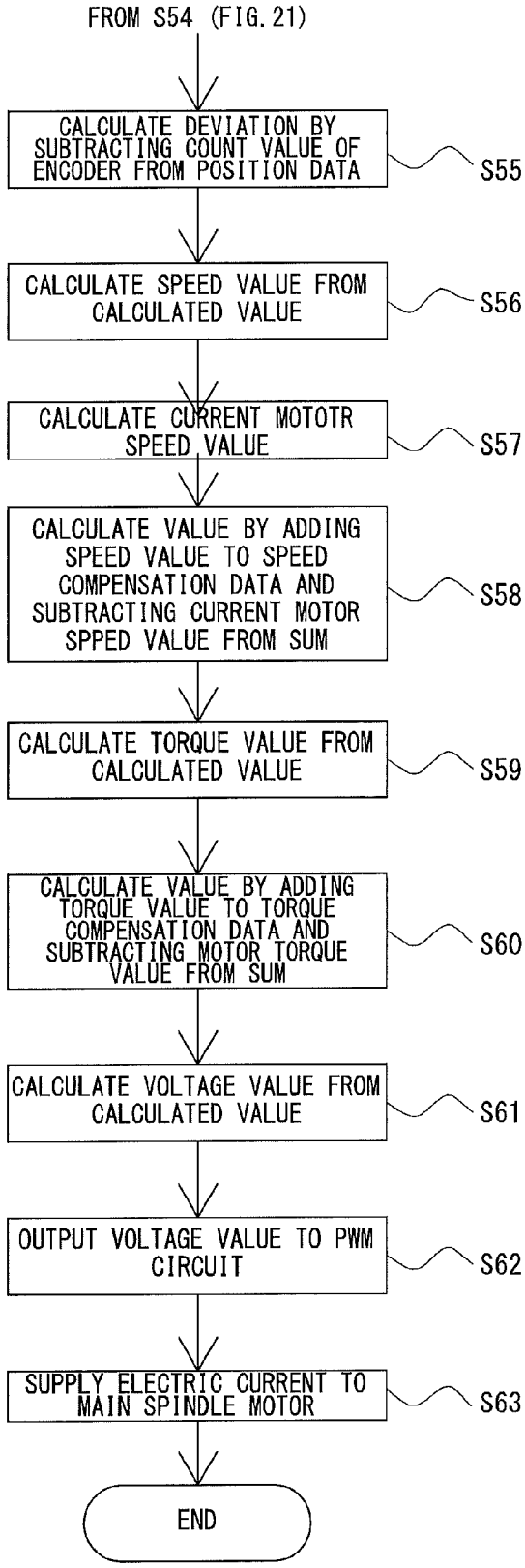
FIG. 22 It is a subsequent flowchart showing the method for controlling the main spindle motor.
Figure 23:
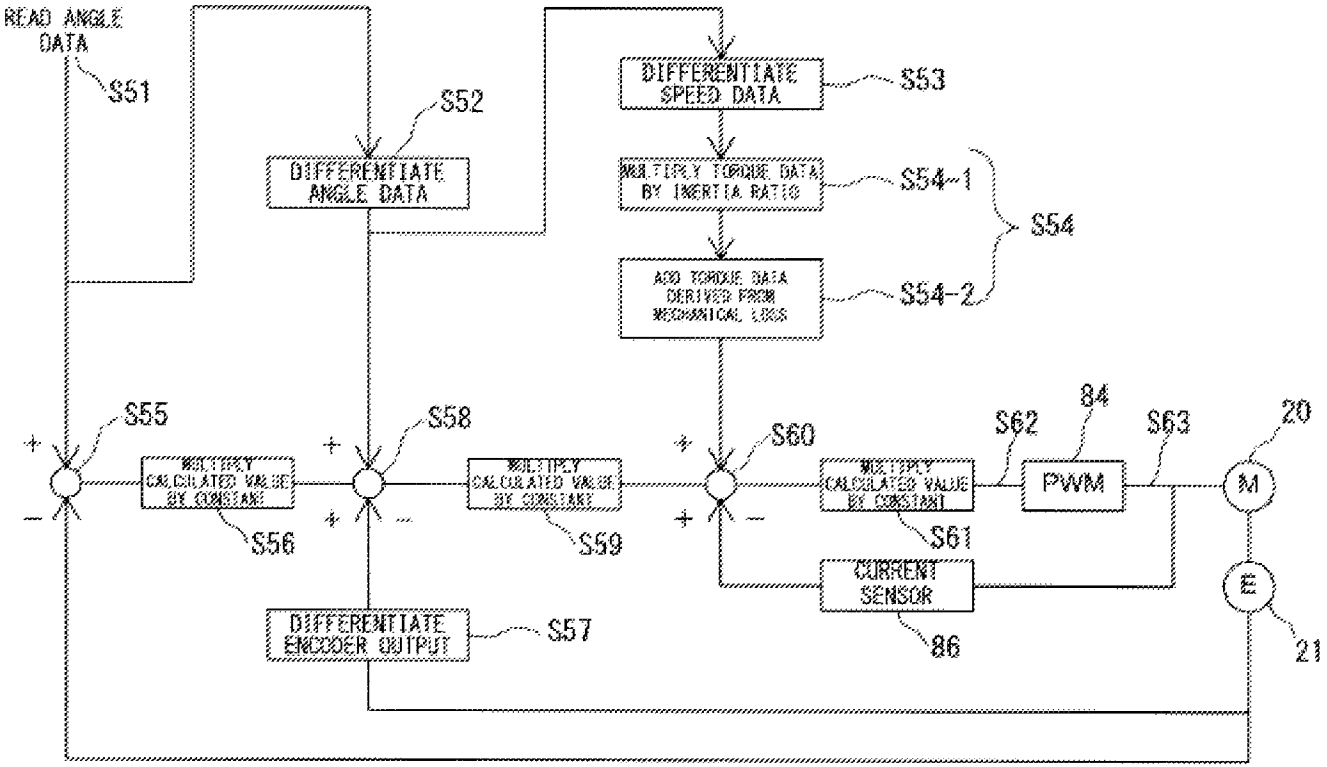
FIG. 23 It is a functional section diagram showing the method for controlling the main spindle motor.

More specifically, in addition to generating needle thread control torque data in accordance with the embroidery data read from the memory device 92, the control circuit 90 performs control as represented by flowcharts shown in FIG. 10 to FIG. 13, FIG. 17, FIG. 21, and FIG. 22, functional block, diagrams shown in FIG. 16 and FIG. 23, and a timing chart shown in FIG. 18. Detailed operations will be provided later. FIG. 18 shows example operation for one stitch performed in a control zone. A control zone for one stitch is one corresponding to one turn of the main spindle 22.

An encoder 21 for detecting an angle of the main spindle motor 20 (the rotational position of the main spindle motor 20) is interposed between the main spindle motor 20 and the control circuit 90. An encoder 87 for detecting an angle of the needle thread motor 86 (a rotational position of the needle thread motor 86) is interposed between the needle thread motor 86 and the control circuit 90. The control circuit 90 detects angles of the respective motors (the rotational positions of the respective motors) from information output from the respective encoders.

The case 110 makes up an enclosure of the head 7 and is fastened to the frame 120. The case 110 assumes an approximately square shape when viewed from the front and the back and an approximately-L-shaped geometry when viewed from the left. The case 110 assumes a shape such that a lower-side portion 110-1 protrudes to the front with respect to an upper-side portion 110-2. The opening section 110*a* is formed in an upper end of an area of the lower-side portion 110-1 protruding from the upper-side portion 110-2, and the needle thread J is inserted into the opening section 110*a*. A vertical slot 110*b* is formed on a left-side area on a front side of the upper-side portion 110-2 when viewed in plane. The thread take-up lever 12*a* is formed so as to protrude from the slot 110*b* to the front side (in direction Y1).

The main spindle motor 20, the encoder 21, and the main spindle 22 can also be disposed outside the case 110 that makes up the head 7.

The shuttle 12*c* is placed at a position that is beneath the head 7 and lower than an upper surface of the sewing machine table. Specifically, the shuttle 12*c* is supported by a shuttle base (not shown) disposed below the sewing machine table.

The sewing frame 12*d* is a member for holding a processed fabric in a stretched manner and placed above (or on an upper surface of) the sewing machine table.

The frame actuator 24 is for actuating the sewing frame 12*d* in both an X-axis direction (direction X1-X2) and a Y-axis direction (direction Y1-Y2) in accordance with a command from the control circuit, and actuates the sewing frame 12*d* in synchronism with vertical movements of the needle bar 12*b*. Specifically, the frame actuator 24 is made up of a servomotor for actuating the sewing frame 12*d* in the X-axis direction, a servomotor for actuating the sewing frame 12*d* in the Y-axis direction, and others.

The memory device 92 stores embroidery data used for performing embroidery. The embroidery data here mean; for instance, data that pertain to a stitch width, a stitching direction, and thread attributes (a thread material and a thread thickness) and that are provided for each stitch.

As shown in FIG. 6, the memory device 92 stores zone position data (zone data). In relation to the zone position data, data pertaining to the starting point and the end point of the torque control zone are stored as information about an angle of the main spindle (i.e., information about the rotational position of the main spindle motor 20) (a starting point is denoted by reference symbol $Z_1$, and an end point is denoted by reference symbol $Z_2$). Moreover, data pertaining to the starting point and the endpoint of the position control zone are stored as information about an angle of the main spindle (i.e., information about the rotational position of the main spindle motor 20) (a starting point is denoted by reference numeral $Z_3$, and an end point is denoted by reference symbol $Z_4$).

As shown in FIG. 18, the starting point of the torque control zone is situated behind an end point of an immediately preceded position control zone in terms of time. Further, a starting point of a position control zone is situated behind an end point of an immediately preceding torque control zone in terms of time. Torque control and position control are switched after the opening and closing of the grip section main bodies 41 and 61 have been reliably switched. For this reason, a predetermined period of time exists between the end point of the torque control zone and the starting point of the position control zone. Further, a predetermined period of time exists between the end point of the position control zone and the starting point of the torque control zone. These predetermined periods of time are for switching the opening and closing of the grip section main bodies 41 and 61.

The starting point of the torque control zone is at any arbitrary position in an area from the bottom dead center (one dead center) to the top dead center (the other dead center) within a turning range of the thread take-up lever (an area in which the thread take-up lever shifts from its bottom dead center to its top dead center) in association with rotation of the main spindle 22. The top dead center of the thread take-up lever (the other dead center) can be said to be an end of the turning range of the thread take-up lever in the direction where the needle thread is pulled from the processed fabric.

The end point in the torque control zone is any arbitrary position in an area from the top dead center to any position on the way from the top dead center to the bottom dead center of the thread take-up lever and also a position achieved before the sewing needle 12*ba* is inserted into the processed fabric (e.g., a position where a leading end of the sewing needle 12*ba* comes to an elevated position above a steel plate 13). In other words, in order to avoid as much as possible exertion of tension on the needle thread in the middle of sewing the processed fabric, a period during which the needle is being inserted into the processed fabric should not be taken as the torque control zone. Therefore, the end point of the torque control zone can also be the position of the top dead center of the thread take-up lever. Further, the top dead center of the shuttle is not taken as the torque control zone so that the shuttle can be smoothly inserted into the needle thread. Therefore, the end point of the torque control zone comes ahead of the top dead center of the shuttle.

In the torque control zone, tension is imparted to the needle thread J by means of pulling the needle thread J in a direction opposite to a direction of pull-up of the thread take-up lever 12*a* while the thread take-up lever 12*a* is pulling up the needle thread J. For these reasons, at least a portion of the torque control zone is set in a period during which the thread take-up lever is in the middle of ascending action (a period during which the needle thread is pulled with respect to the processed fabric). Specifically, the torque control zone can be said to be a zone including at least a portion of the area from the bottom dead center to the top dead center of the thread take-up lever. If torque control is performed even after the sewing needle 12*ba* has been inserted, tension will be exerted on the needle thread that is in the middle of sewing operation. For these reasons, the end point of the torque control zone is set to a position achieved before the sewing needle 12*ba* is inserted into the processed fabric.

The starting point of the position control zone is any arbitrary position in an area from the top dead center to the bottom dead center of the thread take-up lever (i.e., an area where a transition from the top dead center to the bottom dead center of the thread take-up lever takes place). It does not matter whether the starting point is a position achieved before the sewing needle 12*ba* is inserted into the processed fabric (i.e., a point at which the leading end of the sewing needle 12*ba* comes to an elevated position above the steel plate 13) or a position achieved after the sewing needle 12*ba* is inserted into the processed fabric (e.g., a point at which the leading end of the sewing needle 12*ba* becomes lower than the steel plate 13). In order to cause the shuttle to be inserted into the needle thread smoothly, the starting point of the position control zone is set ahead of the top dead center of the shuttle, and the top dead center of the shuttle is placed at any point in the position control zone.

The end point of the position control zone is at any position in the area from the bottom dead center to the top dead center of the thread take-up lever (i.e., the area where a transition from the bottom dead center to the top dead center of the thread take-up lever takes place). Since the endpoint is immediately followed by the torque control zone, the end point of the position control zone should preferably be at a position where the sewing needle 12*ba* has already gone out of the processed fabric (e.g., a position where the leading end of the sewing needle 12*ba* comes to an elevated position above the steel plate 13).

The needle thread J is drawn from the thread roll 98 in the position control zone. However, in order to minimize the possibility of occurrence of a break in the needle thread by slowly drawing the needle thread while taking as long a time as possible, it is preferable to assure the longest possible position control zone. For instance, a long position control zone can be assured by means of setting the starting point of the position control zone at any arbitrary point ahead of the top dead center of the shuttle within the area from the top dead center to the bottom dead center of the thread take-up lever and setting the end point of the position control zone to any arbitrary point in the area from the bottom dead center to the top dead center of the thread take-up lever. Moreover, the area from the bottom dead center to the top dead center of the thread take-up lever corresponds to an area where the thread take-up lever pulls the needle thread against the processed fabric. Hence, it is preferable that the area be taken as the torque control zone. Consequently, it can preferably be said that the starting point of the torque control zone is taken as a period in the area from the bottom dead center to the top dead center of the thread take-up lever; namely, a period from the instant immediately following release of the sewing needle 12*ba* from an inserted state before the top dead center of the thread take-up lever (or the instant following arrival of the top dead center).

As above, the data pertaining to the starting point and the end point of the torque control zone and the starting point and the endpoint of the position control zone are specified as information about a main spindle angle. Although a term "zone" is employed, the main spindle motor 20 and the main spindle 22 rotate only in one direction. A control zone for one stitch becomes later in terms of time with an increase in main spindle angle. Therefore, a "period" can also be used in lieu of the "zone." For instance, a "torque control period" can also be adopted in place of the "torque control zone." Further, a "position control period" can also be adopted in place of the "position control zone." Moreover, a "control period" can also be used in place of the "control zone."

An explanation is now given to the needle thread J and its path. As shown in FIGS. 1 through 3, the needle thread J drawn from the thread roll 98 is arranged so as to pass from an upstream side to a downstream side in sequence of the pretension component 96, the grip section main body 41, the tubular portion 84 of the turning arm 81, the grip section main body 61, the thread take-up lever 12*a*, and the sewing needle 12*ba*.

Operation of the sewing machine 5 having the above structure is now described by reference to FIG. 7 to FIG. 23. First, operation of the needle thread motor 86 and operation of the solenoids 50 and 70 are described.

First, the control circuit 90 generates main spindle data (see FIG. 7) for each stitch in accordance with the embroidery data stored in the memory device 92. Since the memory device 92 stores, for each stitch, information about an embroidery to be generated, like a stitch width, a stitching direction, and thread attributes (a thread material and a thread thickness), main spindle data are generated according to the stitch width, the stitching direction, and the thread attributes for each stitch. As shown in FIG. 7, the main spindle data are data pertaining to a main spindle angle (i.e., the rotational position of the main spindle motor 20) achieved per unit time in a chronological order. For instance, when the stitch width is large, an amount of change in main spindle angle is decreased. On the contrary, when the stitch width is small, the amount of change in main spindle angle is increased. Moreover, when the stitching direction is opposite to the stitching direction employed last time, the amount of change in main spindle angle is decreased.

When the control circuit 90 generates the main spindle data, an entirety of embroidery data made up of a plurality of stitches can have been generated in advance. Alternatively, there can also be generated main spindle data pertaining to a stitch located several stitches ahead of a stitch by means of which the respective machine elements (the needle bar, the thread take-up lever, the shuttle, and the like) actually perform embroidering. Thereby, actual embroidering can also be performed while the main spindle data are being generated.

Figure 8:
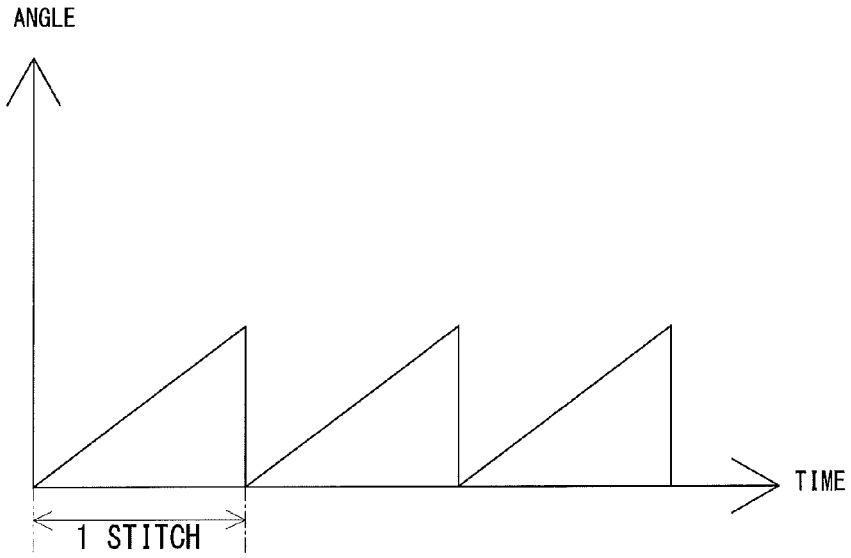
FIG. 8 It is an explanatory view showing the main spindle data.

FIG. 8 shows example main spindle data. The main spindle data shown in FIG. 8 pertain to a case where the main spindle keeps rotating with constant velocity. When the respective stitches have a constant stitch width and when angles of the stitches are also oriented in the same direction, such main spindle data can be adopted. Incidentally, when a certain stitch has a large width, a time consumed to make one stitch is made longer. By contrast, when a certain stitch has a smaller stitch width, a time for one stitch is made shorter.

In accordance with the embroidery data stored in the memory device 92, the control circuit 90 generates on a per-stitch basis needle thread control torque data used for controlling torque of the needle thread motor 86 (see FIG. 9). Specifically, a torque value is determined for each stitch in connection with the needle thread control torque data. The torque value is determined in accordance with information provided for each stitch, like a stitch width, a stitching direction, a thread type, thread attributes, and the like. For instance, in the case of a large stitch width, fastening of the needle thread must be enhanced; therefore, the torque value is increased. When a thread has a large thickness, the fastening of the needle thread must be enhanced; therefore, the torque value is increased. As will be described later, the torque value is set to a value that does not pose any problem when the thread take-up lever 12*a* pulls the needle thread J in the torque control zone. On the occasion of generation of the needle thread control torque data, an entirety of embroidery data made up of a plurality of stitches can have been generated in advance. Alternatively, there can also be generated needle thread control torque data pertaining to a stitch located several stitches ahead of a stitch by means of which the respective machine elements (the needle bar, the thread take-up lever, the shuttle, and the like) actually perform embroidering. Thereby, actual embroidering can also be performed while the needle thread control torque data are being generated. Tension on the needle thread can be controlled for each stitch by means of the needle thread control torque data.

Figure 10:
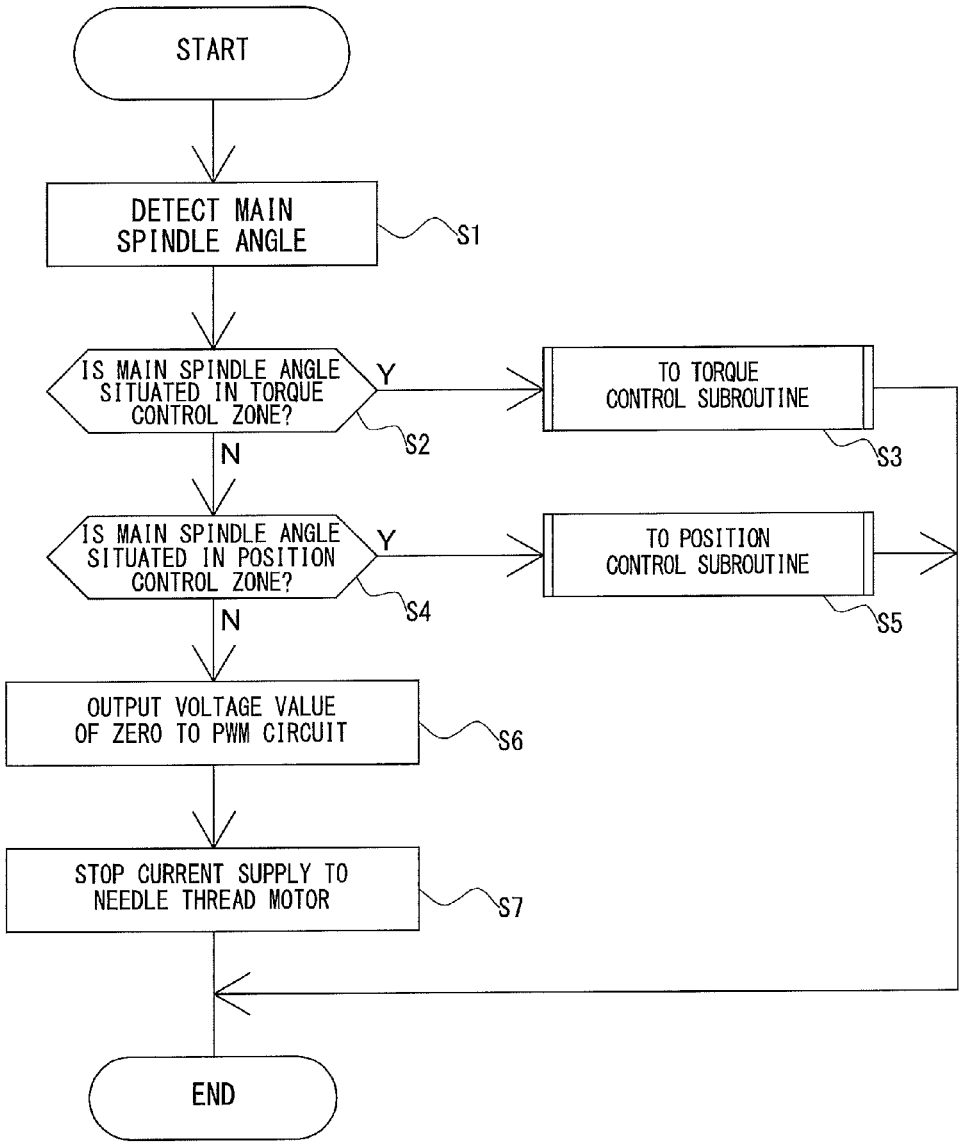
FIG. 10 It is a flowchart showing operation of a needle thread motor.

As shown in FIG. 10, the main spindle angle is first detected during actual embroidering operation (S1). Specifically, a main spindle angle is detected from information from the encoder 21 connected to the main spindle motor 20. The main spindle angle is detected at a predetermined cycle; for instance, a cycle of one-tenths to one-thousandths of a cycle for one stitch.

In accordance with a detected main spindle angle, it is determined that the main spindle motor is situated in which one of zones; namely, the torque control zone, the position control zone, and the other zone. In other words, as shown in FIG. 6, the memory device 92 stores information about the starting point and the end point of the torque control zone and information about the starting point and the end point of the position control zone. Hence, a determination is made by comparing the detected main spindle angle with the information.

Specifically, a determination is made as to whether or not the main spindle angle is in the torque control zone (S2). When the main spindle angle is in the torque control zone, processing proceeds to a torque control subroutine (S3).

When the main spindle angle does not is in the torque control zone, a determination is made as to whether or not the main spindle angle is in the position control zone (S4). When the main spindle angle is in the position control zone, processing proceeds to position control subroutine (S5).

When the main spindle angle is not in the position control zone, the CPU 90*a* outputs a voltage value of 0 to the PWM circuit 90*b* (36), thereby halting a current supply to the needle thread motor 86 (S7). As mentioned above, a period during which the current supply to the needle thread motor 86 is halted corresponds to the area from the end point of the torque control zone to the starting point of the position control zone and the area from the end point of the position control zone to the starting point of the torque control zone which are shown in FIG. 18. Specifically, a current supply halt time is set in order to switch between torque control and position control after the opening and closing of the grip section main bodies 41 and 61 have been reliably switched. Opening and closing of the grip section main bodies 41 and 61 effected during control operation, such as torque control operation and position control operation, can thereby be performed without fail.

When switching response of the grip section main bodies 41 and 61 can be made quick, it is also possible to bring the starting point of the torque control zone in agreement with the end point of the position control zone and also bring the starting point of the position control zone in agreement with the end point of the torque control zone.

Figure 11:
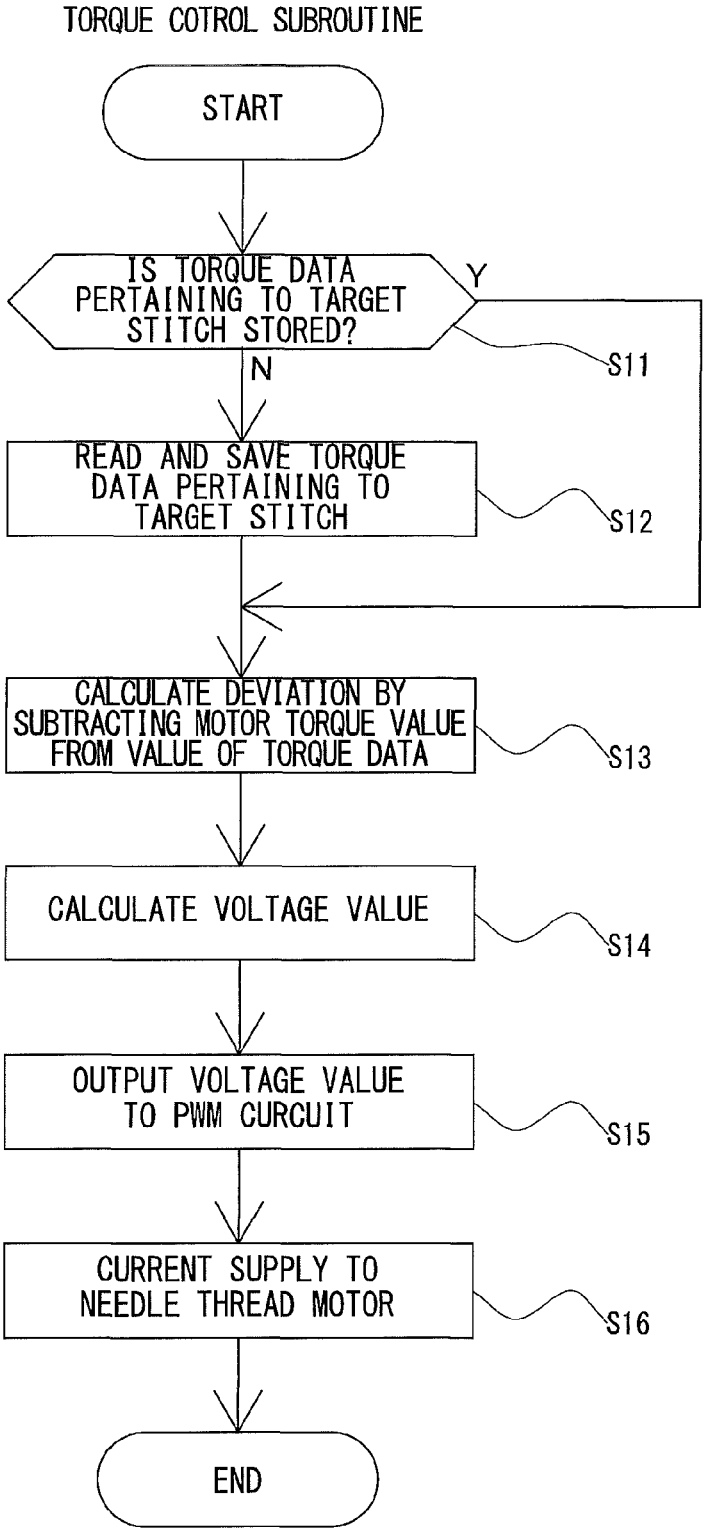
FIG. 11 It is a flowchart showing a method for controlling the needle thread motor and, particularly, a flowchart showing a torque control method.

Next, in the torque control subroutine, torque data (a torque value) pertaining to a target stitch are read from the needle thread control torque data at the starting point of the torque control zone. In the torque control zone for the stitch, torque is controlled in accordance with the thus-read torque data. Specifically, as shown in FIG. 11, it is determined whether or not the torque data pertaining to the target stitch are stored in the control circuit 90 (S11). When the torque data are not yet retained at the starting point of the torque control zone, the torque data pertaining to the target stitch are read from the needle thread control torque data and retained in the control circuit 90 (S12).

When the torque data pertaining to the target stitch are retained, a torque value is read from the current sensor 90*c*, and the torque value thus detected by the current sensor 90*c* is subtracted from a value of the torque data pertaining to the target stitch (S13 shown in FIG. 11, and S13 shown in FIG. 16).

Next, the value calculated in step S13 is multiplied by a predetermined constant, thereby calculating a voltage value (a voltage command to the PWM circuit) to be output to the PWM circuit 90*b* (S14 shown in FIG. 11, and S14 shown in FIG. 16). The thus-calculated voltage value is output to the PWM circuit 90*b* (S15 shown in FIG. 11, and S15 shown in FIG. 16).

In accordance with the thus-input signal, the PWM circuit 90*b* outputs a pulse signal as a voltage signal, thereby supplying an electric current to the needle thread motor 86 (S16 shown in FIG. 11, S16 shown in FIG. 16: a current supply step).

Control executed by the position control subroutine in the position control zone includes detecting an angle of the needle thread motor 86; namely, a current rotational position of the needle thread motor 86 (i.e., a rotational position of an output shaft of the needle thread motor 86); preparing angle correspondence data for controlling the rotational position of the needle thread motor 86 to its initial position (this may also expressed as "a position of origin"); and returning the needle thread motor 86 to its initial position in accordance with the angle correspondence data through position control. First, in relation to the target stitch, a determination is made as to whether or not the angle correspondence data are generated (S21 shown in FIG. 12).

Figure 12:
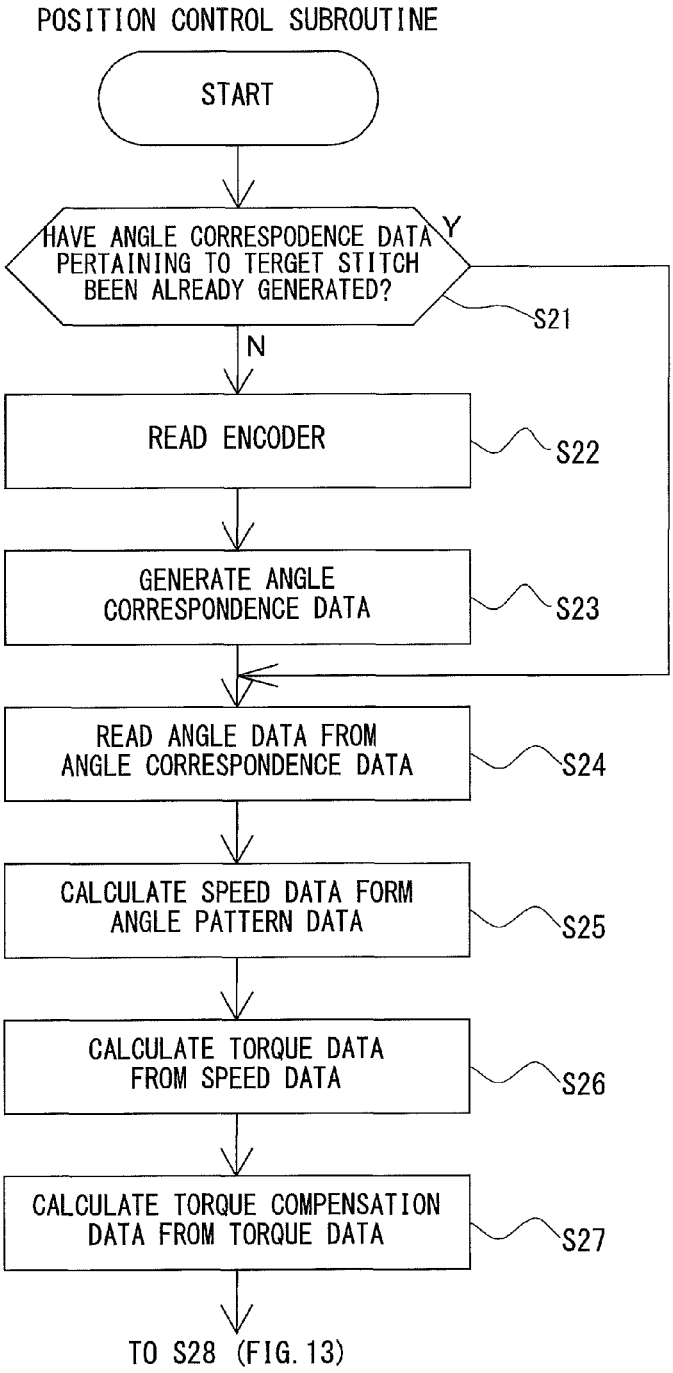
FIG. 12 It is a flowchart showing the method for controlling the needle thread motor and, particularly, a flowchart showing a position control method.
Figure 14:
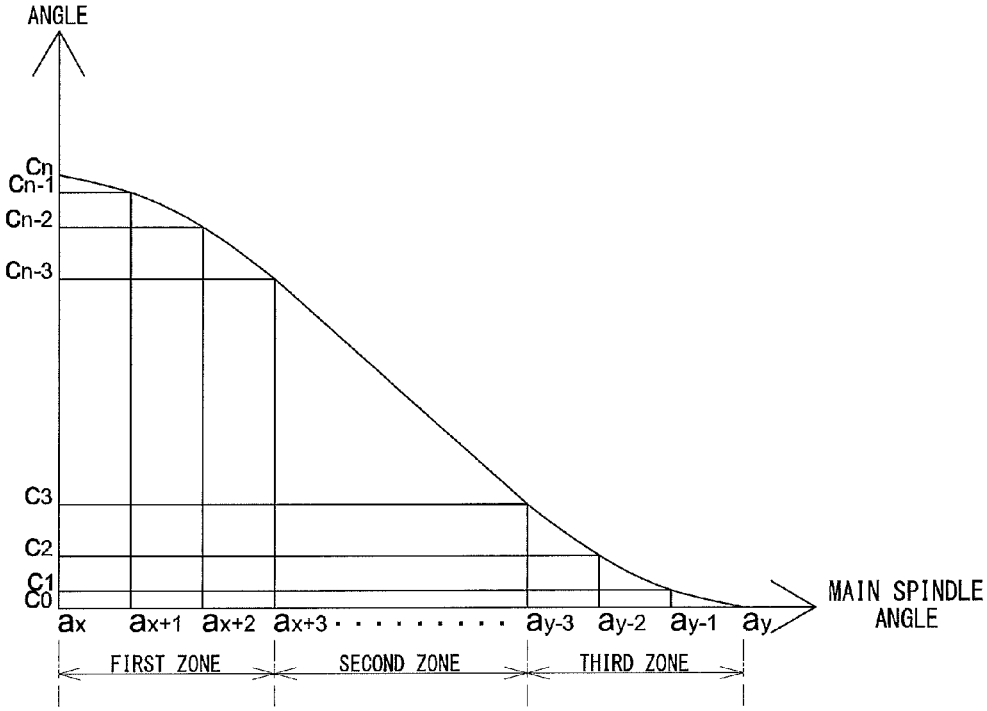
FIG. 14 It is an explanatory view illustrating a method for controlling a position of the needle thread motor.

When the angle correspondence data are not generated yet; namely, at the starting point of the position control zone, the angle of the needle thread motor 86 is detected by means of the encoder 87 (S22 shown in FIG. 12, and S22 shown in FIG. 16). In accordance with the thus-detected angle of the needle thread motor 86, the angle correspondence data are generated (S23 shown in FIGS. 12, and 323 shown in FIG. 16). As shown in FIG. 15, the angle correspondence data are data pertaining to a correspondence between the main spindle angle (i.e., the rotational position of the main spindle motor 20) and a needle thread motor angle (an angle of the needle thread motor) (the rotational position of the needle thread motor 86). More specifically, the angle correspondence data are data pertaining to a correspondence between the main spindle angle and the needle thread motor angle from when the needle thread motor angle changes from $C_n$, achieved at the starting point of the position control zone (the main spindle angle achieved at the starting point of the position control zone is taken as $a_x$) to $C_\theta$ achieved at the end point of the position control zone (the main spindle angle achieved at the end point of the position control zone is taken as $a_y$). The main spindle angle and the needle thread motor angle represent rotational positions of the respective motors. The angle $C_\theta$ is an initial position angle of the needle thread motor 86. On the occasion of generation of the angle correspondence data, a range from the main spindle angle $a_x$ corresponding to the starting point of the position control zone to the main spindle angle $a_y$ corresponding to the end point of the position control zone is divided into equal parts at predetermined intervals (unit angles) (namely, in units of one-$n^{th}$ ("n" is an integer). As shown in FIG. 14, in a first zone that is a predetermined area from the starting point of the position control zone (e.g., a main spindle angle $a_x$ to a main spindle angle $a_{x+3}$), a gradual increase occurs in an amount of change in the needle thread motor per unit angle, whereby a turning speed of the turning arm 81 increases. In a second zone (e.g., the main spindle angle $a_{x+3}$ to a main spindle angle $a_{y-3}$) following the first zone, the amount of change in needle thread motor angle per unit angle becomes constant. In a third zone (e.g., a main spindle angle $a_{y-3}$ to a main spindle angle $a_y$) following the second zone, a gradual decrease occurs in the amount of change in needle thread motor angle per unit angle, whereby the turning speed of the turning arm 81 decreases. An angular range of the first zone and an angular range of the third zone are assumed to be shorter than an angular range of the second zone.

Data pertaining to the needle thread motor angle are read from the angle correspondence data (S24 shown in FIG. 12 and S24 shown in FIG. 16). Specifically, a main spindle angle closest to the main spindle angle detected in step S1 is detected from the angle correspondence data (FIG. 15), and the needle thread motor angle corresponding to the main spindle angle is read. When data pertaining to two main spindle angles adjoining to the main spindle angle detected in step S1 are found in the angle correspondence data, the needle thread motor angle can also be calculated according to a ratio of the detected main spindle angle to the two adjoining main spindle angles.

Speed data are now calculated by detecting an amount of change per unit time from the thus-read needle thread motor angle (S25 shown in FIG. 12, S25 shown in FIG. 16: a speed data calculation step). Speed data are calculated by dividing the amount of change in angle data by a time. Specifically, a relationship between the main spindle angle and the needle thread motor angle is specified by the angle correspondence data shown in FIG. 15. Further, a relationship between a time and a main spindle angle is specified by the main spindle data shown in FIG. 7. The amount of change in needle thread motor angle per unit time is thereby detected. When no match exists between main spindle angle data of the main spindle data and the main spindle angle data of the angle correspondence data, all you need to do; for instance, is to calculate a time from a ratio of the main spindle angle data of the main spindle data to a difference between two main spindle angles adjoining the main spindle angle of the angle correspondence data (the main spindle angle of the main spindle data).

Torque data are now calculated by detecting an amount of change in speed data per unit time (526 shown in FIG. 12, S26 shown in FIG. 16: a torque data calculation step). Specifically, torque data are calculated by dividing the amount of change in speed data by a time. In step S25, the speed data pertaining to the needle thread motor are calculated on a per-time basis; hence, torque data are calculated by differentiating the speed data.

Next, torque compensation data are calculated from the torque data calculated in step S26 (S27 shown in FIG. 12, and S27 shown in FIG. 16). Specifically, the torque data are multiplied by an inertia ratio (S27-1 shown in FIG. 16), torque derived from a mechanical loss is added to a value determined by multiplying the torque data by the inertia ratio, thereby calculating torque compensation data (S27-2 shown in FIG. 16). The inertia ratio is a constant previously determined according to a mass of each of the machine elements, or the like. Further, the torque derived from a mechanical loss is a value previously determined in correspondence with each of the machine elements.

Figure 13:
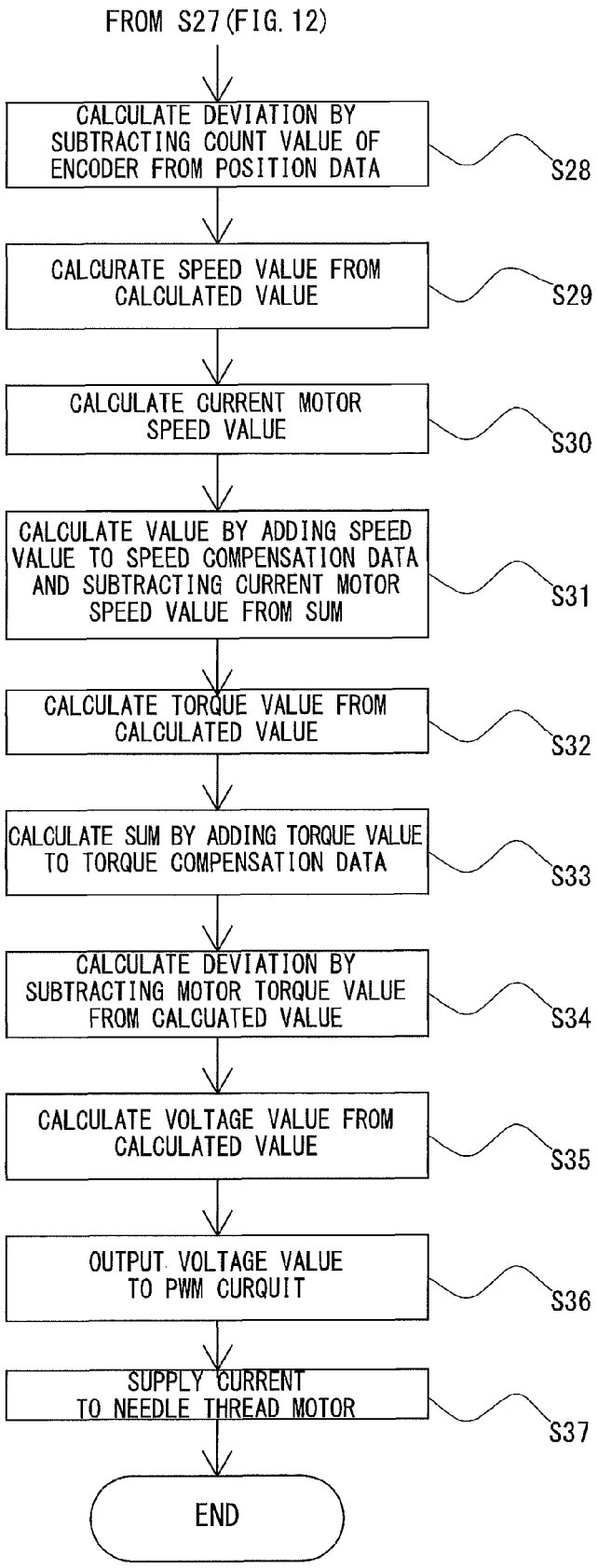
FIG. 13 It is a flowchart showing the method for controlling the needle thread motor and, particularly, a flowchart showing the position control method.

Data (a count value of the encoder) output from the encoder 87 (the encoder corresponding to the needle thread motor 86) are subtracted from the angle data read in step S24 (528 shown in FIG. 13, S28 shown in FIG. 16: a location deviation calculation step). A value calculated in step S28 can be said to be a value of a location deviation.

The value calculated in step S28 is now multiplied by a predetermined constant, thereby calculating a speed value (S29 shown in FIG. 13 and S29 shown in FIG. 16).

A current motor speed value is calculated by differentiating the output from the encoder 87 (S30 shown in FIG. 13 and S30 shown in FIG. 16). Specifically, an amount of change in encoder count value per unit time is calculated, thereby calculating a current motor speed value.

Next, the current motor speed value calculated in step S31 is subtracted from the speed value calculated in step S30, and the speed data calculated in step S25 are added to a subtraction result (S31 shown in FIG. 13, S31 shown in FIG. 16: a speed deviation calculation step). A value calculated in step S31 can be said to be a value of speed deviation.

The value calculated in step S31 is multiplied by a predetermined constant, thereby calculating a torque value (S32 shown in FIGS. 13 and 532 shown in FIG. 16).

Torque compensation data calculated in step S27 are added to the torque value calculated in step S32 (S33 shown in FIG. 13, and S33 shown in FIG. 16). Subsequently, the torque value output from the current sensor 90*c* is subtracted from the value calculated in step S33 (S34 shown in FIG. 13, S34 shown in FIG. 16: a torque deviation calculation step). The value calculated in step S34 can be said to be a torque deviation value.

The value calculated in step S34 is multiplied by a predetermined constant, thereby calculating a voltage value (a voltage command to the PWM circuit) output to the PWM circuit 90*b* (S35 shown in FIG. 13, 335 shown in FIG. 16). The voltage value is then output to the PWM circuit 90*b* (S36 shown in FIG. 13, and S36 shown in FIG. 16).

The PWM circuit 90*b* outputs a pulse signal as a voltage signal in accordance with an input signal, thereby supplying an electric current to the needle thread motor 86 (S37 shown in FIG. 13, S37 shown in FIG. 16: a current supply step).

As mentioned above, processing represented by flowcharts shown in FIGS. 10 to 13 is carried out at predetermined cycles, thereby controlling the needle thread motor 86.

As shown in FIG. 18, in relation to control of switching between the upstream grip section 40 and the downstream grip section 60, the grip section main body 41 of the upstream grip section 40 is opened, and the grip section main body 61 of the downstream grip section 60 is closed from the end point of the torque control zone to the end point of the position control zone of the needle thread motor 86. In the meantime, the grip section main body 41 of the upstream grip section 40 is closed, and the grip section main body 61 of the downstream grip section 60 is opened from the end point of the position control zone to the end point of the torque control zone.

Figure 17:
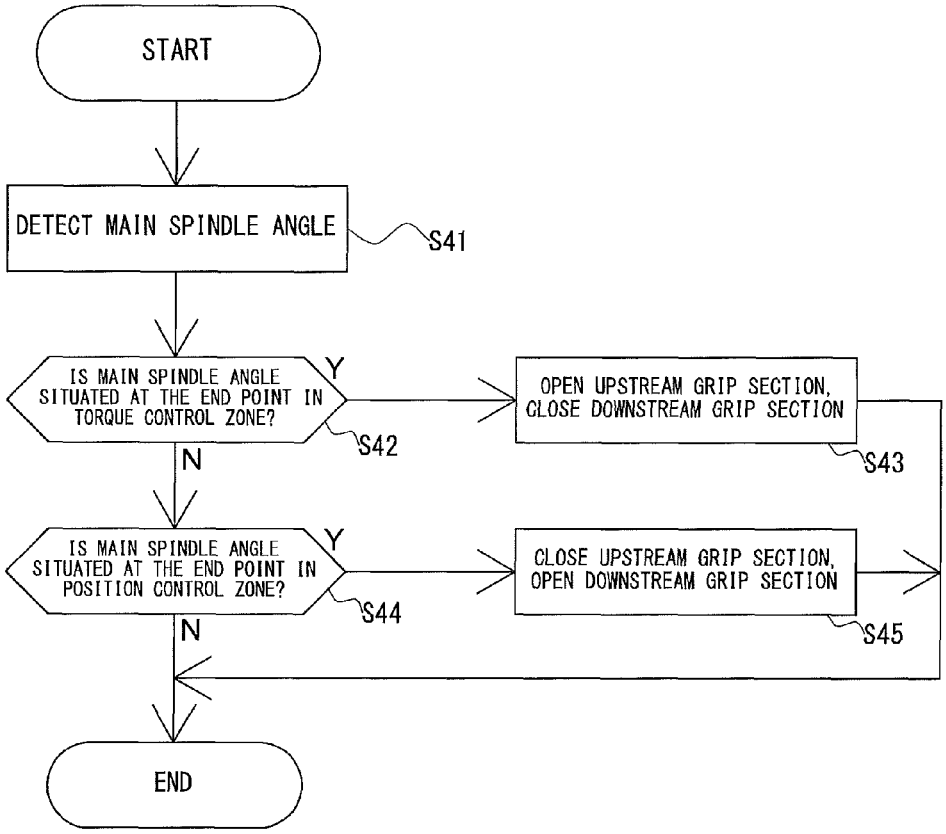
FIG. 17 It is a flowchart showing operation of an upstream grip section and operation of a downstream grip section.

Specifically, explanations are given along a flowchart shown in FIG. 17. A main spindle angle is detected (S41) (detection of a main spindle angle is performed in the same manner as described in connection with the stitch S1). A determination is made as to whether or not the main spindle angle is situated at the end point of the torque control zone (S42). When the main spindle angle is at the end point of the torque control zone, the grip section main body 41 of the upstream grip section 40 is opened, and the grip section main body 61 of the downstream grip section 60 is closed. Specifically, the needle thread J is not fixed by the grip section main body 41 but fixed by the grip section main body 61. Even when the main spindle angle has not reached the end point of the torque control zone yet on the occasion of detection of the previous main spindle angle (S41) and when the main spindle angle has passed on the endpoint of the torque control zone on the occasion of detection of the current main spindle angle (S41), the main spindle angle is determined to be at the end point of the torque control zone.

Further, when the main spindle angle is not at the end point of the torque control zone, a determination is made as to whether or not the main spindle angle is at the end point of the position control zone (S44). When the main spindle angle is at the endpoint of the position control zone, the grip section main body 41 of the upstream grip section 40 is closed, and the grip section main body 61 of the downstream grip section 60 is opened. Incidentally, even when the main spindle angle has not reached the end point of the position control zone yet on the occasion of detection of a previous main spindle angle (S41) and when the main spindle angle has passed on the end point of the position control zone on the occasion of detection of a current main spindle angle (S41), the main spindle angle is determined to be at the end point of the position control zone.

As mentioned above, in the torque control zone, the grip section main body 41 is closed, and the grip section main body 61 is opened. In the position control zone, the grip section main body 41 is opened, and the grip section main body 61 is closed.

Figure 19:
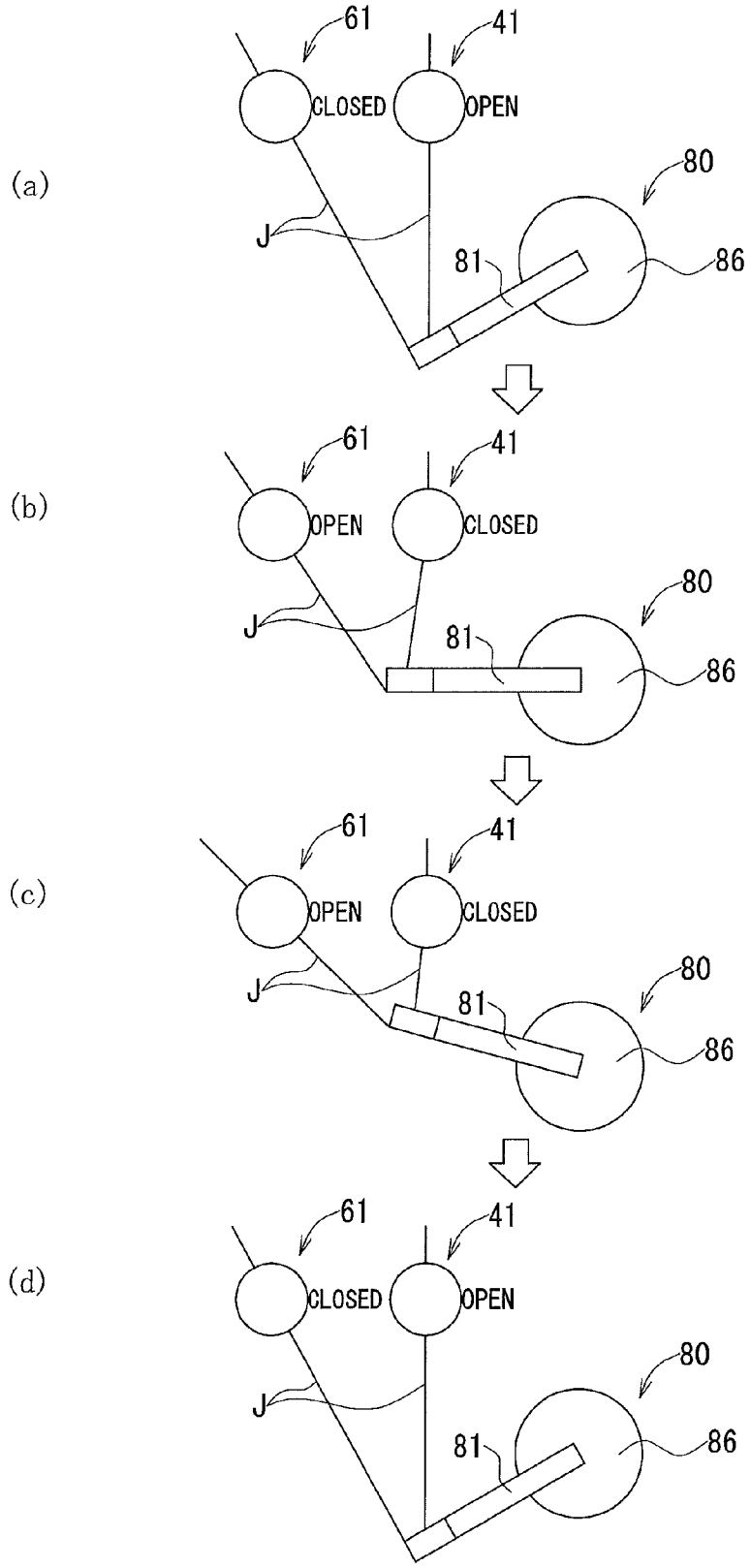
FIG. 19 It is an explanatory view for describing operation of a needle thread control section.

Operation of the needle thread control section 30 is illustrated in a schematic manner as shown in FIG. 19. When the main spindle angle is at the endpoint of the position control zone, the turning arm 81 is situated at the position of the bottom dead center (the initial position) (FIG. 19(*a*)).

When the main spindle angle enters the torque control zone, the needle thread motor 86 is subjected to torque control while the grip section main body 41 is closed and while the grip section main body 61 is opened, whereby the needle thread motor 86 imparts downward rotating force to the turning arm 81. Thereby, the thread take-up lever 12*a* turns upwardly while the turning arm 81 is pulling the needle thread J against a direction (a pulling direction) in which the thread take-up lever 12*a* pulls the needle thread J, thereby pulling the needle thread J with respect to the processed fabric. As the thread take-up lever 12*a* pulls the needle thread J, the turning arm 81 thereby turns in the direction (the upward direction) in which the thread take-up lever 12*a* pulls the needle thread J (FIGS. 19(*b*), (*c*)).

Torque set in the needle thread control torque data is set to a value such that, as the thread take-up lever 12*a* pulls the needle thread J, the turning arm 81 turns in the direction (the upward direction) in which the thread take-up lever 12*a* pulls the needle thread J and does not hinder the thread take-up lever 12*a* from pulling the needle thread J (i.e., the thread take-up lever 12*a* can pull the needle thread J with respect to the processed fabric without impediment). Specifically, if the torque value is excessively large, the turning arm 81 will downwardly pull the needle thread J, thereby making the thread take-up lever 12*a* unable to turn upwardly to draw the needle thread J upwardly. For this reason, the torque value is set such that the thread take-up lever 12*a* is not hindered from pulling the needle thread J.

When the main spindle angle enters the position control zone, the needle thread motor 86 is subjected to position control while the grip section main body 41 is opened and while the grip section main body 61 is closed, whereupon the turning arm 81 turns in a direction (a downward direction) in which the needle thread J is pulled (FIG. 19(*d*)). FIG. 19(*d*) shows a state where the turning arm 81 turned to its initial position (this may also be expressed as "a position of origin") as a result of the needle thread motor 86 having returned to the initial position at the endpoint of the position control zone. FIG. 19(*d*) is analogous to FIG. 19(*a*).

When the torque value is large, the needle thread J is hardly pulled during torque control, so that a corresponding stitch is tightly sewn. On the contrary, when the torque value is small, the needle thread J is weakly pulled, so that a corresponding stitch is softly sewn.

Figure 20:
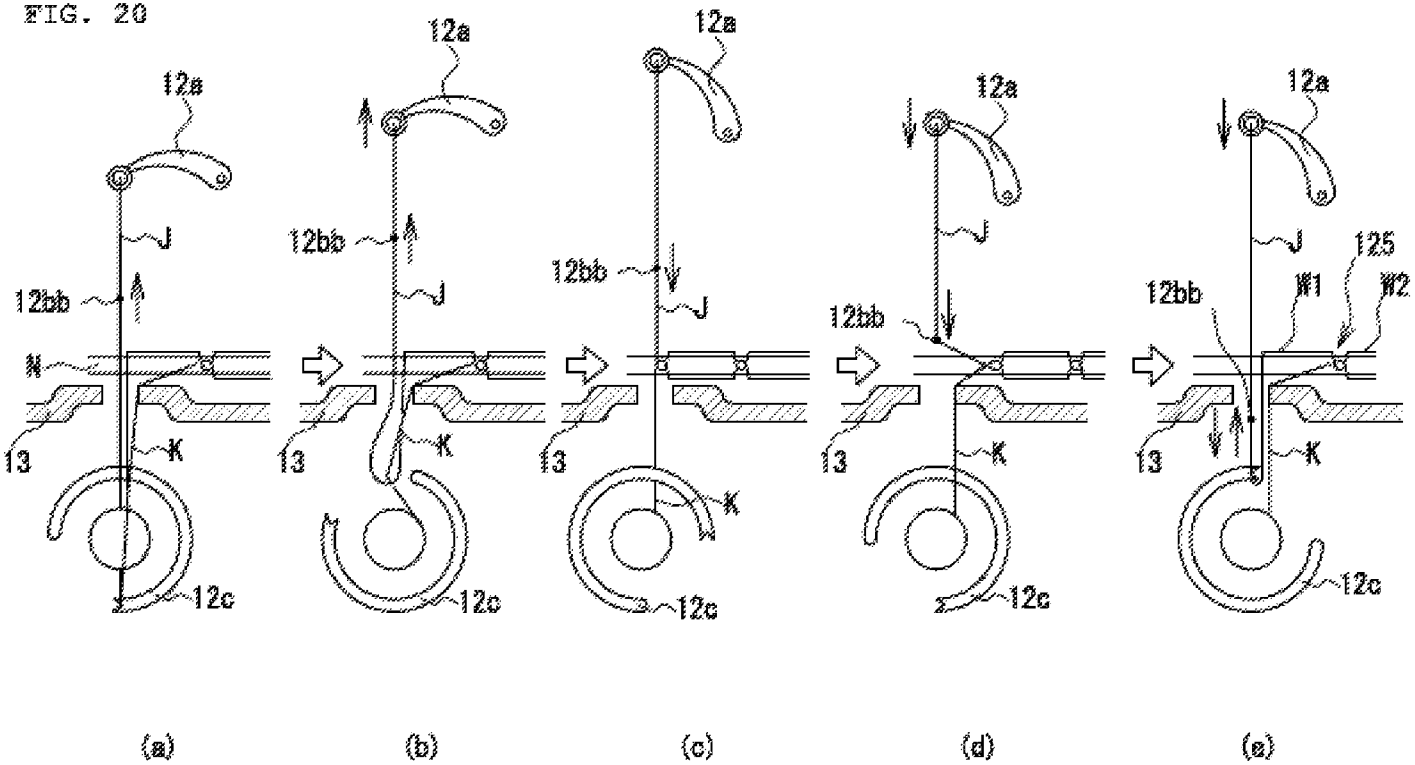
FIG. 20 It is an explanatory view showing operation of the sewing machine of the first embodiment and operation of the sewing machine of the second embodiment.

Namely, in connection with FIG. 20, FIG. 20(*a*) shows a state achieved when the main spindle angle is at about 290 degrees in FIG. 18; FIG. 20(*b*) shows a state achieved when the main spindle angle is at about 330 degrees in FIG. 18; FIG. 20(*c*) shows a state achieved when the main spindle angle is at about 70 degrees in FIG. 18; FIG. 20(*d*) shows a state achieved when the main spindle angle is at about 110 degrees in FIG. 18; and FIG. 20(*e*) shows a state achieved when the main spindle angle is at about 170 degrees in FIG. 18. The needle thread motor 86 is subjected to torque control in FIG. 20(*b*) and FIG. 20(*c*). When a torque value for a certain stitch is increased, the needle thread J is hardly pulled, so that the stitch is therefore tightly sewn. In the meantime, when the torque value is decreased, the needle thread J is weakly pulled, so that the stitch is softly sewn. In FIG. 20, reference symbol K denotes a bobbin thread, and N denotes a processed fabric.

As above, in connection with a control zone for each stitch, in a torque control zone including at least a portion of an area from the bottom dead center to the top dead center of the thread take-up lever 12*a* that is a zone during which the thread take-up lever 12*a* pulls the needle thread with respect to the processed fabric to be sewn with the needle thread, there is performed torque control for imparting rotating force to the turning arm 81 in accordance with the torque value in such a way that tension is imparted to the needle thread against the direction in which the thread take-up lever 12*a* pulls the needle thread, while the grip section main body 41 is closed and while the grip section main body 61 is opened, in the meantime, in a position control zone which is at least one of the zones other than the torque control zone, there is performed position control for imparting rotating force to the turning arm 81 in accordance with angular position data pertaining to the needle thread motor 86 in such a way that the angle of the needle thread motor 86 returns to its initial angular position which is a rotational position of the needle thread motor 86, while the grip section main body 41 is opened and while the grip section main body 61 is closed, thereby drawing the needle thread from upstream.

Control of the main spindle motor 20 is now described. Control of the main spindle motor 20 is performed in the same manner as in the case of position control of the needle thread motor 86.

First, angle data (this can also be taken as position data) are read from the main spindle data (S51 shown in FIG. 21, S51 shown in FIG. 23: a reading step). Specifically, an angle (a main spindle angle) corresponding to a time that is an objective of processing is detected from the main spindle data, and data pertaining to the angle are read.

Next, there is detected an amount of change in the thus-detected main spindle angle per unit time, and speed data are calculated (S52 shown in FIG. 21, S52 shown in FIG. 23: a speed data calculation step). On the occasion of calculation of speed data, the amount of change in angle data is divided by a time, thereby calculating speed data. Namely, the speed data are calculated by differentiating the angle data.

The amount of change in speed data per unit time is detected, thereby calculating torque data (S53 shown in FIG. 21, S53 shown in FIG. 23: a torque data calculation step). On the occasion of calculation of torque data, the amount of change in speed data is divided by a time, thereby calculating torque data. Namely, torque data are calculated by differentiating the speed data. Speed data required to calculate the amount of change in speed are previously retained by the CPU 90*a*.

Torque compensation data are calculated from the torque data calculated in step S53 (S54 shown in FIG. 21, S54 shown in FIG. 23). Specifically, torque data are multiplied by an inertia ratio (S54-1 shown in FIG. 23), and torque derived from a mechanical loss is added to a value determined by multiplying the torque data by the inertial ratio, thereby calculating the torque compensation data (S54-2 shown in FIG. 23). The inertia ratio is a constant previously determined according to a mass of each of the machine elements, or the like. Further, the torque derived from a mechanical loss is a value previously determined in correspondence with each of the machine elements.

Data (a count value of the encoder) output from the encoder 21 are subtracted from the angle data read in step S51 (S55 shown in FIG. 22, S55 shown in FIG. 23: a location deviation calculation step). A value calculated in step 355 can be said to be a value of a location deviation.

The value calculated in step S55 is now multiplied by a predetermined constant, thereby calculating a speed value (S56 shown in FIG. 22 and S56 shown in FIG. 23).

A current motor speed value is calculated by differentiating the output from the encoder 21 (S57 shown in FIG. 22 and S57 shown in FIG. 23). Specifically, an amount of change in encoder count value per unit time is calculated, thereby calculating a current motor speed value.

Next, the current motor speed value calculated in step 357 is subtracted from the speed value calculated in step S56, and the speed data calculated in step S52 are added to a subtraction result (558 shown in FIG. 22, S58 shown in FIG. 23: a speed deviation calculation step). A value calculated in step S58 can be said to be a value of speed deviation.

The value calculated in step S58 is multiplied by a predetermined constant, thereby calculating a torque value (559 shown in FIG. 22 and S59 shown in FIG. 23).

The torque value output from the current sensor 90*c* is subtracted from the torque value calculated in step S59. Further, torque compensation data calculated in step S54 are added to a subtraction result (S60 shown in FIG. 22, and S60 shown in FIG. 23: a torque deviation calculation step). The value calculated in step S60 can be said to be a torque deviation value.

The value calculated in step S60 is multiplied by a predetermined constant, thereby calculating a voltage value (a voltage command to the PWM circuit) output to the PWM circuit 90*b* (S61 shown in FIG. 22, S61 shown in FIG. 23). The voltage value is then output to the PWM circuit 90*b* (S62 shown in FIG. 22, and S62 shown in FIG. 23).

The PWM circuit 90*b* outputs a pulse signal as a voltage signal in accordance with an input signal, thereby supplying an electric current to the main spindle motor 20 (S63 shown in FIG. 22, S63 shown in FIG. 23: a current supply step).

As mentioned above, the sewing machine of the first embodiment subjects the needle thread to torque control in the torque control zone, so that a magnitude of tension exerted on the needle thread can be controlled. In particular, torque control is performed on a per-stitch basis in the torque control zone by means of needle thread control torque data (FIG. 9). Hence, tension exerted on the needle thread can be controlled on a per-stitch basis, so that seam hardness can be controlled on a per-stitch basis.

Figure 46:
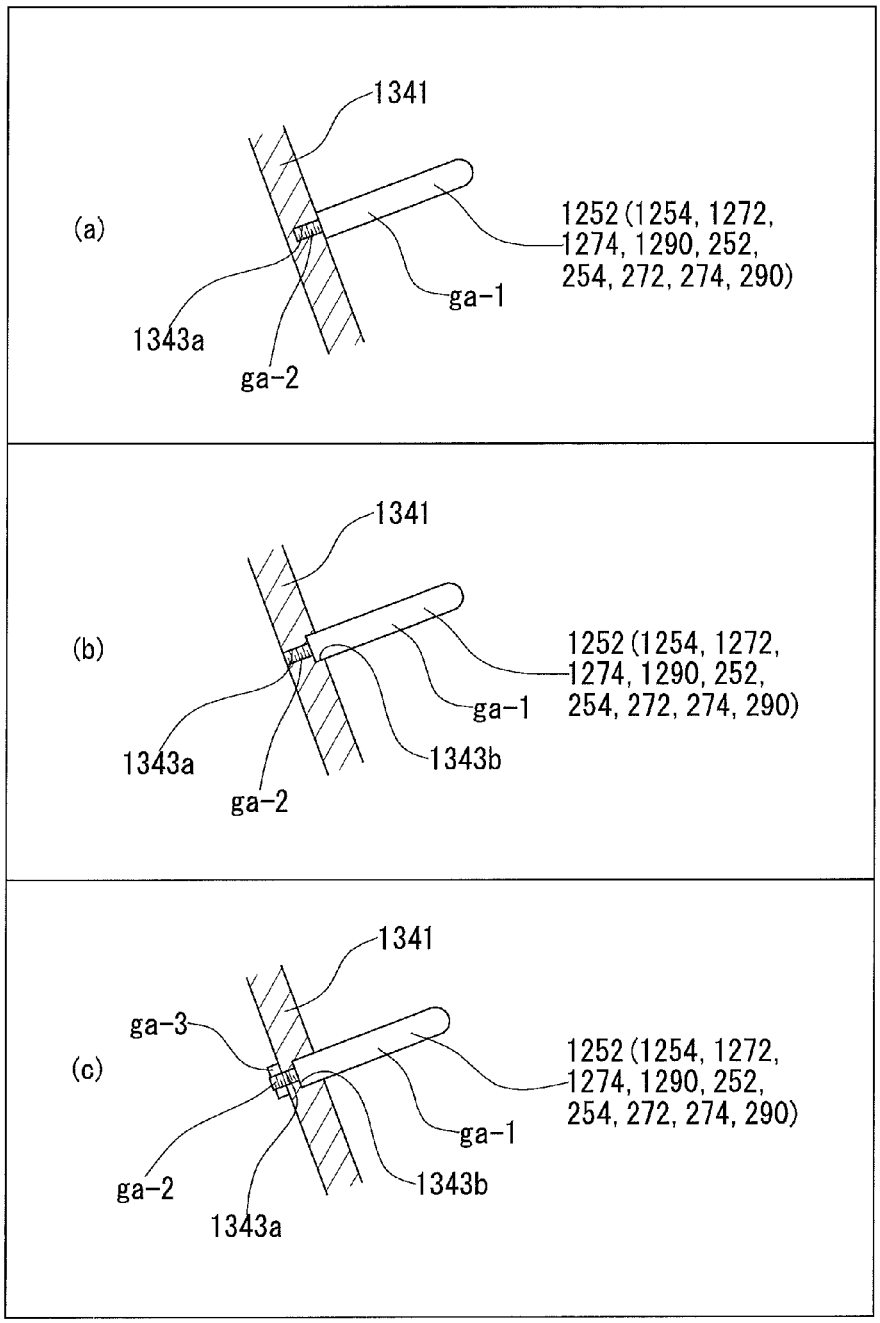
FIG. 46 It is an explanatory view showing configurations of a guide member and ways to attach the same.

The needle thread control section 30 is provided in lieu of the tension disc, the rotary tension component, and the tension spring of the related-art sewing machine (see FIG. 46). Thereby, the grip section main body 41 becomes open in the position control zone where the needle thread J is drawn. Only the pretension component 96 is present at an upstream position with respect to the turning arm 81 of the turning section 80, and friction resistance does not exist between the tension disc and the rotary tension component. Moreover, since the grip section main body 61 becomes closed, movements of the thread take-up lever 12*a* will not pose any problems at the time of drawing of the needle thread. Consequently, the needle thread can be smoothly drawn from the thread roll, and the possibility of occurrence of a thread break can be reduced.

If a break has occurred in the needle thread, upward pulling of the turning arm 81, which would otherwise occur when the thread take-up lever 12*a* moves to the top dead center, is prevented in the torque control zone. Specifically, the turning arm 81 will not be pulled in a direction opposite to the direction in which the rotating force of the needle thread motor 80 is imparted. Therefore, occurrence of a thread break can be detected by means of detecting that the turning arm 81 is not pulled upward. Further, when there is not a thread break, the turning arm 81 is pulled upward in the torque control zone, so that occurrence of a thread break can be detected accurately.

In the position control zone, a current position of the needle thread motor 86 is detected, and angle correspondence data for controlling the position of the needle thread motor 86 to its initial position are generated. Since there is performed control for returning the needle thread motor 86 to its initial position through position control in accordance with the angle correspondence data, the needle thread can be drawn, in the torque control zone, by only the amount corresponding to a quantity of thread consumed as a result of pulling of the turning arm 81. Hence, an excess or deficiency of the quantity of accumulated thread, which would otherwise be caused by drawing a needle thread, will not arise.

Another example of the sewing machine 5 is now described by reference to FIG. 24. In the example shown in FIG. 2 and FIG. 3, the turning section 80 is disposed beneath the upstream grip section 40 and the downstream grip section 60. However, in the example shown in FIG. 24, the turning section 80 is disposed above the upstream grip section 40 and the downstream grip section 60.

In the example shown in FIG. 2 and FIG. 3, the thread take-up lever 12*a* is structured so as to turn upwardly, thereby drawing a needle thread J located downstream of the thread take-up lever 12*a*. In the example shown in FIG. 24, the thread take-up lever 12*a* is constituted so as to draw the needle thread J located downstream of the thread take-up lever 12*a* by turning downwardly. Specifically, in the turning range of the thread take-up lever 12*a*, "the other dead center" that is the end in the direction in which the needle thread is drawn corresponds to a lower end. "The one dead center" corresponds to an upper end. An area from one dead center to the other dead center of the thread take-up lever 12*a* corresponds to a range where the needle thread is drawn with respect to the processed fabric.

Figure 24:
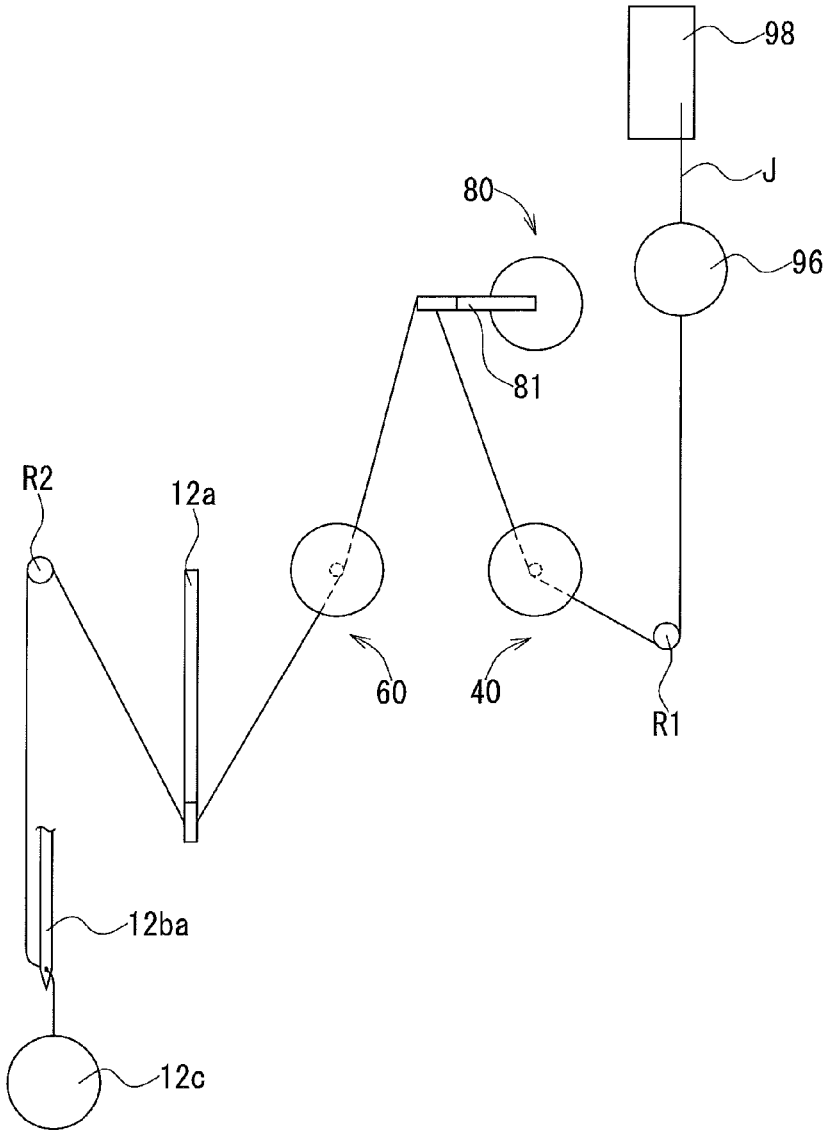
FIG. 24 It is an explanatory view of a principal part showing another example sewing machine of the first embodiment.
Figure 25:
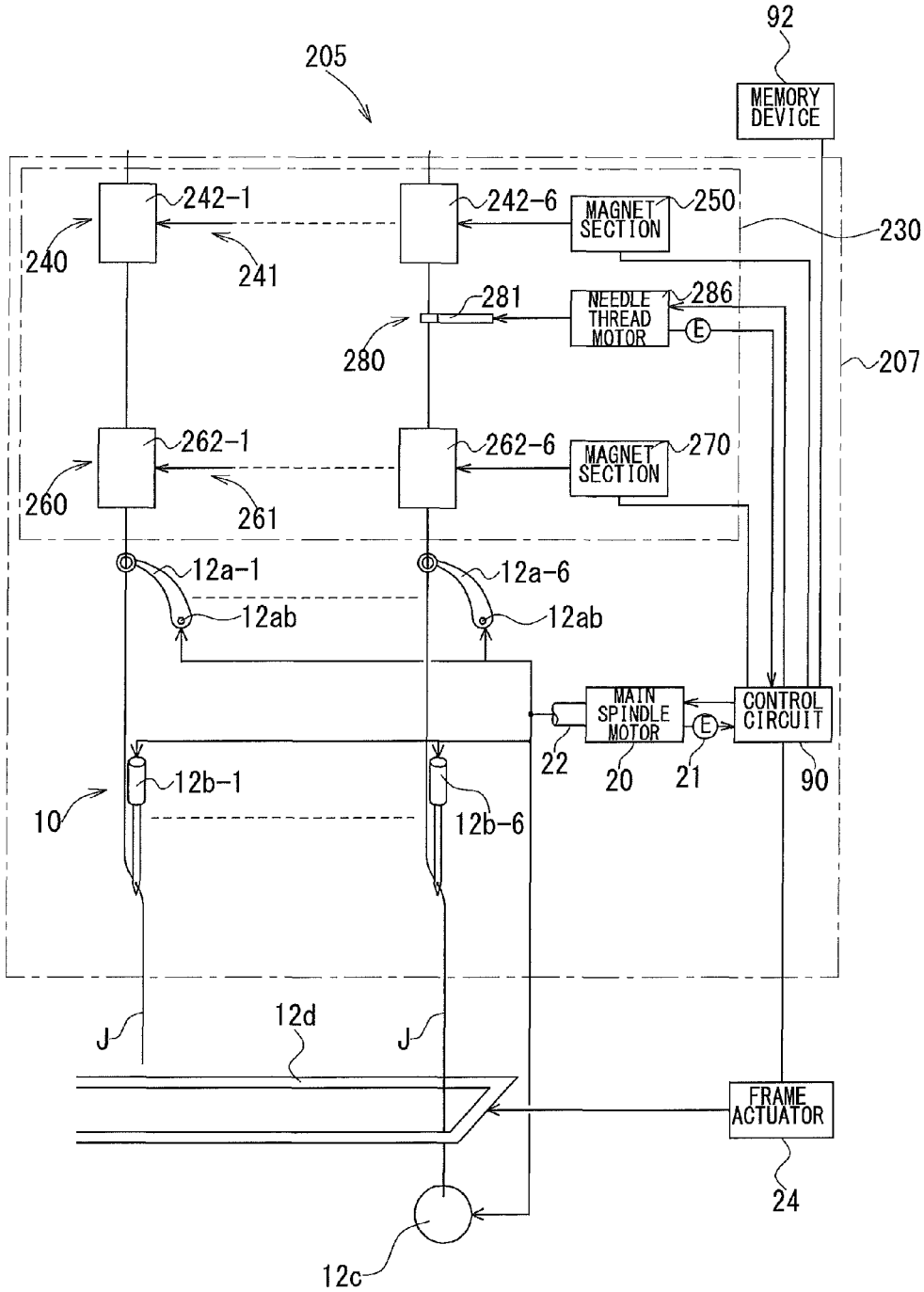
FIG. 25 It is an explanatory view showing the sewing machine of the second embodiment.
Figure 26:
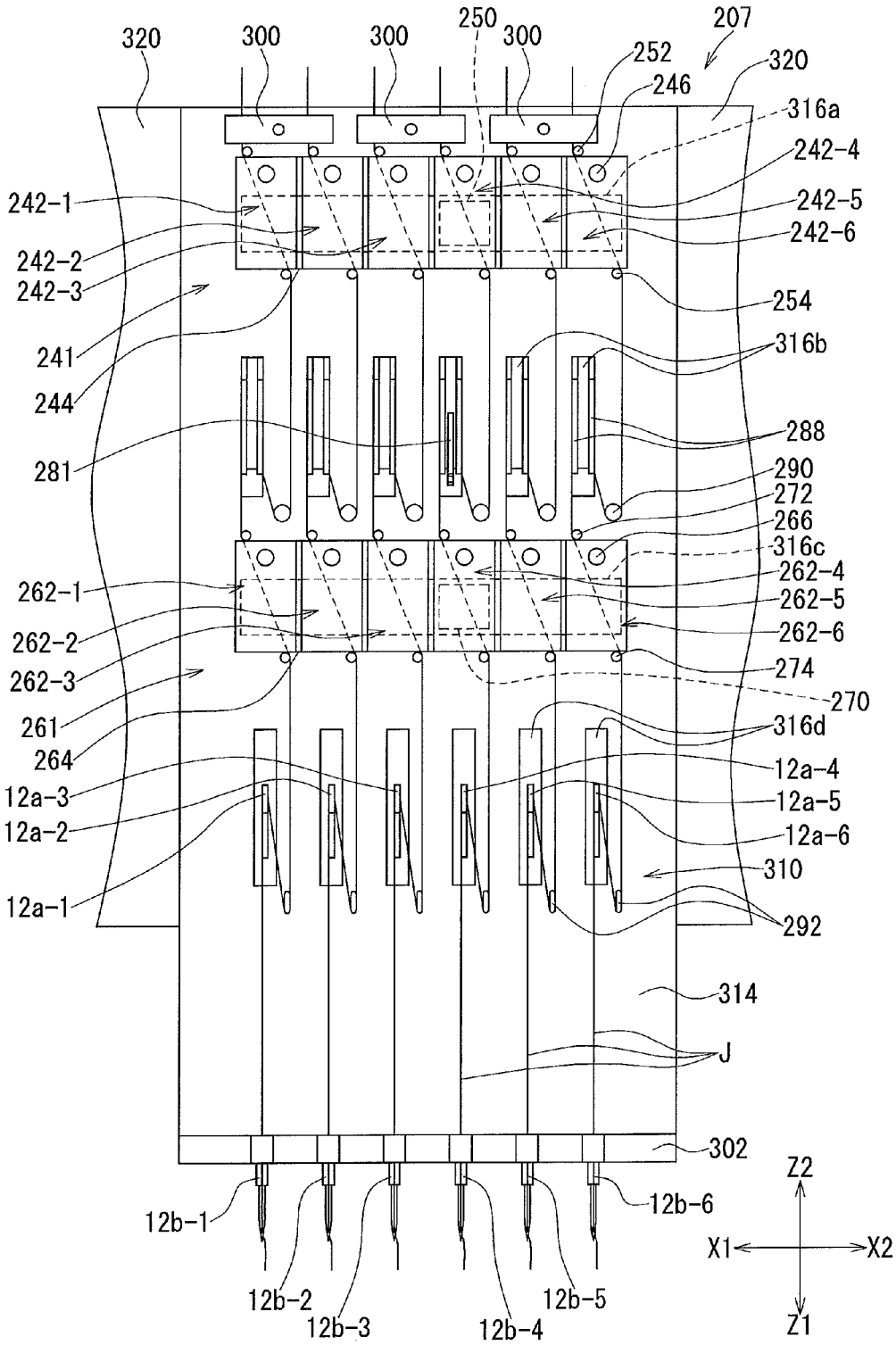
FIG. 26 It is a front view showing the sewing machine of the second embodiment.

Specifically, in the example shown in FIG. 24, a cylindrical guide R1 used for changing a direction of the path of the needle thread J is interposed between the thread roll 98 and the upstream grip section 40 along the path of the needle thread J. Likewise, a cylindrical guide R2 used for changing the direction of the path of the needle thread J is interposed between the thread take-up lever 12*a* and the sewing needle 12*ba* along the path of the needle thread J.

In the turning section 80, the needle thread motor 86 is subjected to torque control in the torque control zone, whereby rotating force is upwardly imparted to the turning arm 81. The thread take-up lever 12*a* downwardly turns while the turning arm 81 is drawing the needle thread J against the direction in which the thread take-up lever 12*a* draws the needle thread J, thereby upwardly pulling the needle thread J with respect to the processed fabric. As the thread take-up lever 12*a* pulls the needle thread J, the turning arm 81 thereby turns in a direction (downward direction) in which the thread take-up lever 12*a* draws the needle thread J.

In the position control zone, the needle thread motor 86 is subjected to position control while the grip section main body 41 is opened and while the grip section main body 61 is closed, whereby the turning arm 81 turns in a direction (an upward direction) in which the needle thread J is drawn.

Although the above descriptions are provided on the assumption that the sewing machine 5 is an embroidery sewing machine, the sewing machine can also be another sewing machine other than the embroidery sewing machine. The needle thread control section 30 having the foregoing configuration and the control section for controlling the needle thread control section 30 are provided. In relation to a control zone for each stitch, in a torque control zone including at least a portion of an area from a bottom dead center to a top dead center of a thread take-up lever that is a zone in which the thread take-up lever draws the needle thread with respect to a processed fabric to be sewn with the needle thread, there is performed torque control for imparting rotating force to the turning arm 81 in accordance with a torque value so as to impart tension to the needle thread against a direction in which the thread take-up lever draws the needle thread while the grip section main body 41 is closed and while the grip section main body 61 is opened, in the meantime, in a position control zone which is at least one of the zones other than the torque control zone, there is performed position control for imparting rotating force to the turning arm 81 in accordance with angle position data pertaining to the needle thread motor 86 such that the angle of the needle thread motor 86 returns to its initial angular position that is a rotational position of the needle thread motor 86 while the grip section main body 41 is opened and while the grip section main body 61 is closed. Thus, the needle thread is drawn from upstream.

Second Embodiment

A sewing machine of a second embodiment is now described. A sewing machine 205 of the second embodiment is an embroidery sewing machine and structured as shown in FIGS. 25 to 28. The sewing machine 205 has a head (an embroidering head) 207, the shuttle 12*c*, the sewing frame 12*d*, the frame actuator 24, and the memory device 92. The sewing machine 205 is a multi-needle sewing machine; specifically, a six-needle embroidery sewing machine that can cope with six types of needle threads.

The head 207 is positioned above an approximately tabular sewing machine table (not shown) in the same way as is the head 7. A frame 320 (see FIG. 27) stands upright on an upper surface of the sewing machine table, and the head 207 is put on a front side of the frame 320.

The head 207 is constituted as shown in FIGS. 25 to 28 and includes the machine element group 10, the main spindle motor 20, the main spindle 22, a needle thread control section 230, the control circuit 90, needle thread guides 300 and 302, and a case 310.

The machine element group 10 is comprised of machine elements to be actuated in the head 207. As with the first embodiment, the machine elements include thread take-up levers, needle bars, and presser feet (not shown). However, in the second embodiment, the head is equipped with a plurality of thread take-up levers and a plurality of needle bars; in other words, a plurality of (specifically six) thread take-up levers 12*a*-1 to 12*a*-6 and a plurality of (specifically six) needle bars 12*b*-1 to 12*b*-6. The thread take-up levers 12*a*-1 to 12*a*-6, the needle bars 12*b*-1 to 12*b*-6, and the shuttle 12*c* are actuated by means of transmitting rotating force of the main spindle 22 by way of the power transmission means, like a cam mechanism or a belt mechanism, as in the case of the related-art sewing machine.

The thread take-up levers 12*a*-1 to 12*a*-6 are provided in a needle bar case 314 of the case 310 and are formed so as to be able to sway around an axis line (the rotating center) in the horizontal direction (the direction X1-X2) and perform turning action between the bottom dead center (one dead center) and the top dead center (the other dead center). The thread take-up levers 12*a*-1 to 12*a*-6 are axially supported by the needle bar case 314 so as to sway around the rotating center (that can also be referred to as a swaying center) 12*ab*. A needle thread to be inserted into the sewing needle 12*ba* is inserted into the thread take-up lever 12*a*. As a result of the needle bar case 314 sliding in the horizontal direction with respect to an arm 312, power is transmitted solely to a specific selected thread take-up lever, whereupon the thread take-up lever is swayed. Leading ends of the respective thread take-up levers 12*a*-1 to 12*a*-6 project to the front (in direction Y1) from an opening section 316*d* formed in a front section 314*a* of the needle bar case 314, to thus be exposed. Tension springs 292 [that can also be referred to as "thread take-up springs" (generally called "high tension springs")] (a second needle thread inverting member) for guiding the respective needle threads J sent from upward positions (i.e., from downstream grip sections 260) are fixedly mounted at positions on the front section 314*a* of the needle bar case 314 that are low neighborhoods of the respective opening sections 316*d*. The tension springs 292 invert the needle threads J guided from upward positions and subsequently guide them to the respective thread take-up levers, and tension is exerted on the needle threads J. Like guide members 290, rod-shaped guides can also be used in place of the tension springs 292.

The needle bars 12*b*-1 to 12*b*-6 are provided in the needle bar case 314 so as to be movable in the vertical direction. The sewing needle 12*ba* (the needle thread is inserted into the pin hole 12*bb* of each of the sewing needles 12*ba*) is fixedly provided at a lower end of each of the needle bars 12*b*. The needle bar connecting stud 14*a* is fixedly provided at an upper end of each of the needle bars 12*b*. Further, the needle bar actuation member 14*b* is engaged with each of the needle bar connecting studs 14*a*. The vertically-oriented base needle bar 14*c* is inserted into each of the needle bar actuation members 14*b*. The needle bar actuation members 14*b* are formed so as to be movable in the vertical direction along the respective base needle bars 14*c*. Rotating force of the main spindle 22 is transmitted by the power transmission means, whereupon the needle bar actuation members 14*b* are vertically actuated. The needle bars are thereby moved in the vertical direction. The needle bar case 314 slides in the horizontal direction (the horizontal direction in FIG. 26) with respect to the arm 312, whereby the needle bar actuation member 14*b* is engaged with a specific needle bar connection stud 14*a*, so that a selected needle bar is vertically actuated. The presser foot is provided for each of the needle bars.

The main spindle 22 is rotated by the main spindle motor 20, and the rotating force is transmitted by way of the predetermined power transmission mechanism, whereby the respective machine elements, like the thread take-up levers 12*a*-1 to 12*a*-6, the needle bars 12*b*-1 to 12*b*-6, and the presser foots, and the shuttles 12*c* are actuated. Incidentally, the main spindle motor 20 is configured so as to rotate in one direction.

The needle thread control section 230 is for drawing a needle thread from the thread roll wound around the needle thread bobbin (not shown) and controlling tension exerted on the needle threads. The needle thread control section 230 has an upstream grip section 240, a downstream grip section 260, a turning section 280, and a needle thread supporting member 288.

Incidentally, the upstream grip section 240 is mounted at an upstream position with respect to the head 207; namely, an upstream position with respect to the turning section 280. The upstream grip section 240 has a grip section main body (an upstream grip section main body) 241 and a magnet section (an upstream drive section and an upstream magnet section) 250 provided at a back side of the grip section main body 241.

The grip section main body 241 has first plate-like sections (upstream first plate-like sections) 242-1 to 242-6 provided for the respective needle bars, a second plate-like section (an upstream second plate-like section) 244 that is provided on the back side of the first plate-like sections 242-1 to 242-6 and on the front side of the front section 314*a* of the needle bar case 314; and mounting members 246 for mounting the first plate-like sections 242-1 to 242-6 and the second plate-like section 244 to the front section 314*a* of the needle bar case 314.

Each of the first plate-like sections 242-1 to 242-6 assumes the shape of a rectangular plate and is formed from a material which is attracted by a magnet (a material to which a magnet adheres), or a magnetic substance (this can also be a ferromagnetic substance). Specifically, the first plate-like sections 242-1 to 242-6 are formed from metal attracted by a magnet; for instance, iron. All of the first plate-like sections are formed in (or approximately) a same size and a same shape. The first plate-like sections 242-1 to 242-6 are arranged side by side at intervals (specifically at uniform intervals) in the horizontal direction. Specifically, spacing exists between adjacent two first plate-like section units.

The second plate-like section 244 assumes the shape of an elongated rectangular plate. Specifically, the second plate-like section 244 is a single plate-like member disposed on the back side of the first plate-like sections 242-1 to 242-6. The second plate-like section 244 horizontally has a width equal to a distance from a left lateral side of the first plate-like section 242-1 provided at the left end when viewed from the front to a right lateral side of the first plate-like section 242-6 provided at the right end when viewed from the front. In addition, the second plate-like section 244 has a vertical width (or approximately) equal to a vertical width of each of the first plate-like sections 242-1 to 242-6. Specifically, the second plate-like section 244 is present on the back side of the respective first plate-like sections 242-1 to 242-6 and in parallel to the same. The second plate-like section 244 is formed from a material unattracted by the magnet (a material to which the magnet does not adhere); that is, a non-magnetic substance, and; for instance, aluminum and stainless steel.

A horizontally-elongated rectangular opening section (a second opening section) 316*a* is formed in an upper portion of the front section 314*a* of the needle bar case 314. The second plate-like section 244 is provided so as to cover the opening section 316*a* from the front. Specifically, the opening section 316*a* is formed in a size that is smaller than the second plate-like section 244. The vertical width of the second plate-like section 244 is larger than a leading end portion of the magnet section 250 and is formed so as to enable insertion of the leading end portion of the magnet section 250 into the opening section 316*a*.

The mounting members 246 are members for mounting the first plate-like sections 242-1 to 242-6 and the second plate-like section 244 to the needle bar case 314 and assume the shape of a pin. Each of the mounting members 246 is inserted into a first hole formed in a center (which can also be a substantial center) of an upper-side area of each of the first plate-like sections 242-1 to 242-6 and each of second holes formed in the second plate-like section 244 in correspondence to each of the first hole sections and fixed to the front section 314*a* of the needle bar case 314. Thus, the first plate-like sections 242-1 to 242-6 and the second plate-like section 244 are attached to the front section 314*a* of the needle bar case 314. Specifically, the mounting member 246 is provided for each of the first plate-like sections 242-1 to 242-6 and attached to the horizontal center (which can also be a substantial center) of an upper-side area of the first plate-like section in the horizontal direction. As above, the first plate-like sections 242-1 to 242-6 and the second plate-like section 244 are suspended by means of the respective mounting members 246 (or may hang from the mounting members). The first plate-like sections slide in the vertical direction with respect to a front surface of the second plate-like section 244, whereby spacing between the first plate-like sections and the second plate-like section 244 varies (i.e., spacing between a surface of each of the first plate-like sections facing the second plate-like section 244 and a surface of the second plate-like section 244 facing the first plate-like sections varies).

The magnet section 250 is formed from an electromagnet, and a leading end of the magnet section is formed so as to be placed in an opening section 316*b* and contact the back side of the second plate-like section 244. A surface (facing the second plate-like section 244) of the leading end of the magnet section 250 works as an attracting surface. The magnet section 250 assumes a shape of an approximately quadrangular prism (the same also holds true for a magnet section 270). The magnet sections 250 and 270 are structurally similar to an ordinary electromagnet and include a core made of a magnetic substance and a coil wound around the core. When energized, the magnet section generates magnetic force. One magnet section 250 is provided for the upstream grip section 240. The control circuit 90 activates the magnet section 250, whereupon any one of the first plate-like sections 242-1 to 242-6 corresponding to the position of the magnet section 250 is attracted by magnetic force. Spacing between the thus-attracted first plate-like section and the second plate-like section 244 is thus closed.

When the respective first plate-like sections are viewed from the front, rod-shaped guide members (first guide members) 252 are provided above the respective first plate-like sections 242-1 to 242-6, and rod-shaped guide members (first guide members) 254 are provided below the respective first plate-like sections 242-1 to 242-6. Namely, the guide members 252 and 254 are fastened to the front section 314*a* of the needle bar case 314. The guide members 252 and 254 are arranged in such a way that the needle thread J diagonally passes on the back side of each of the first plate-like sections. Each of the guide members 252 is provided at an upper left point above each of the first plate-like sections when viewed from the front. Each of the guide members 254 is provided at a lower right point below each of the first plate-like sections when viewed from the front. A longer path can thereby be assured for the needle thread J that is on the back side of each of the first plate-like sections, so that the needle thread J can be caught between the first plate-like section and the second plate-like section 244 in a more reliable manner.

The downstream grip section 260 is placed at an approximately intermediate position on the head 207 along its vertical direction; namely, a position beneath the turning section 280. The downstream grip section 260 has a grip section main body (a downstream grip section main body) 261 and the magnet section (a downstream actuation section or a downstream magnet section) 270 provided at the back side of the grip section main body 261.

The grip section main body 261 has the same structure as that of the grip section main body 241. Specifically, the grip section main body 261 has first plate-like sections (downstream first plate-like sections) 262-1 to 262-6 provided for the respective needle bars, a second plate-like section (a downstream second plate-like section) 264 that is provided on the back side of the first plate-like sections 262-1 to 262-6 and on the front side of the front section 314*a* of the needle bar case 314; and mounting members 266 for mounting the first plate-like sections 262-1 to 262-6 and the second plate-like section 264 to the front section 314*a* of the needle bar case 314.

The first plate-like sections 262-1 to 262-6 have a similar structure as that of the first plate-like sections 242-1 to 242-6. Specifically, each of the first plate-like sections 262-1 to 262-6 assumes the shape of a rectangular plate and is formed from a material that is attracted by a magnet; namely, a magnetic substance (this can also be a ferromagnetic substance). The respective first plate-like sections are formed in (or approximately) a same size and a same shape. The first plate-like sections 262-1 to 262-6 are arranged side by side at intervals (specifically at uniform intervals) in the horizontal direction. Specifically, spacing exists between adjacent two first plate-like section units. Of the first plate-like sections 242-1 to 242-6 and the first plate-like sections 262-1 to 262-6, the first plate-like sections assigned to the same needle thread are placed at the same position with reference to the horizontal direction.

The second plate-like section 264 has a similar structure as that of the second plate-like section 244. Specifically, the second plate-like section 264 horizontally has a width equal to a distance from a left lateral side of the first plate-like section 262-1 provided at the left end when viewed from the front to a right lateral side of the first plate-like section 262-6 provided at the right end when viewed from the front. In addition, the second plate-like section 264 vertically has a width (approximately) equal to a vertical width of each of the first plate-like sections 262-1 to 262-6. Specifically, the second plate-like section 264 is present on the back side of the respective first plate-like sections 262-1 to 262-6 and in parallel to the same. The second plate-like section 269 is formed from a material unattracted by the magnet; that is, a non-magnetic substance.

A horizontally-elongated rectangular opening section (a third opening section) 316*c* is formed in a substantial center of the front section 314*a* of the needle bar case 314 in its vertical direction. The second plate-like section 264 is provided so as to cover the opening section 316*c* from the front. Specifically, the opening section 316*c* is formed in a size that is smaller than the second plate-like section 264. The vertical width of the second plate-like section 264 is larger than a leading end portion of the magnet section 270 and is formed so as to enable insertion of the leading end portion of the magnet section 270 into the opening section 316*c*.

The mounting members 266 are members for mounting the first plate-like sections 262-1 to 262-6 and the second plate-like section 264 to the needle bar case 314 and have the same structure as that of the mounting members 246. The mounting members 266 are inserted into first holes that assume a pin shape and that are formed at centers (which can also be substantial centers) of upper-side areas of the respective first plate-like sections 262-1 to 262-6 and into second holes that are formed in the second plate-like section 264 and that correspond to the first hole sections, thereby being fixed to the front section 314*a* of the needle bar case 314. The first plate-like sections 262-1 to 262-6 and the second plate-like section 264 are thereby attached to the front section 314*a* of the needle bar case 314. Specifically, the mounting member 266 is provided for each of the first plate-like sections 262-1 to 262-6 and attached to the horizontal center (which can also be a substantial center) of the upper-side area of the first plate-like section along the horizontal direction. As above, the first plate-like sections 262-1 to 262-6 and the second plate-like section 264 are suspended by means of the respective mounting members 266 (or may hang from the mounting members). The first plate-like sections slide in the vertical direction with respect to a front surface of the second plate-like section 264, whereby spacing between the first plate-like sections and the second plate-like section 264 varies (i.e., spacing between a surface of each of the first plate-like sections facing the second plate-like section 264 and a surface of the second plate-like section 264 facing the first plate-like sections varies).

The magnet section 270 is formed from an electromagnet in the same manner as is the magnet 250, and a leading end of the magnet section is formed so as to be placed in the opening 316*c* and contact the back side of the second plate-like section 264. A surface (facing the second plate-like section 264) of the leading end of the magnet section 270 works as an attracting surface. One magnet section 270 is provided for the downstream grip section 260 and formed into (or approximately) the same size and the shape as those of the magnet section 250. The control circuit 90 activates the magnet section 270, whereupon any one of the first plate-like sections 262-1 to 262-6 corresponding to the position of the magnet section 270 is attracted by magnetic force. Spacing between the thus-attracted first plate-like section and the second plate-like section 264 is thus closed.

The magnet section 250 and the magnet section 270 are placed at the same position with reference to the horizontal direction. When the magnet section 250 and the magnet section 270 are activated, the magnet sections grip the same needle thread. For instance, in the example shown in FIG. 26, the magnet section 250 is situated on the back side of the first plate-like section 242-4, and the magnet section 270 is situated on the back side of the first plate-like section 262-4. Therefore, the magnet sections 250 and 270 grip the same thread.

When the respective first plate-like sections are viewed from the front, rod-shaped guide members (second guide members) 272 are provided above the respective first plate-like sections 262-1 to 262-6, and rod-shaped guide members (second guide members) 279 are provided below the respective first plate-like sections 262-1 to 262-6. Namely, the guide members 272 and 274 are fastened to the front section 314*a* of the needle bar case 314. The guide members 272 and 274 are arranged in such a way that the needle thread J diagonally passes on the back side of each of the first plate-like sections. Each of the guide members 272 is provided at an upper left point above each of the first plate-like sections when viewed from the front. Each of the guide members 274 is provided at a lower right point below each of the first plate-like sections when viewed from the front. A longer path can thereby be assured for the needle thread J that is on the back side of each of the first plate-like sections, so that the needle thread J can be caught between the first plate-like section and the second plate-like section 264 in a more reliable manner.

The turning section 280 is placed at an intermediate position between the upstream grip section 240 and the downstream grip section 260 along the vertical direction. More specifically, the turning section 280 is disposed at a downstream position in the direction in which the upstream grip section 240 feeds a needle thread and an upstream position in the direction in which the downstream grip section 260 feeds a needle thread. The turning section 280 is for turning the needle thread between the grip section main body 241 and the grip section main body 261 (or an area (a position) of the needle thread located between the grip section main body 241 and the grip section main body 261).

Figure 28:
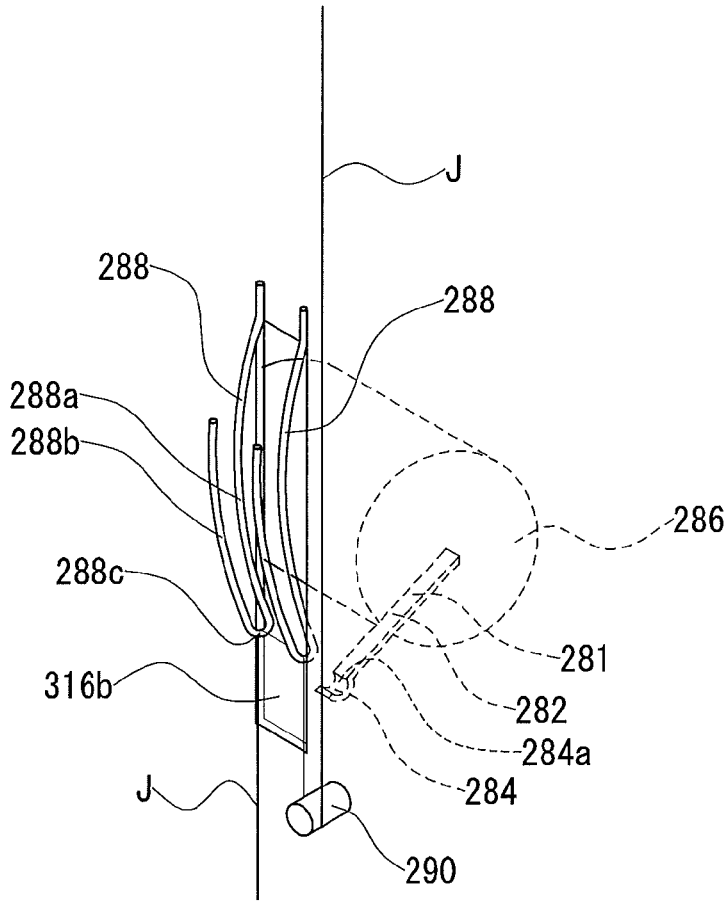
FIG. 28 It is a perspective view of a principal part showing the sewing machine of the second embodiment.
Figure 29:
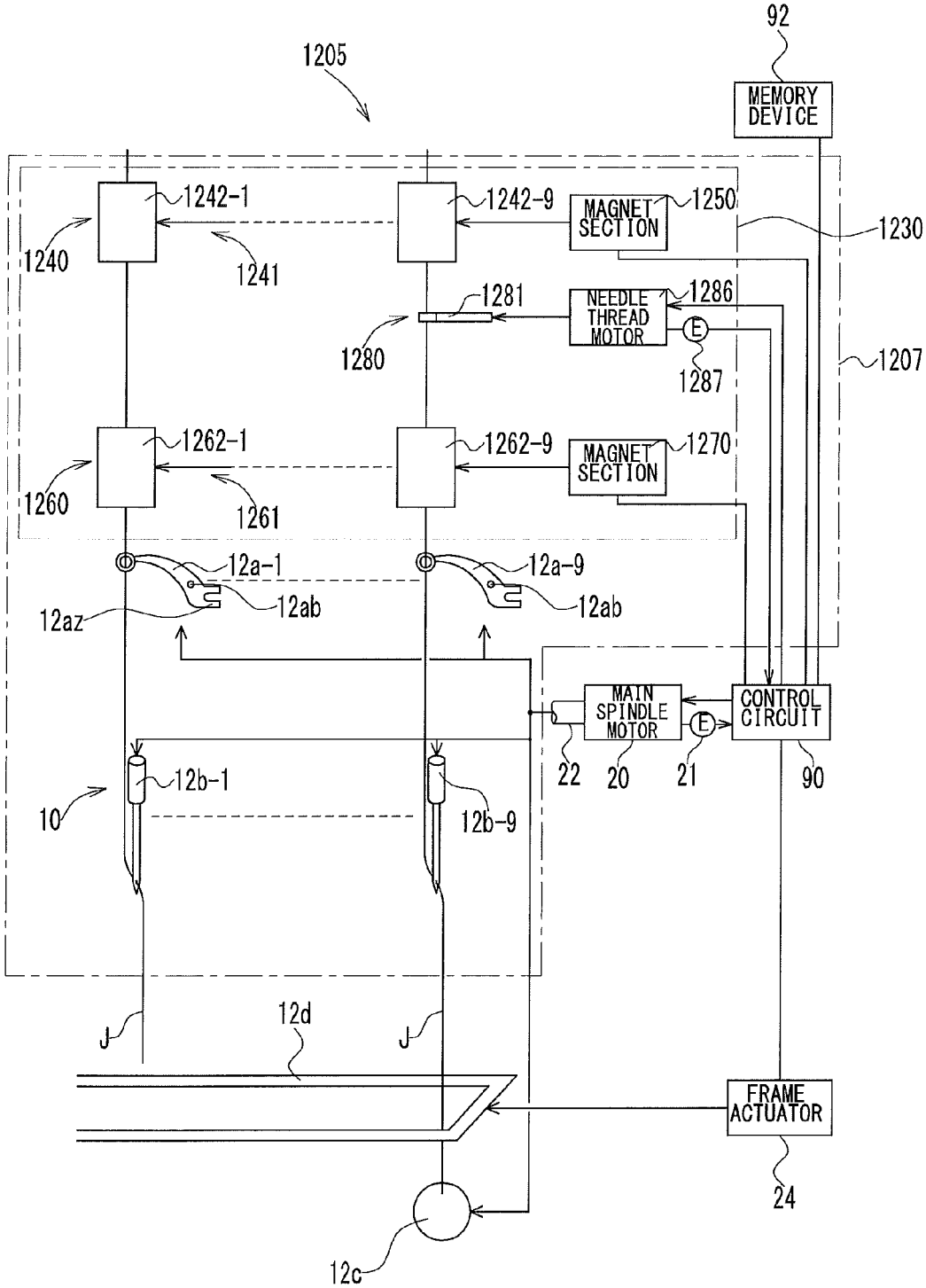
FIG. 29 It is an explanatory view showing a sewing machine of a third embodiment.
Figure 30:
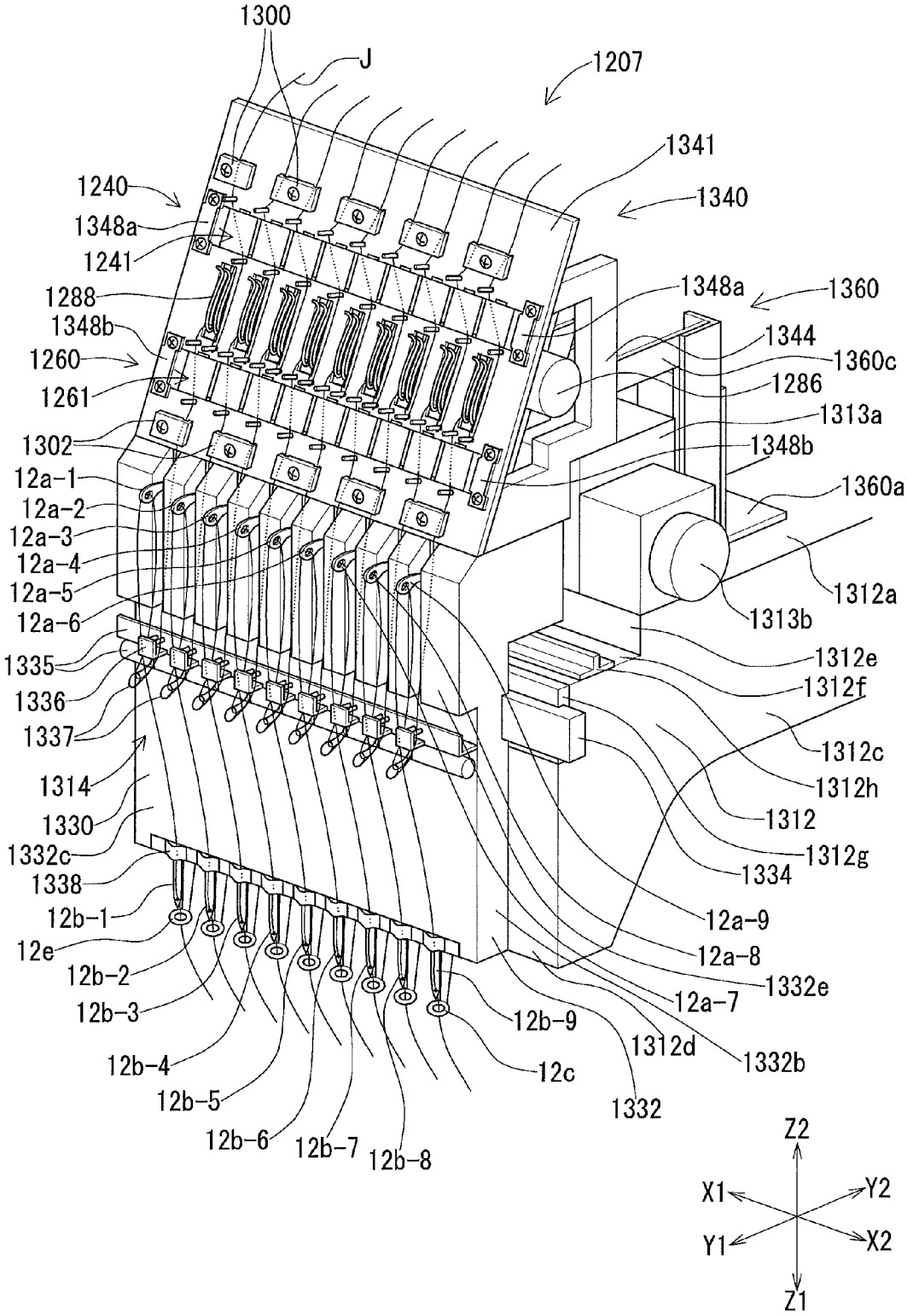
FIG. 30 It is a forward perspective view showing a head of the sewing machine of the third embodiment.
Figure 31:
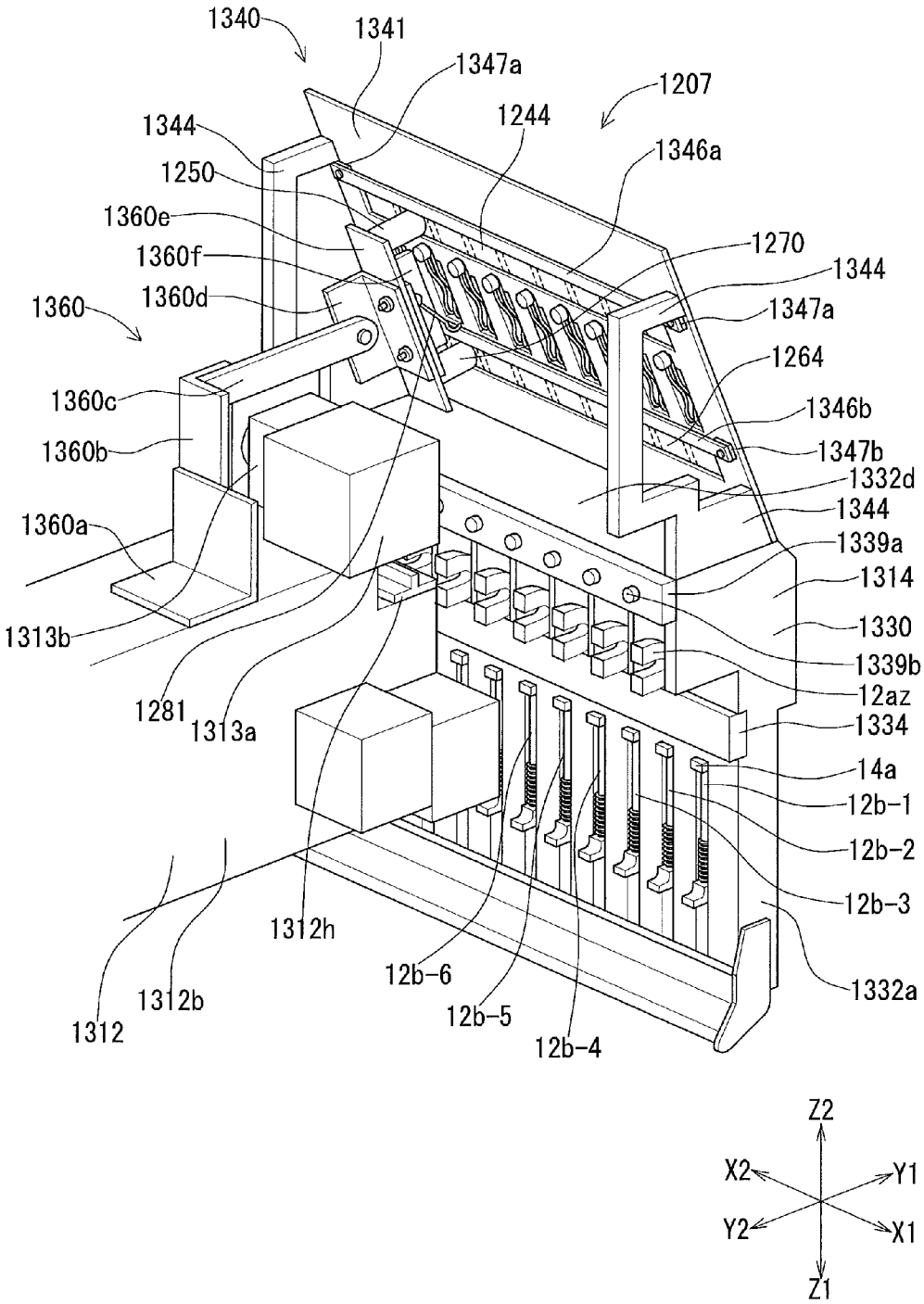
FIG. 31 It is a backward perspective view showing the head of the sewing machine of the third embodiment.

The turning section 280 has a turning arm 281 and a needle thread motor 286 for rotating the turning arm 281. As shown in FIG. 28, the turning arm 281 has a rod-shaped main body section 282 and a hook section 284 provided at one leading end of the main body section 282. An output shaft of the needle thread motor 286 is fastened to the other leading end of the main body section 282. The hook section 284 assumes approximately a form of a U-shaped plate. When the turning arm 281 is turned, the hook section 284 can retain the needle thread J. Specifically, the hook section 284 has a groove section 284*a* provided in parallel to an axis line of the output shaft of the needle thread motor 286. The hook section 284 is arranged so as to be able to contact and retain the needle thread J laid in parallel to the axis line of the output shaft of the needle thread motor 286 as a result of the turning arm 281 being upwardly turned around the output shaft (the rotating center) of the needle thread motor 286. The turning arm 281 is interposed between the magnet section 250 and the magnet section 270 and can retain a selected needle thread.

The needle thread motor 286 is secured to the arm 312 and configured as follows. When the turning arm 281 is turned upward from a receded position (a position 281(B) shown in FIG. 27) that is obliquely downward on the front, the turning arm 281 projects to the front from the opening section (a first opening section) 316*b* formed between an opening section 316*a* and the opening section 316*c* with respect to the vertical direction of the front section 314*a* of the needle bar case 314. Specifically, the opening section 316*b* is formed such that a leading end of the turning arm 281 can project to the front side (in direction Y1) of the needle bar case 314 (the front side is on the other side of the needle bar case 314 with respect to the arm 312), to thus become exposed. When situated at the receded position, the turning arm 281 is configured so as not to contact the needle bar case 314 or a member (e.g., the needle thread supporting member 288, or the like) provided in the needle bar case 314 even when the needle bar case 314 slides in its horizontal direction. The opening section 316*b* is provided in correspondence with each of the needle bars. The opening sections 316*b* are formed at positions between the first plate-like sections of the grip section main body 241 and the first plate-like sections of the grip section main body 261 corresponding to the respective first plate-like sections. The opening sections 316*b* assume a vertically-elongated rectangular shape. In the illustrated example, a total of six opening sections are provided. As mentioned above, the receded position is a position where the turning arm 281 will not contact the needle bar case 314 or any member provided on the needle bar case 314 even if the needle bar case 314 slides in its horizontal direction; at least, a position achieved as a result of the turning arm 281 having turned to a location that is lower than a position where the turning arm 281 contacts a needle thread supported by the needle thread supporting member 288 and also a position where the leading end of the turning arm 281 will not reach the opening section 316*b*.

Figure 27:
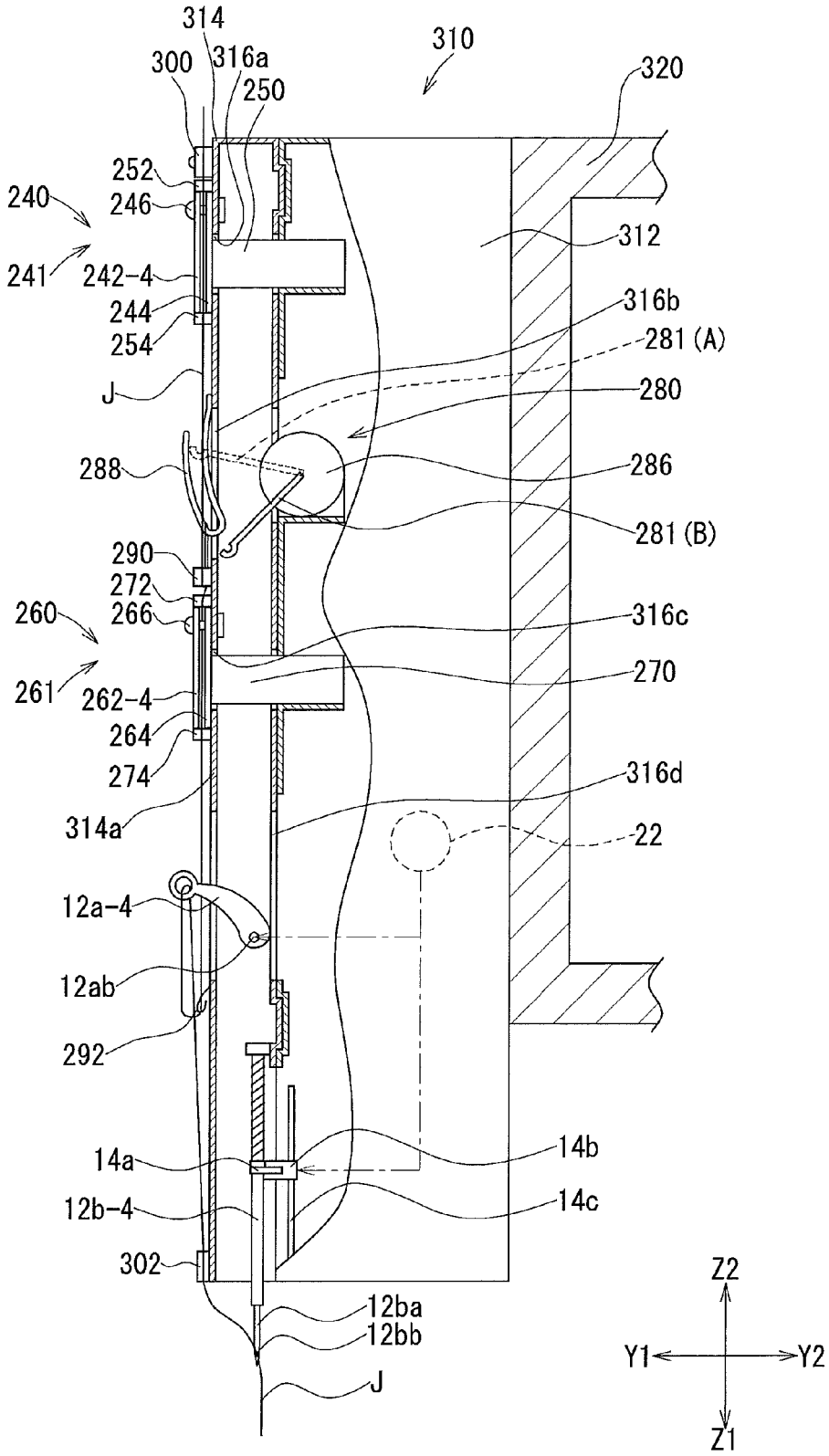
FIG. 27 It is a fragmentary right-side cross sectional view showing the sewing machine of the second embodiment.

The needle thread supporting member 288 for supporting the needle thread J in its horizontal direction is provided on either side of each of the opening sections 316*b* in the front section 314*a* of the needle bar case 314. Specifically, the pair of needle thread supporting members 288 is provided in total on both sides of each of the opening sections 316*b*. The respective needle thread supporting members 288 have the same structure and are formed by folding back a wire into a circular-arc shape. Specifically, each of the needle thread supporting members 288 assumes a shape resulting from integration of: a circular-arc member 288*a* formed (approximately) concentrically with the rotating center of the needle thread motor 286; a circular-arc member 288*b* formed approximately in parallel to the circular-arc member 288*a* on the other side of the circular-arc member 288*a* with respect to the axis line (the axis line passing through the rotating center) of the output shaft of the needle thread motor 286 and (or approximately) concentrically with the rotating center of the needle thread motor 286; and a connecting member 288*c* that is formed in a circular-arc shape and that connects a lower end of the circular-arc member 288*a* to a lower end of the circular-arc member 288*b*. Specifically, the circular-arc member 288*a* and the circular-arc member 288*b* are formed concentrically with the rotating center of the needle thread motor 286 when viewed sideways. In one needle thread supporting member 288, the circular-arc member 288*a* and the circular-arc member 288*b* are formed along a plane that forms a right angle with the axis line (the axis line passing through the rotating center) of the output shaft of the needle thread motor 286 while spaced apart from each other in a direction perpendicular to the axis line of the output shaft. The circular-arc member 288*a* and the circular-arc member 288*b* are formed at the same position with reference to the horizontal direction. Further, in relation to one needle thread supporting member 288, the pair of needle thread supporting members 288 provided for one needle thread are spaced apart from each other in the horizontal direction. A portion of the circular-arc section 288*a* and a portion of the connecting member 288*c* are placed in the opening section 316*b*, and the circular-arc section 288*b* projects to the front from a front-side surface of the front section 314*a*. The needle thread is inserted into spacing between the respective circular-arc members 288*a* and the respective circular-arc members 288*b* of the pair of needle thread supporting members 288 from above, to thus be positioned between the pair of connecting members 288*c*. As a consequence, the needle thread J can be horizontally placed between the connecting members 288*c* of the pair of needle thread supporting members 288. Even when the needle thread J is pull up by means of the turning arm 281, the needle thread J comes to lie between the circular-arc member 288*a* and the circular-arc member 288*b*. Specifically, the needle thread supporting member 288 horizontally supports the needle thread at a position of the opening section 316*b* (namely, the position of the opening 316*b* in both the vertical and horizontal directions (more specifically, at a position of a lower side of the opening section 316*b*)). More specifically, the needle thread supporting member 288 horizontally supports the needle thread on the front side of the opening section 316*b* (or "at a position on the front side of the opening section 316*b*") when viewed from the front. Alternatively, the needle thread supporting member 288 can also horizontally support the needle thread in the opening section 316*b* (i.e., a position between the front surface and the back surface of the front section 314*a* in the front-back direction). As shown in FIG. 27, lower ends of the needle thread supporting members 288 can also be configured so as to enter the needle bar case 314 from the opening 316*b*.

The rod-shaped guide member (a first needle thread path inverting member) 290 for guiding the needle thread J fed from above (in other words; from the upstream grip section 240) to the needle thread supporting member 288 is secured to a position in the vicinity of a lower side of each of the openings 316*b* and on the front section 314*a* of the needle bar case 314. The guide member 290 inverts the needle thread guided from above and subsequently guides the same to the needle thread supporting member 288.

The control circuit 90 is a circuit for controlling operation of the main spindle motor 20, operation of the needle thread motor 286, operation of the magnet section 250, and operation of the magnet section 270. According to the data stored in the memory device 92, the control circuit 90 controls operation of the individual sections. Specifically, the control circuit 90 generates main spindle data (see FIG. 7) according to embroidery data read from the memory device 92 and controls operation of the main spindle motor 20 according to the thus-generated main spindle data.

According to the embroidery data read from the memory device 92, the control circuit 90 generates needle thread control torque data (see FIG. 9). In the torque control zone, the needle thread motor 286 is subjected to torque control in accordance with the needle thread control torque data. In a position control zone, the control circuit 90 generates angle correspondence data, such as that shown in FIG. 15, and performs position control in accordance with the angle correspondence data.

In a zone ranging from the end point of the position control zone to the end point of the torque control zone, the control circuit 90 controls the magnet sections 250 and 270 so as to close the upstream grip section 240 and open the downstream grip section 260. In the meantime, in a zone ranging from the end point of the torque control zone to the end point of the position control zone, the control circuit 90 controls the magnet sections 250 and 270 so as to open the upstream grip section 240 and close the downstream grip section 260.

Specifically, as shown in FIG. 5, the control circuit 90 has the CPU 90*a*, the PWM circuit 90*b*, and the current sensor 90*c* in the same manner as in the first embodiment. The respective sections; namely, the CPU 90*a*, the PWM circuit 90*b*, and the current sensor 90*c*, are structurally same to their counterparts described in connection with the first embodiment, and hence their repeated detailed descriptions are omitted. In the second embodiment, the solenoid 50 shown in FIG. 5 is replaced by the magnet section 250, and the solenoid 70 is replaced by the magnet section 270.

The encoder 21 for detecting an angle of the main spindle motor 20 (the rotational position of the main spindle motor 20) is interposed between the main spindle motor 20 and the control circuit 90. An encoder 287 for detecting an angle of the needle thread motor 286 (a rotational position of the needle thread motor 286) is interposed between the needle thread motor 286 and the control circuit 90. The control circuit 90 detects angles of the respective motors (the rotational positions of the respective motors) from information output from the respective encoders.

The case 310 makes up an enclosure of the sewing machine 205 (more specifically the head 207). The case 310 has the arm 312 (which can also be taken as an arm section) secured to the frame 320 and the needle bar case 314 that is provided on the front side of the arm 312 and that slides in the horizontal direction with respect to the arm 312. The arm 312 is equipped with the needle bar actuation member 14*b* and the base needle bar 14*c* for actuating the needle bars 12*b*-1 to 12*b*-6, the magnet sections 250 and 270, and the needle thread motor 286. The arm 312 is formed approximately in a case form, thereby making up an enclosure of the sewing machine 205 (specifically the head 207).

The needle bar case 314 is formed approximately into the shape of a case that can slide in the horizontal direction with respect to the arm 312. The front section 314*a* has the opening section (the second opening section) 316*a* on which the magnet section 250 fronts, the plurality of opening sections (the first opening sections) 316*b* to which the respective turning arms 281 face and to each of which the pair of needle thread supporting members 288 are attached, the opening section (the third opening section) 316*c* on which the magnetic section 270 fronts, and the plurality of opening sections 316*d* through which the thread take-up levers 12*a*-1 to 12*a*-6 are exposed. The front section 314*a* is provided on the front side that is on the other side of the needle bar case 314 with respect to the arm 312. The needle bar case 314 slides in the horizontal direction (the X1-X2 direction) with respect to the arm 312 by means of an unillustrated sliding mechanism section.

The needle thread guides 300 are attached to an upper end region (a region that is higher than the guide members 252) on the front-side surface of the needle bar case 314, thereby guiding the respective needle threads in an insertable manner. In the illustrated example, the three needle thread guides 300 are provided. The needle thread guide 302 is also attached to a lower end region of the front-side surface of the needle bar case 314, thereby guiding the respective needle threads in an insertable manner.

The main spindle motor 20, the encoder 21, and the main spindle 22 can also be disposed outside the case 310 that makes up the head 207. For instance, in the case of a multi-head embroidery sewing machine equipped with a plurality of heads, a main spindle is provided in common to respective heads, and a main spindle motor for rotating the main spindle is provided.

The shuttle 12*c* is placed at a position that is beneath the head 207 and lower than the upper surface of the sewing machine table. Specifically, the shuttle 12*c* is supported by the shuttle base (not shown) disposed below the sewing machine table.

The sewing frame 12*d* is a member for holding the processed fabric in a stretched manner and placed above (or on an upper surface of) the sewing machine table.

The frame actuator 24 is for actuating the sewing frame 12*d* in both the X-axis direction (direction X1-X2) and the Y-axis direction (direction Y1-Y2) in accordance with a command from the control circuit, and actuates the sewing frame 12*d* in synchronism with vertical movements of the needle bar 12*b*. Specifically, the frame actuator 24 is made up of a servo motor for actuating the sewing frame 12*d* in the X-axis direction, a servo motor for actuating the sewing frame 12*d* in the Y-axis direction, and others.

The memory device 92 stores embroidery data used for performing embroidery. The embroidery data here mean; for instance, data that pertain to a stitch width, a stitching direction, a thread type (which one of a plurality of types of threads is used), and thread attributes (a thread material and a thread thickness) and that are provided for each stitch.

As shown in FIG. 6, in the same manner as in the first embodiment, the memory device 92 stores data pertaining to the starting point and the end point of the torque control zone as information about a main spindle angle, and also data pertaining to the starting point and the endpoint of the position control zone as information about a main spindle angle. The starting point and the end point of the torque control zone and the starting point and the end point of the position control zone are same as those described in connection with the first embodiment, and hence their detailed explanations are omitted for brevity.

An explanation is now given to the path of the needle threads J. Six needle threads run along similar paths. Therefore, the needle thread situated at the right end when viewed from the front is taken as an example. The needle thread J guided from a thread roll (not shown) contacts the guide member 252 by way of the needle thread guide 300; passes through spacing between the first plate-like section 242-6 and the second plate-like section 244 of the upstream grip section 240, then contacts the guide member 254, undergoes inversion on the guide member 290, and subsequently reaches the needle thread supporting member 288. The needle thread J passed through the pair of needle thread supporting members 288 contacts the guide member 272, passes through spacing between the first plate-like section 262-6 and the second plate-like section 264 of the downstream grip section 260, then contacts the guide member 274, arrives at the thread take-up lever 12*a*-6 by way of the tension spring 292, and reaches a sewing needle of the needle bar 12*b*-6 from the thread take-up lever 12*a*-6 by way of the needle thread guide 302. The needle thread moves from the upstream side to the downstream side along the aforementioned sequence.

Operation of the sewing machine 205 having the above structure is now described. First, operation of the needle thread motor 286 and operation of the magnet sections 250 and 270 are described.

First, the control circuit 90 generates main spindle data (see FIG. 7) for each stitch in accordance with the embroidery data stored in the memory device 92. Since the memory device 92 stores, for each stitch, information about an embroidery to be generated, like a stitch width, a stitching direction, a thread type, and thread attributes (a thread material and a thread thickness), main spindle data are generated in accordance with the pieces of information about each stitch. As shown in FIG. 7, the main spindle data are data pertaining to a main spindle angle achieved per unit time in a chronological order. For instance, when the stitch width is large, an amount of change in main spindle angle is decreased. On the contrary, when the stitch width is small, the amount of change in main spindle angle is increased. Moreover, when the stitching direction is opposite to the stitching direction employed last time, the amount of change in main spindle angle is decreased.

When the control circuit 90 generates the main spindle data, an entirety of embroidery data made up of a plurality of stitches can have been generated in advance. Alternatively, there can also be generated main spindle data pertaining to a stitch located several stitches ahead of a stitch by means of which the respective machine elements (the needle bar, the thread take-up lever, the shuttle, and the like) actually perform embroidering. Thereby, actual embroidering can also be performed while the main spindle data are being generated.

In accordance with the embroidery data stored in the memory device 92, the control circuit 90 generates for each stitch needle thread control torque data used for controlling torque of the needle thread motor 286 (see FIG. 9). Specifically, a torque value is determined for each stitch in connection with the needle thread control torque data. The torque value is determined in accordance with information provided for each stitch, like a stitch width, a stitching direction, a thread type, thread attributes, and the like. For instance, in the case of a large stitch width, fastening of the needle thread must be enhanced; therefore, the torque value is increased. When a thread has a large thickness, the fastening of the needle thread must be enhanced; therefore, the torque value is increased. On the occasion of generation of the needle thread control torque data, an entirety of embroidery data made up of a plurality of stitches can have been generated in advance. Alternatively, there can also be generated needle thread control torque data pertaining to a stitch located several stitches ahead of a stitch by means of which the respective machine elements (the needle bar, the thread take-up lever, the shuttle, and the like) actually perform embroidering. Thereby, actual embroidering can also be performed while the needle thread control torque data are being generated.

Operation performed during actual embroidering is analogous to that described in connection with the first embodiment. The sewing machine operates according to the flowcharts shown in FIG. 10 to FIG. 13 and FIG. 17. However, in the second embodiment, a plurality of needle bars are provided, and a needle bar is selected from the plurality of needle bars (i.e., a thread is selected). Accordingly, a main spindle angle is detected along the flowchart shown in FIG. 10 (S1). When the detected main spindle angle is a main spindle angle corresponding to a start of one stitch (e.g., a zero degree in FIG. 18) (in other words, when processing proceeds to the next stitch) and when a needle thread to be selected is subjected to a change, the following processing is performed between step S1 and step S2. Namely, the needle bar case 314 is slid, to thus place the magnet sections 250 and 270 at the position of the selected thread. Further, sliding operation of the needle bar case 314 is controlled so that the turning arm 281 of the turning section 280 can retain and pull up the thus-selected thread.

When the needle bar case 314 is slid with respect to the arm 312, the turning arm 281 is downwardly turned to the receded position designated by 281(B) in FIG. 27, to thus prevent the turning arm 281 from contacting the needle bar case 314 and a member provided on the needle bar case 314.

Even in the torque control subroutine pertaining to step S3 shown in FIG. 10, operation is performed along the flowchart shown in FIG. 11 in the same way as in the first embodiment. Specifically, torque data (a torque value) pertaining to a target stitch are read from the needle thread control torque data at the starting point of the torque control zone. In the torque control zone for the stitch, torque is controlled in accordance with the thus-read torque data.

Even in the position control subroutine pertaining to step S5 shown in FIG. 10, operation is performed as illustrated by the flowcharts shown in FIGS. 12 and 13 and in the same manner as in the first embodiment. Specifically, the encoder 287 detects a current position (a rotational position) of the needle thread motor 286. In the position control zone, angle correspondence data for controlling the position of the needle thread motor 286 to its initial position are generated (see FIG. 14 and FIG. 15). The needle thread motor 286 is controlled so as to return its initial position in accordance with the angle correspondence data through position control.

Even in relation to control of switching between the upstream grip section 240 and the downstream grip section 260, the grip section main body 241 of the upstream grip section 240 is opened, and the grip section main body 261 of the downstream grip section 260 is closed, as shown in FIGS. 17 and 18, in a domain of the needle thread motor 286 from the end point of the torque control zone to the end point of the position control zone as in the case of the first embodiment. In the meantime, the grip section main body 241 of the upstream grip section 240 is closed, and the grip section main body 261 of the downstream grip section 260 is opened from the end point of the position control zone to the end point of the torque control zone. When the grip section main bodies 241 and 261 are closed, the gripped needle thread is fixed. On the contrary, when the grip section main bodies 241 and 261 are opened, the needle thread is released from the gripped state.

As a result of activation of the magnet section 250, the first plate-like section corresponding to the position of the magnet section 250, among the first plate-like sections 242-1 to 242-6, is attracted by magnetic force. Spacing between the first plate-like section and the second plate-like section 244 is thereby closed, and the grip section main body 241 is also closed. Thus, there is achieved a closed state in which the needle thread J is pinched first plate-like section and the second plate-like section 244. As shown in; for instance, FIG. 26, when the magnet section 250 is situated on the back side of the first plate-like section 242-4, the magnet section 250 is activated, whereby the spacing between the first plate-like section 242-4 and the second plate-like section 244 is closed. Thus, the needle thread is gripped between the first plate-like section 242-4 and the second plate-like section 244. When the magnet section 250 is not activated, the spacing between the first plate-like section 242-4 and the second plate-like section 244 is not closed. Hence, the grip section main body 241 is opened, thereby achieving an open state in which the needle thread is released from the gripped state. As above, the magnet section 250 acting as the upstream drive section switches between the closed state in which the grip section main body 241 grips the needle thread and the open state in which the needle thread is released from the gripped state.

Likewise, as a result of activation of the magnet section 270, the first plate-like section corresponding to the position of the magnet section 270, among the first plate-like sections 262-1 to 262-6, is attracted by magnetic force. Spacing between the first plate-like section and the second plate-like section 264 is thereby closed, and the grip section main body 261 is also closed. Thus, there is achieved a closed state in which the needle thread J is pinched between the first plate-like section and the second plate-like section 264. As shown in; for instance, FIG. 26, when the magnet section 270 is situated on the back side of the first plate-like section 262-4, the magnet section 270 is activated, whereby the spacing between the first plate-like section 262-4 and the second plate-like section 264 is closed. Thus, the needle thread is gripped between the first plate-like section 262-4 and the second plate-like section 264. When the magnet section 270 is not activated, the spacing between the first plate-like section 262-4 and the second plate-like section 264 is not closed. Hence, the grip section main body 261 is opened, thereby achieving an open state in which the needle thread is released from the gripped state. As above, the magnet section 270 acting as the downstream drive section switches between the closed state in which the grip section main body 261 grips the needle thread and the open state in which the needle thread is released from the gripped state.

Specifically, an explanation is given to operation of the needle thread control section 230. At the end point of the position control zone, the turning arm 281 assumes a position of the top dead center (the initial position). Specifically, the hook section 284 of the turning arm 281 is situated at an obliquely upward position (a position designated by 281(A) shown in FIG. 27). The leading end of the turning arm 281 is exposed to the front side of the front section 314*a* from the opening section 316*b* at the initial position. When a change is made to the needle thread to be selected, the turning arm 281 is receded. Therefore, the turning arm 281 is turned to the receded position. On this occasion, the turning arm 281 is downwardly turned, thereby turning the needle thread to the receded position.

When the main spindle angle enters the torque control zone, the needle thread motor 286 is subjected to torque control while the grip section main body 241 is closed and the grip section main body 261 is opened, whereby the needle thread motor 286 imparts upward rotating force to the turning arm 281. Thereby, the thread take-up lever 12*a*-1 turns upwardly while the turning arm 281 is pulling the needle thread J against a direction (a pulling direction) in which the thread take-up lever 12*a*-1, or the like, pulls the needle thread J, thereby pulling the needle thread J with respect to the processed fabric. As the thread take-up lever 12*a*-1 pulls the needle thread J (i.e., the thread take-up lever 12*a* shifts to the top dead center (the other dead center)), the turning arm 281 turns in the direction (the downward direction) in which the thread take-up lever 12*a*-1, or the like, pulls the needle thread J.

As in the case of the first embodiment, a torque value set in the needle thread control torque data is set to a value such that, as the thread take-up lever 12*a*-1, or the like, pulls the needle thread J, the turning arm 281 turns in the direction (the downward direction) in which the thread take-up lever 12*a*-1, or the like, pulls the needle thread J and does not hinder the thread take-up lever 12*a* from pulling the needle thread J.

When entered the position control zone, the needle thread motor 286 is subjected to position control while the grip section main body 241 is opened and while the grip section main body 261 is closed, whereupon the turning arm 281 turns in a direction (an upward direction) in which the needle thread J is pulled. Reference numeral 281(A) shown in FIG. 27 shows a state where the turning arm 281 turned to its initial position as a result of the needle thread motor 286 having returned to the initial position (this can also be taken as a "position of origin") at the end point of the position control zone.

When the torque value is large, the needle thread J is hardly pulled during torque control, so that a stitch is tightly sewn. On the contrary, when the torque value is small, the needle thread J is weakly pulled, so that a corresponding stitch is softly sewn.

As above, in connection with a control zone for each stitch, in a torque control zone including at least a portion of an area from the bottom dead center to the top dead center of the thread take-up lever 12*a*-1, or the like, that is a zone during which the thread take-up lever 12*a*-1, or the like, pulls the needle thread with respect to the processed fabric to be sewn with the needle thread, there is performed torque control for imparting rotating force to the turning arm 281 in accordance with the torque value in such a way that tension is imparted to the needle thread against the direction in which the thread take-up lever 12*a*-1, or the like, pulls the needle thread, while the grip section main body 241 is closed and while the grip section main body 261 is opened, in the meantime, in a position control zone which is at least one of the zones other than the torque control zone, there is performed position control for imparting rotating force to the turning arm 281 in accordance with angular position data pertaining to the needle thread motor 286 in such a way that the angle of the needle thread motor 286 returns to its initial angular position which is a rotational position of the needle thread motor 286, while the grip section main body 241 is opened and while the grip section main body 261 is closed, thereby drawing the needle thread from upstream.

Control of the main spindle motor 20 is same to that described in connection with the first embodiment. Although the main spindle motor 20 operates along the flowcharts shown in FIGS. 21 and 22, a plurality of needle bars are provided in the second embodiment, and a needle bar is selected from the plurality of needle bars (i.e., a thread is selected). On the occasion of a main spindle angle being read from the main spindle data in step S51 of the flowchart shown in FIG. 21, when the detected main spindle angle is a main spindle angle corresponding to the start of one stitch (e.g., zero degree in FIG. 18) and when a needle thread to be selected is subjected to a change, there is performed the following process between steps S51 and S52, namely, processing for sliding the needle bar case 314, to thereby place the magnet sections 250 and 270 at the position of the thus-selected thread, and controlling sliding operation of the needle bar case 314 so as to come to the position of the opening section 316*b* corresponding to the thread so that the turning arm 281 of the turning section 280 can retain and pull up the thus-selected thread.

Control of the main spindle motor 20 is same to that described in connection with the first embodiment except that control of sliding operation of the needle bar case 314 is provided and, therefore, its detailed explanations are omitted.

As mentioned above in the sewing machine of the second embodiment, the needle thread is subjected to torque control in the torque control zone as mentioned above. Accordingly, the magnitude of tension on the needle thread can be controlled. In particular, torque control can be performed on a per-stitch basis in the torque control zone by means of the needle thread control torque data (FIG. 9). Hence, tension on the needle thread can be controlled on a per-stitch basis, so that seam hardness can be controlled on a per-stitch basis.

In the case of the multi-needle head, even when a stitch is formed from a different needle thread, a torque value in the needle thread control torque data is made constant, whereby tension on the needle thread can be equally controlled. In the case of a multi-head embroidery sewing machine, the needle thread control torque data used for a torque control zone are made common to the heads, whereby tension on the needle threads exerted by the respective heads can be made equal.

Figure 47:
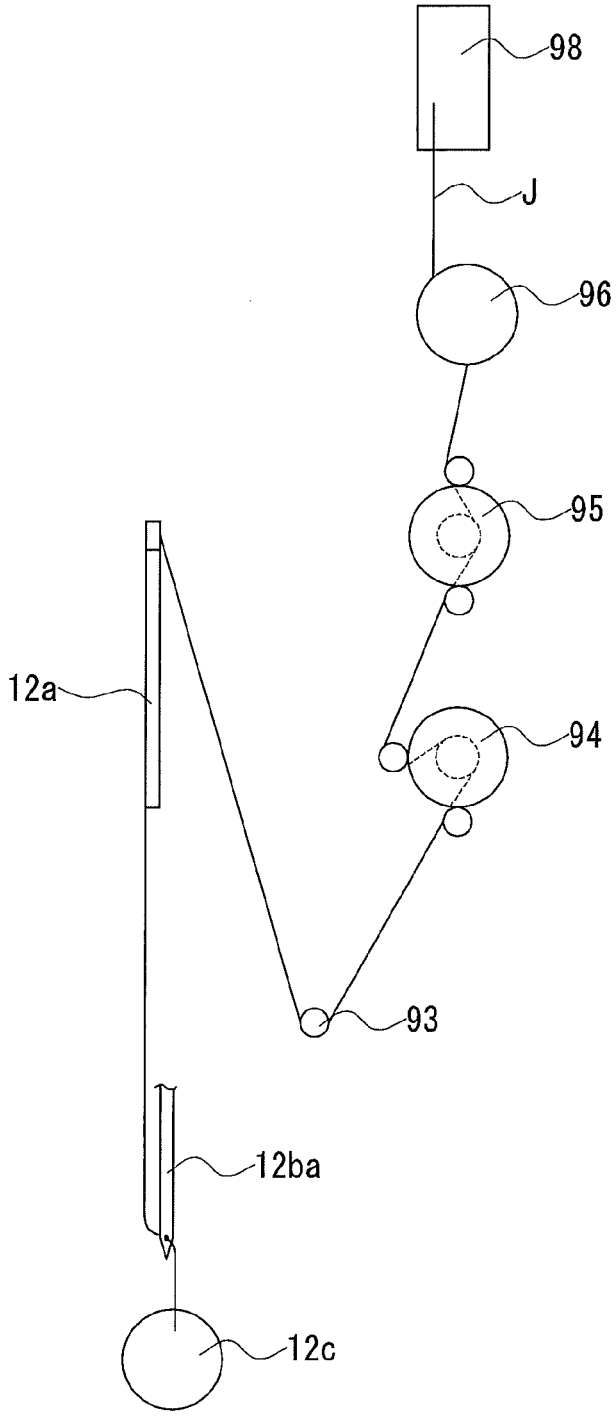
FIG. 47 It is an explanatory view showing a related-art sewing machine.

Further, the needle thread control section 230 is provided in place of the tension disc and the rotary tension component in the related-art sewing machine (see FIG. 47). In the position control zone where the needle thread J is drawn, the grip section main body 241 becomes open, and only the needle thread guide 300 is present at an upstream position with respect to the turning arm 281 of the turning section 280. Frictional resistance does not exist between the tension disc and the rotary tension component. Further, the grip section main body 261 becomes closed. Hence, movements of the thread take-up lever 12*a* will not pose any problems at the time of drawing of the needle thread. Consequently, the needle thread can be smoothly drawn from the thread roll, thereby reducing the risk of occurrence of a thread break.

If a break has occurred in a needle thread, the turning arm 281 will not turn downwardly in the torque control zone. Specifically, the turning arm 281 will not be pulled in the downward direction opposite to the direction in which the rotating force of the needle thread motor 286 is imparted. A thread break can be detected by detecting that the turning arm 281 does not turn downwardly. Further, when there are not any thread breaks, the turning arm 281 downwardly turns in the torque control zone. Hence, occurrence of a thread break can be detected accurately.

In the position control zone, the current position (angle) of the needle thread motor 286 is detected. There are generated angle correspondence data for controlling the position of the needle thread motor 286 to its initial angle. There is performed control for returning the needle thread motor 286 to its initial position in accordance with the angle correspondence data through position control. The needle thread can therefore be drawn by only the amount corresponding to a quantity of thread consumed as a result of the turning arm 281 being pulled in the torque control zone. Hence, an excess or deficiency of the quantity of accumulated thread, which would otherwise be caused by drawing a needle thread, will not occur.

When the structure including the upstream grip section 240, the downstream grip section 260, and the turning section 280 is applied to the multi-needle head, the sewing machine can be configured by providing only one each of the magnet section 250 of the upstream grip section 240, the magnet section 270 of the downstream grip section 260, and the turning section 280. Accordingly, the sewing machine can be provided with an efficient structure while its manufacturing cost is curtailed.

Third Embodiment

A sewing machine of a third embodiment is now described. A sewing machine 1205 of the third embodiment is an embroidery sewing machine and configured as shown in FIG. 29 to FIG. 36. The sewing machine includes a head (an embroidering head) 1207, the shuttle 12*c*, the sewing frame 12*d*, the main spindle motor 20, the main spindle 22, the frame actuator 24, the control circuit 90, and the memory device 92. The sewing machine 1205 is a multi-needle sewing machine; specifically, a nine-needle embroidery sewing machine capable of coping with nine types of needle threads.

Figure 32:
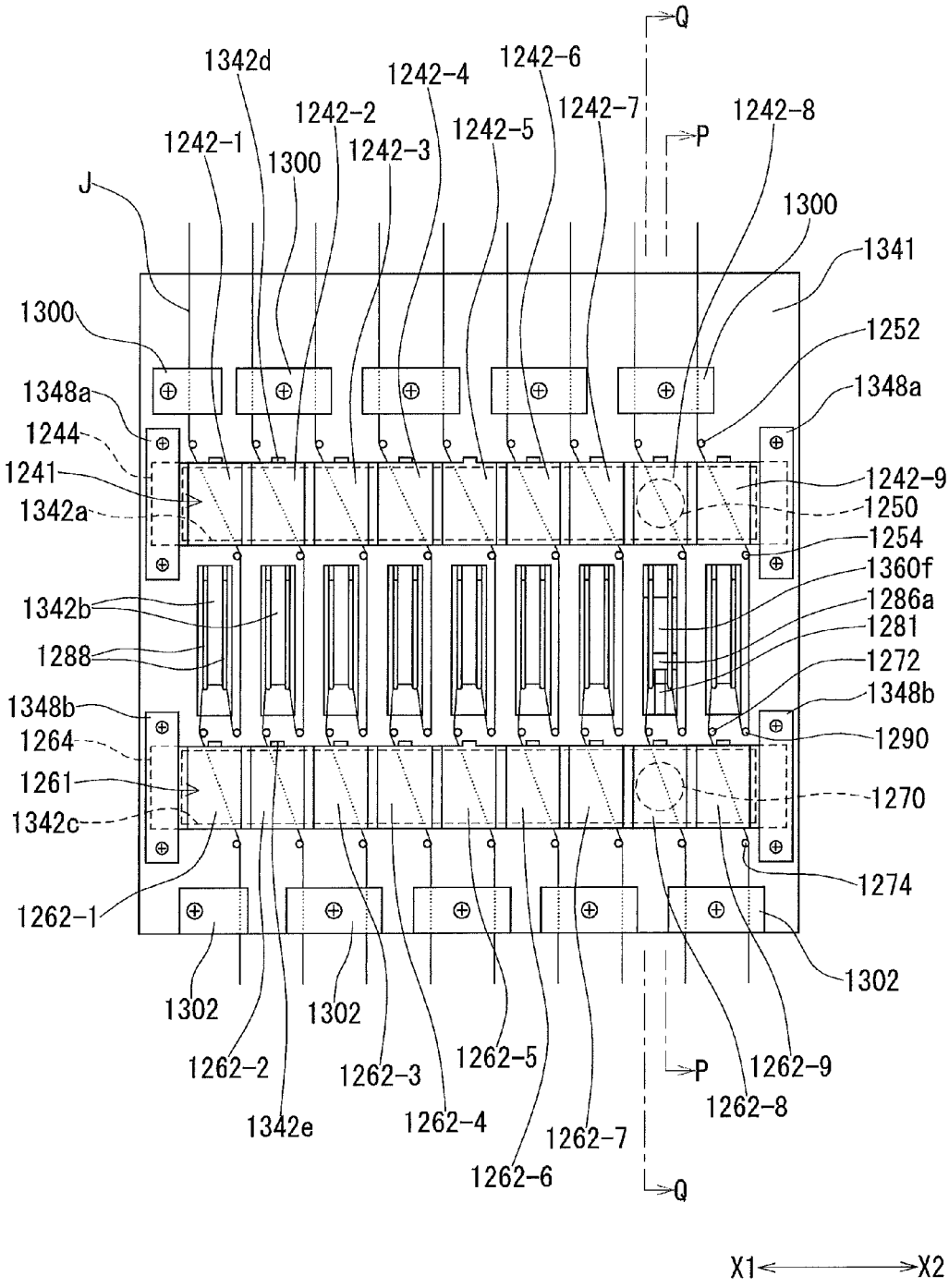
FIG. 32 It is a front view showing a principal part of the head of the sewing machine of the third embodiment.
Figure 33:
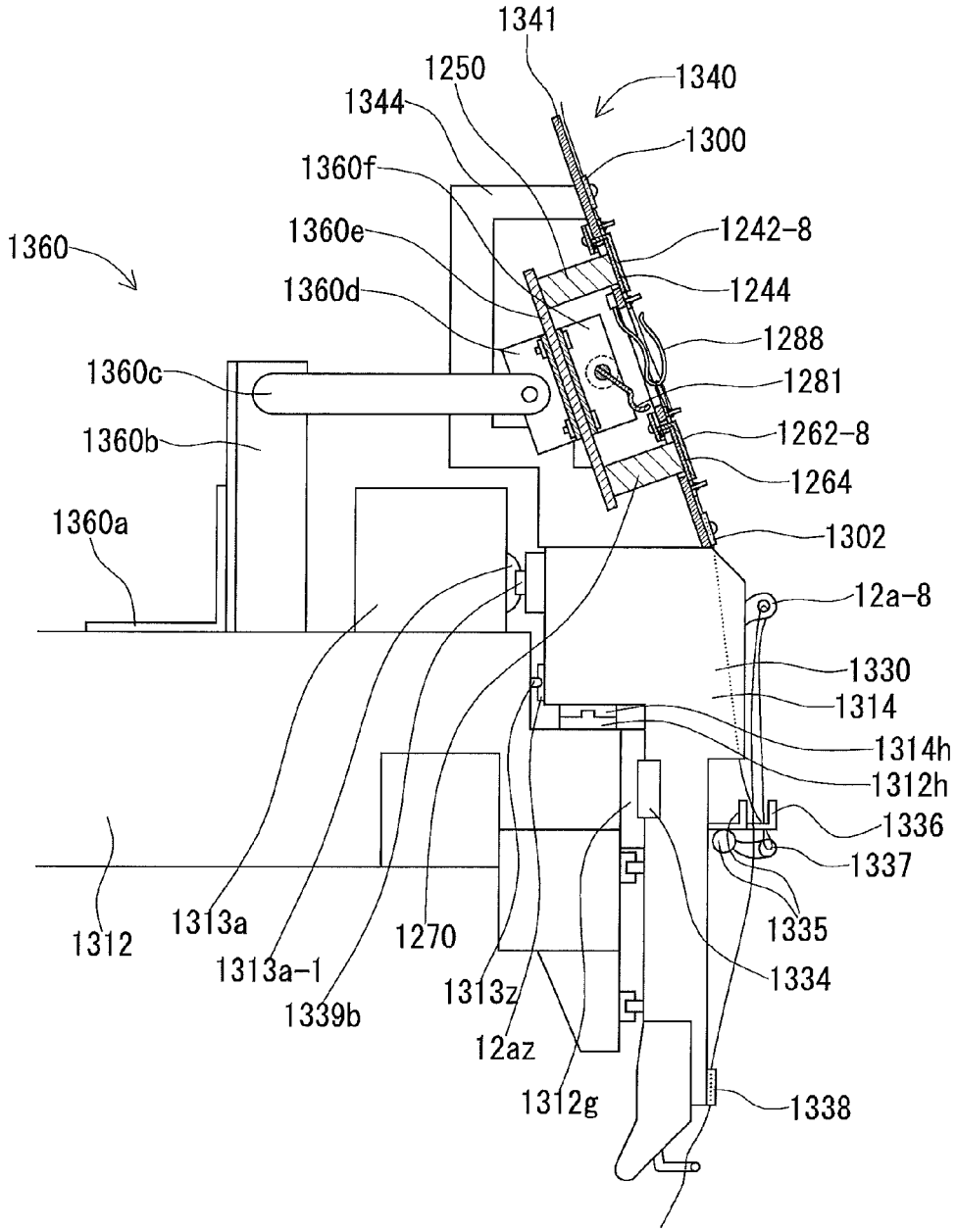
FIG. 33 It is a fragmentary left-side cross sectional view showing the head of the sewing machine of the third embodiment.
Figure 34:
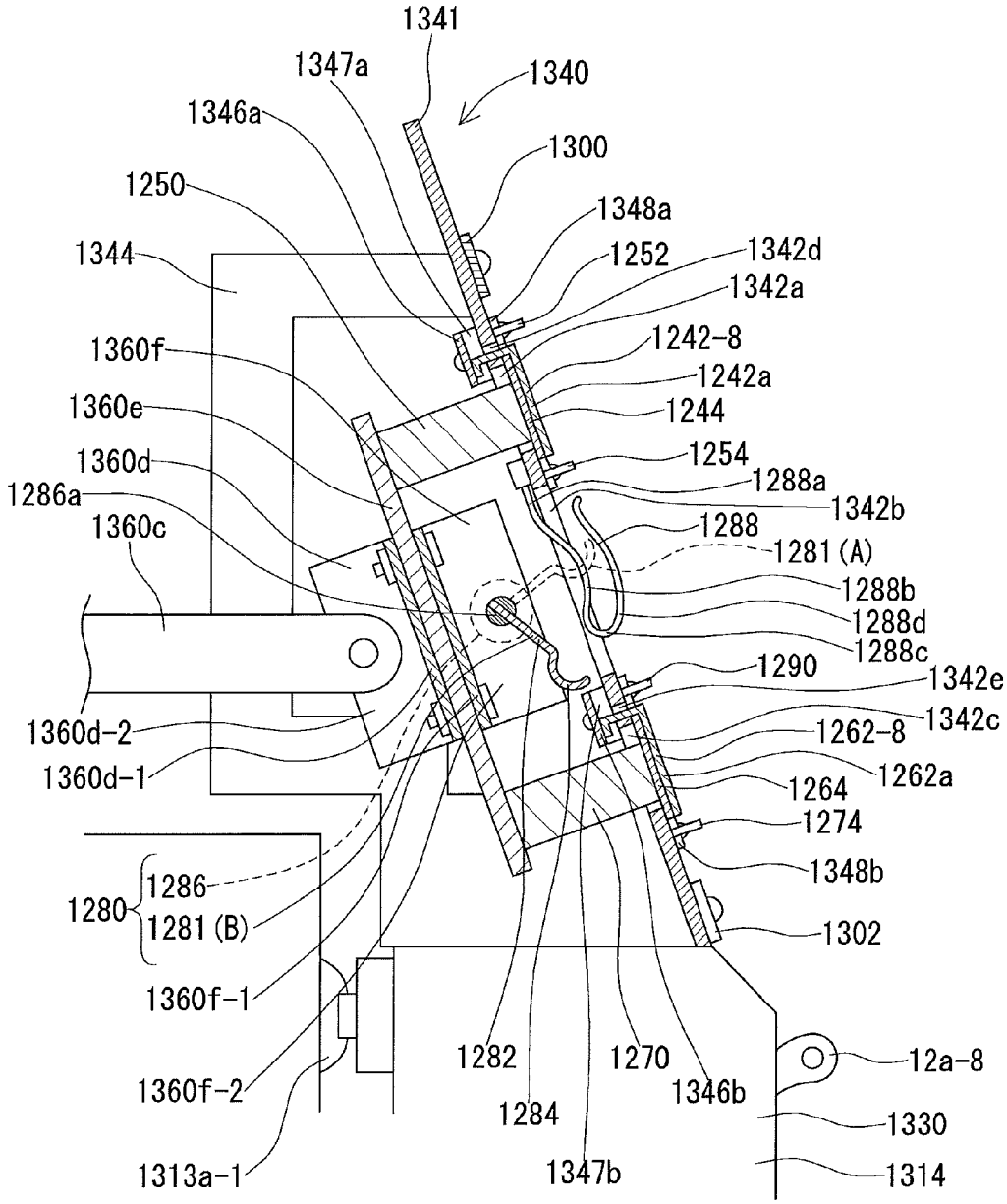
FIG. 34 It is an enlarged view of the principal part shown in FIG. 32.
Figure 35:
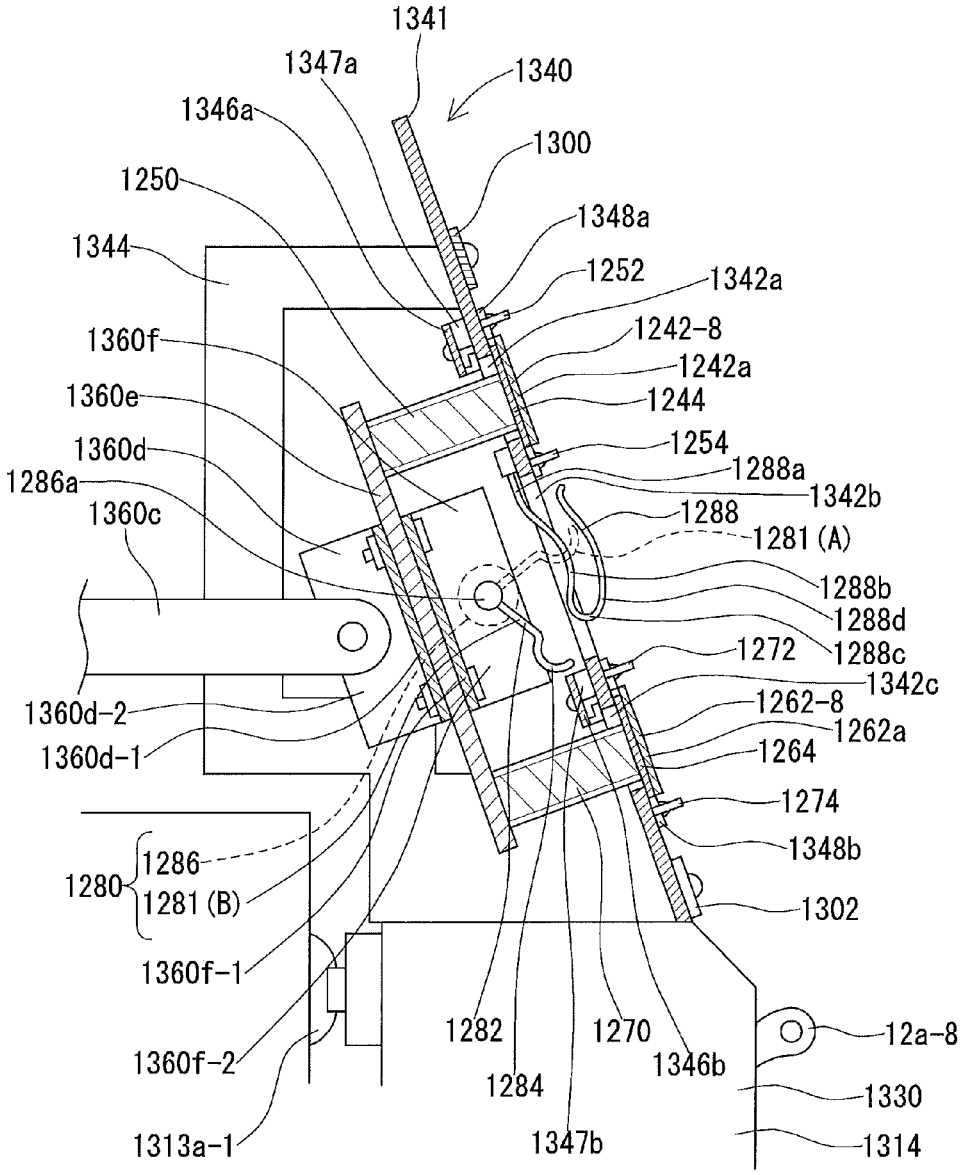
FIG. 35 It is a fragmentary left-side cross sectional view showing the head of the sewing machine of the third embodiment.

FIG. 33 and FIG. 34 are fragmentary left-side cross sectional views acquired when only a needle thread control mounting section 1340 and a needle thread control section 1230 are fractured at position P-P shown in FIG. 32. FIG. 35 is a fragmentary left-side cross sectional view acquired when only the needle thread control mounting section 1340 and the needle thread control section 1230 are fractured at position Q-Q shown in FIG. 32. FIG. 33, FIG. 34, and FIG. 35 show the sections while the needle thread is omitted.

Like the heads 7 and 207, the head 1207 is disposed at an elevated position above an approximately-plate-like sewing machine table (not shown). Specifically, a frame (a frame having the same structure as that of the frame 320 (see FIG. 27)) is disposed upright on the upper surface of the sewing machine table. The head 1207 is provided on the front side of the frame.

The head 1207 is structured as shown in FIG. 29 to FIG. 36 and has the machine element group 10, the main spindle motor 20, the main spindle 22, the needle thread control section 1230, the control circuit 90, and a case 1310.

The case 1310 makes up an enclosure of the sewing machine 1205 (specifically, the head 1207). The case 1310 has an arm 1312 (this may also be taken as an "arm section") secured to the frame and a needle bar case 1314 that slides in a horizontal direction with respect to the arm 1312 provided on a front side (Y1 side) of the arm 1312.

The arm 1312 is formed approximately into a shape of a case extended in its front-back direction, making up an enclosure of the sewing machine 1205 (specifically the head 1207). The arm 1312 has a shape enclosed by a square-shaped upper surface section 1312*a*; side surface sections 1312*b* and 1312*c* that continually extend from both lateral ends of the upper surface section 1312*a* in the downward direction and a front-side upper end of each of which has a square cutout; front surface section 1312*d* continually extending from front-side ends of the respective side surface sections 1312*b* and 1312*c* except their upper ends; front surface sections 1312*e* continually extending from the front-side ends in upper end areas of the respective side surface sections 1312*b* and 1312*c*; and upper surface section 1312*f* formed between lower ends of the respective front surface section 1312*e* and upper ends of the respective front surface section 1312*d*. A back-side end of the arm 1312 is connected to the frame.

A rail supporting section 1312*g* is provided on a front side of the arm 1312, and a rail section 1334 provided on a back side of a needle bar case main body 1330 slidably fits on the rail supporting section 1312*g*.

A rail 1312*h* having a shape of an approximately inverted letter T is disposed on the upper surface section 1312*f*. The needle bar case main body 1330 is equipped with a sliding member 1314*h* that slides over the rail 1312*h*.

Power transmission means, such as a cam mechanism or a belt mechanism, for transmitting rotating force of the main spindle 22 to respective machine elements is provided in the arm 1312.

A motor 1313*b* for letting the needle bar case 1314 slide and a clutch housing section 1313*a* are provided on an upper surface of the arm 1312. The clutch housing section 1313*a* is provided with a clutch 1313*a*-1 that is rotated by the motor 1313*b*. The clutch 1313*a*-1 has a helical groove. The helical groove of the clutch 1313*a*-1 is engaged with a cylindrical clutch engagement section 1339*b* provided on a back side of the needle bar case main body 1330. As a result of the clutch 1313*a*-1 being rotated, the needle bar case 1314 slides in the horizontal direction.

The needle bar case 1314 is formed approximately into a shape of a case that can slide in the horizontal direction with respect to the arm 1312. The needle bar case 1314 has the needle bar case main body (a needle bar housing case) 1330 and the needle thread control mounting section 1340.

The needle bar case main body 1330 is structured as shown in FIGS. 30, 31, 33, 34, and 35. The needle bar case main body 1330 has an enclosure section 1332; the rail section 1334 formed on a back side of the enclosure section 1332 along the horizontal direction; and supporting sections 1335, guide members 1336, tension springs (generally called "high tension springs") 1337, and needle thread guides 1338 that are all provided on a front side of the enclosure section 1332.

The enclosure section 1332 assumes a shape of a case that is formed in a vertically-elongated manner when viewed sideways. The enclosure section 1332 has a side surface section 1332*a* that is vertically long when viewed sideways and that has an upper end area protruding to the front and back sides; a side surface section 1332*b* formed symmetrical to the side section 1332*a*; a square-shaped front section 1332*c* interposed between a lower area of the side surface section 1332*a* and a lower area of the side surface section 1332*b*; an upper surface section 1332*d* that is interposed on the level between an upper end of the side surface section 1332*a* and an upper end of the side surface section 1332*b* in the horizontal direction; and a projecting section 1332*e* that is interposed between the front section 1332*c* and the upper surface section 1332*d* and that projects to the front rather than the front section 1332*c*. In relation to the projecting section 1332*e*, a plurality of projecting sections 1332*e* are spaced apart from each other. Opening sections (not shown) used for letting the thread take-up levers 12*a*-1 to 12*a*-9 project to the front are provided among the adjacent projecting sections 1332*e*.

The rail section 1334 is laid on the back side of the enclosure section 1332; assumes a square-rod-shaped cross section; and is formed along the horizontal direction. The rail section 1334 is supported so as to be slidable in the horizontal direction by the rail supporting section 1312*g* secured to the arm 1312. The rail supporting section 1312*g* and the rail section 1334 make up a linear way.

A plurality of cylindrical clutch engagement sections 1339*b* are provided along the horizontal direction, while spaced apart from each other, at an upper end on the back side of the enclosure section 1332 of the needle bar case main body 1330 by way of a horizontally-laid rod-shaped section 1339*a*. As a result of rotation of the motor 1313*b*, the clutch 1313*a*-1 rotates, whereupon the needle bar case 1314 slides in the horizontal direction.

The supporting sections 1335 are mounted on the level (or approximately on the level) to an upper area of a front side of the front section 1332*c* of the enclosure section 1332 along the horizontal direction. The guide members 1336 are provided at intervals for respective thread take-up levers on the supporting sections 1335 and assume the shape of an approximately-L-shaped plate. The tension springs 1337 are provided at intervals for the respective thread take-up levers and attached to the supporting sections 1335 beneath the respective guide members 1336. The tension springs 1337 are provided for guiding the needle threads J fed from above (namely, fed from the downstream grip section 1260) to the respective thread take-up levers while preventing occurrence of a flexure or looseness of the needle thread J. The tension springs 1337 invert the respective needle threads J guided from above and subsequently lead the respective needle threads J to the respective thread take-up levers while exerting tension on the respective needle threads J. The needle thread guides 1338 are provided at a lower end on the front side of the front section 1332*c* along the horizontal direction.

The needle thread control mounting section 1340 is mounted on an upper surface of the needle bar case main body 1330 (particularly the enclosure section 1332). The needle thread control mounting section 1340 has a plate-like plate section 1341; plate section supporting sections 1344 that support the plate section 1341 in an upright position; guide members 1252, 1254, 1272, 1274, and 1290 attached to the plate section 1341; and needle thread guides 1300 and 1302, guide plates 1346*a* and 1346*b*, rest sections 1347*a* and 1347*b*, and presser plates 1348*a* and 1348*b*.

The plate section 1341 assumes a shape of a (or approximately) rectangular plate. Formed in the plate section 1341 are an opening section (a second opening section) 1342*a* on which a magnet section 1250 fronts, a plurality of (nine in the illustrated example) opening sections (first opening sections) 1342*b* on which a turning arm 1281 fronts and that each are used for mounting a pair of needle thread supporting members 1288; and an opening section (a third opening section) 1342*c* on which a magnet section 1270 fronts. The plate section 1341 is formed in the horizontal direction, and upper and lower sides of the plate section 1341 are oriented along the horizontal direction.

The opening section 1342*a* is formed into a horizontally elongated rectangular shape above the opening sections 1342*b*. A vertical width of the opening section 1342*a* is larger than a leading end portion of the magnet section 1250, to thus make it possible to insert the leading end portion of the magnet section 1250 into the opening section 1342*a*. Likewise, the opening section 1342*c* is formed into a horizontally elongated rectangular shape below the opening sections 1342*b*. A vertical width of the opening section 1342*c* is larger than a leading end portion of the magnet section 1270, to thus make it possible to insert the leading end portion of the magnet section 1270 into the opening section 1342*c*.

The opening sections 1342*b* are provided in correspondence with the respective needle bars. The opening sections 1342*b* are formed at a position between a first plate-like section unit in a grip section main body 1241 and a first plate-like section unit in a grip section main body 1261 corresponding to the counterpart first plate-like section unit (i.e., a position between the a first plate-like section 1242*a* and a first plate-like section 1262*a* corresponding to the first plate-like section 1242*a*). Specifically, the opening sections 1342*b* assume a vertically-long rectangular shape. In the illustrated example, a total number of nine opening sections 1342*b* are provided. The opening sections 1342*b* are placed along the horizontal direction at spacing (specifically regular intervals). The opening sections 1342*b* are formed so that a leading end of the turning arm 1281 can project to the front side (Y1 side) of the plate section 1341 (the front side is on the other side of the plate section 1341 with respect to the arm 1312) in an exposed manner.

The plate section supporting section 1344 is provided at each of horizontal ends on the back side of the plate section 1341, assuming an approximately-C-shaped frame. Each of the plate section supporting sections 1344 is attached to an upper surface of the enclosure section 1332. The plate section 1341 is attached to the front side of the enclosure section 1332 and supported by the enclosure section 1332. The plate section 1341 is attached in such a way that a front-side surface of the plate section 1341 faces in an oblique upward direction.

The guide members 1252, 1254, 1272, 1274, and 1290 are provided vertically to a front-side surface of the plate section

1341 upright on the front-side surface of the plate section 1341. The guide member 1252 and the guide member 1254 are provided for each of first plate-like section units 1242-1 to 1242-9. The guide members 1252 are disposed at intervals along an upper side of the opening section 1342*a*. The guide members 1254 are disposed at intervals along a lower side of the opening section 1342*a*. The guide members 1272, the guide members 1274, and the guide members 1290 are provided for each of first plate-like section units 1262-1 to 1262-9. The guide members 1272 are disposed at intervals along an upper side of the opening section 1342*c*. The guide members 1274 are disposed at intervals along a lower side of the opening section 1342*c*. The guide members (the first needle thread path inverting members) 1290 are disposed at intervals along an upper side surface of the opening section 1342*c* while spaced apart from the respective guide members 1272.

FIG. 46 shows a conceivable method for attaching the guide members 1252, 1254, 1272, 1274, and 1290 and the guide members 252, 254, 272, 274, and 290.

Specifically, all the guide members 1252, 1254, 1272, 1274, and 1290 assume a similar configuration. Hence, an explanation is now provided by means of taking the guide member 1252 as an example. Each of the guide members 1252 has an approximately cylindrical main body section ga-1 and a screw section (a base end section) ga-2 projecting from a base end of the main body section ga-1. A thread groove is formed in an outer periphery of the screw section ga-2.

Specifically, the main body section ga-1 has a cylindrical outer peripheral surface and a hemispherical leading end. The screw section ga-2 assumes an approximately cylindrical shape, and a thread groove is formed in the cylindrical peripheral surface. A radius (diameter) of the screw section ga-2 is smaller than a radius (diameter) of the main body section ga-2.

In an example shown in FIG. 46(*a*), screw holes 1343*a* to be screw-engaged with the respective screw sections ga-2 are formed in the plate section 1341. The screw sections ga-2 are attached to the respective screw holes 1343*a*, whereby base end faces of the respective main body sections ga-1 contact the surface of the plate section 1341.

In the example shown in FIG. 46(*b*), indentations 1343*b* used for inserting the base end sections (i.e., ends facing the screw sections ga-2) of the respective main body sections ga-1 and the screw holes (hole sections) 1343*a* continually extending from the respective indentations 1343*b* are formed in the plate section 1341. Hole sections that completely pass through the plate section 1341 from the front side to the back side of the plate section 1341 are formed from the respective indentations 1343*b* and the respective screw holes 1343*a*. The screw sections ga-2 are attached to the respective screw holes 1343*a*, whereby the base end sections of the respective main body sections ga-1 are inserted into the respective indentations 1343*b*. Specifically, the base end sections of the main body section ga-1 are embedded in the plate section 1341. Although the screw holes 1343*a* pass through to the back side of the plate section 1341, the screw holes can also be formed into indented hole sections that do not completely pass through to the back side of the plate section 1341.

The configuration shown in FIG. 46(*b*) makes it possible to prevent a chance of the needle thread entering spacing between the base end of each of the main body sections ga-1 and the surface of the plate section 1341. Specifically, in the configuration 46(*a*), the base end face of each of the main body sections ga-1 contacts a front-side face of the plate section 1341. Hence, there is a risk of the needle thread entering spacing between the base end face of each of the main body sections ga-1 and a front-side surface of the plate section 1341 and being caught by the spacing. However, the method shown in FIG. 46(*b*) makes it possible to avoid the risk.

Although a method illustrated in FIG. 46(*c*) is approximately identical with the method illustrated in FIG. 46(*b*) the method shown in FIG. 46(*c*) is directed toward an example in which the screw section ga-2 projects from the screw hole 1343*b* and in which a nut ga-3 is attached to the screw section ga-2. Even in the case of the method illustrated in FIG. 46(*c*), the base end portion of the main body section ga-1 is inserted and embedded in the indentation 1343*b*. Hence, a risk of the needle thread entering spacing between the base end of each of the main body sections ga-1 and the surface of the plate section 1341 can be avoided.

The needle thread guides 1300 are disposed in an upper region on the front side of the plate section 1341 (a region above the guide members 1252), thereby guiding the respective needle threads in an insertable manner. In the illustrated example, the five needle thread guides 1300 are provided.

The needle thread guides 1302 are disposed in a lower region on the front side of the plate section 1341 (a region beneath the guide members 1274), thereby guiding the respective needle threads in an insertable manner. In the illustrated example, the five needle thread guides 1302 are provided.

The guide plate 1346*a* assumes the shape of an elongated rectangular plate and disposed in the horizontal direction on the back side of the plate section 1341 and along an upper side on a back surface of the opening section 1342*a*. The guide plate 1346*a* is placed on the back side of a retaining section 1242*b* for the first plate-like section units 1242-1 to 1242-9, preventing droppage of the first plate-like section units 1242-1 to 1242-9 from the plate section 1341. The rest section 1347*a* is provided at each of right and left lateral ends of the back side of the plate section 1341 while interposed between the guide plate 1346*a* and the back side of the plate section 1341, thereby forming spacing between the guide plate 1346*a* and the plate section 1341. Thus, the rest section 1347*a* makes it possible for the first plate-like section units 1242-1 to 1242-9 to make sliding actions in the front-back direction with no difficulty.

The guide plate 1346*b* assumes the shape of an elongated rectangular plate and disposed in the horizontal direction on the back side of the plate section 1341 and along an upper side on a back surface of the opening section 1342*c*. The guide plate 1346*b* is placed on the back side of a retaining section 1262*b* for the first plate-like section units 1262-1 to 1262-9, preventing droppage of the first plate-like section units 1262-1 to 1262-9 from the plate section 1341. The rest section 1347*b* is provided at each of right and left lateral ends of the back side of the plate section 1341 while interposed between the guide plate 1346*b* and the back side of the plate section 1341, thereby forming spacing between the guide plate 1346*b* and the plate section 1341. Thus, the rest section 1347*b* makes it possible for the first plate-like section units 1262-1 to 1262-9 to make sliding actions in the front-back direction with no difficulty.

The presser plates 1348*a* are provided on both sides of the opening section 1342*a* on the front surface of the plate section 1341. Right and left lateral side ends of a second plate-like section 1244 are sandwiched between the presser plates 1348*a* and the plate section 1341. The presser plates 1348*b* are provided on both sides of the opening section 1342*c* on the front surface of the plate section 1341. Right and left lateral side ends of a second plate-like section 1264 are sandwiched between the presser plates 1348*b* and the plate section 1341.

The machine element group 10 is comprised of machine elements to be actuated in the head 1207. As with the first and second embodiments, the machine elements include the plurality of thread take-up levers, the plurality of needle bars, and the presser feet. However, in the third embodiment, the head is equipped with nine thread take-up levers 12*a*-1 to 12*a*-9, nine needle bars 12*b*-1 to 12*b*-9, and nine presser feet 12*e*. The thread take-up levers 12*a*-1 to 12*a*-9, the needle bars 12*b*-1 to 12*b*-9, and the shuttle 12*c* are actuated by means of transmitting rotating force of the main spindle 22 by way of the power transmission means, like a cam mechanism or a belt mechanism, as in the case of the related-art sewing machine. Incidentally, the number of thread take-up levers, needle bars, and presser feet can also be any number other than nine (e.g., 12).

The thread take-up levers 12*a*-1 to 12*a*-9 are provided in the enclosure section 1332 of the needle bar case main body 1330 of the case 1310 and are formed so as to be able to sway around an axis line (the rotating center) in the horizontal direction (the direction X1-X2) and turn between the bottom dead center (one dead center) and the top dead center (the other dead center). Specifically, the thread take-up levers 12*a*-1 to 12*a*-9 are axially supported by the needle bar case main body 1330 so as to sway around the rotating center (this can also be taken as a "swaying center") 12*ab*. Needle threads to be inserted into the respective sewing needles are inserted into the respective thread take-up levers 12*a*-1 to 12*a*-9. Power is transmitted to only a selected, specific thread take-up lever as a result of the needle bar case 1314 sliding in the horizontal direction with respect to the arm 1312, whereupon the specific thread take-up lever is swayed. In other words, base ends 12*az* (see FIG. 31) of the respective thread take-up levers 12*a*-1 to 12*a*-9 are engaged with engagement members 1313*z* of the arm 1312. The thread take-up levers are then swayed as a result of the engagement members 1313*z* turning around a turning center. Leading ends of the respective thread take-up levers 12*a*-1 to 12*a*-9 project to the front (in direction Y1), in an exposed manner, from the respective opening sections provided between the adjacent projecting sections 1332*e* on the front side of the enclosure section 1332.

The needle bars 12*b*-1 to 12*b*-9 are provided in the enclosure section 1332 so as to be movable in the vertical direction. Sewing needles (sewing needles having the same structure as those of the sewing needles 12*ba* described in connection with the second embodiment, and needle threads are inserted into pin holes of the respective sewing needles) are fixedly provided at lower ends of the respective needle bars. The needle bar connecting stud 14*a* is fixedly provided at the upper end of each of the needle bars 12*b*. Further, a needle bar actuation member (a needle bar actuation member having the same structure as that of the needle bar actuation member 14*b* described in connection with the second embodiment) is engaged with each of the needle bar connecting studs 14*a*. Abase needle bar (a base needle bar having the same structure as that of the base needle bar 14*c* described in connection with the second embodiment) provided in the vertical direction is inserted into each of the needle bar actuation members. The needle bar actuation members are formed so as to be movable in the vertical direction along the respective base needle bars. Rotating force of the main spindle 22 is transmitted by the power transmission means, whereupon the needle bar actuation members are vertically actuated. The needle bars are thereby moved in the vertical direction. The needle bar case 314 slides in the horizontal direction with respect to the arm 1312, whereby the needle bar actuation member is engaged with a specific needle bar connection stud 14*a*, so that a selected needle bar is vertically actuated. The presser foot 12*e* is provided for each of the needle bars.

The needle thread control section 1230 is for drawing a needle thread from the thread roll (not shown) wound around the needle thread bobbin and controlling tension exerted on the needle threads. The needle thread control section 1230 has an upstream grip section 1240, the downstream grip section 1260, a turning section 1280 (see FIG. 29, FIG. 34, and FIG. 35), and a supporting section (a magnet section and a motor supporting member) 1360.

Incidentally, the upstream grip section 1240 is placed at an upper area of the plate section 1341; namely, an area above the turning sections 1280. The upstream grip section 1240 has the grip section main body (an upstream grip section main body) 1241 and the magnet section (an upstream drive section and an upstream magnet section) 1250 provided on a back side of the grip section main body 1241.

The grip section main body 1241 has the first plate-like section units 1242-1 to 1242-9 provided for the respective needle bars and the second plate-like section (an upstream second plate-like section) 1244 that is provided on the back side of the first plate-like section 1242*a* in the first plate-like section units 1242-1 to 1242-9 and on the front side of the needle bar case 1314 (specifically the plate section 1341).

Figure 36:
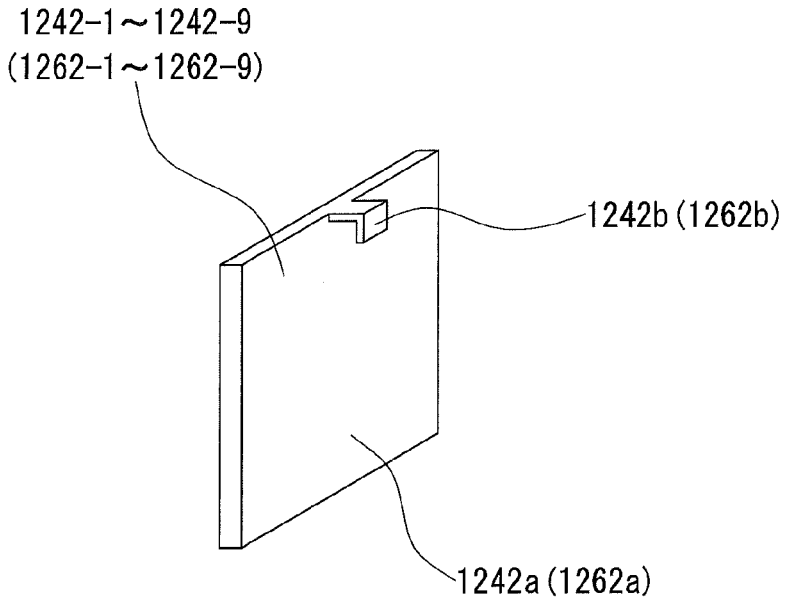
FIG. 36 It is a backward perspective view of a first plate-like member.

As shown in FIG. 36, each of the first plate-like section units 1242-1 to 1242-9 includes the first plate-like section (an upstream first plate-like section) 1242*a* assuming the shape of a square-shaped plate and the retaining section (a mounting member) 1242*b* formed so as to project from an upper end of the first plate-like section 1242*a* to the back. The retaining section 1242*b* assumes the shape of an approximately-L-shaped plate (a shape made by bending a rectangular plate approximately into the letter L). The first plate-like section unit is integrally formed from a material which is attracted by a magnet (a material to which a magnet adheres); that is, a magnetic substance (or a ferromagnetic substance instead). Specifically, each of the first plate-like section units 1242-1 to 1242-9 is formed from metal attracted by a magnet, like iron. The first plate-like section units are formed in (or approximately) a same size and a same shape. As a result of the retaining sections 1242*b* being engaged with retaining holes 1342*d* formed in the plate section 1341, the first plate-like section units 1242-1 to 1242-9 are arranged at spacing (specifically uniform intervals) side by side along the horizontal direction. Spacing exists between two adjacent first plate-like section units. The plurality of (specifically, a total of nine) retaining holes 1342*d* are arranged at spacings (specifically uniform intervals) side by side along the horizontal direction and at an area on the plate section 1341 above the opening section 1342*a*. The first plate-like sections are suspended by means of the plate section 1341 (or may also hang from the plate section) as a result of the retaining sections 1242*b* being engaged with the respective retaining holes 1342*d*. The first plate-like section 1242*a* slides in the vertical direction with respect to the front surface of the second plate-like section 1244, whereby spacing between the first plate-like section 1242*a* and the second plate-like section 1244 varies.

The second plate-like section 1244 is a single plate-like member that is provided at the back side of the first plate-like sections 1242*a* of the respective first plate-like section units 1242-1 to 1242-9 and that assumes the shape of an elongated rectangle. Specifically, the second plate-like section 1244 is formed so as to become, in the horizontal direction, longer than a distance from a left lateral side of the first plate-like section 1242*a* of the first plate-like section unit 1242-1 provided at a left end to a right lateral side of the first plate-like section 1242*a* of the first plate-like section unit 1242-9 provided at a right end when viewed from the front. In addition, the second plate-like section 1244 is formed so as to have, in the vertical direction, (approximately) the same width as a vertical width of each of the first plate-like sections 1242*a* of the first plate-like section units 1242-1 to 1242-9. The left end of the second plate-like section 1244 when viewed from the front is situated more left than the left lateral side of the first plate-like section 1242*a* of the first plate-like section unit 1242-1 and fixed to the plate section 1341 by means of the presser plate 1348*a*. The right end of the second plate-like section 1244 when viewed from the front is situated more right than the right lateral side of the first plate-like section 1242*a* of the first plate-like section unit 1242-9 and fixed to the plate section 1341 by means of the presser plate 1348*a*. Specifically, the second plate-like section 1244 is present on the back of each of the respective first plate-like section units 1242-1 to 1242-9 and in parallel with the respective first plate-like sections of the respective first plate-like section units 1242-1 to 1242-9. The second plate-like section 1244 is formed from a substance unattracted by the magnet (a material to which the magnet does not adhere); that is, a non-magnetic substance, for instance, a film made from a synthetic resin. The second plate-like section 1244 can also be made from aluminum or stainless steel.

The second plate-like section 1244 is made larger than the opening section 1342*a* and provided so as to cover the opening section 1342*a* from the front.

The magnet section 1250 is formed from an electromagnet, and a leading end of the magnet section is formed so as to be placed in the opening section 1342*a* and contact the back side of the second plate-like section 1244. A surface (facing the second plate-like section 1244) of the leading end of the magnet section 1250 works as an attracting surface. The magnet section 1250 assumes a shape of an approximately cylindrical shape (the same also holds true for the magnet section 1270). FIG. 33 to FIG. 35, FIG. 38, FIG. 39, FIG. 42, and FIG. 44 depict the magnet sections 1250 and 1270 while their detailed cross-sectional profiles are omitted. The magnet sections 1250 and 1270 are structurally similar to an ordinary electromagnet and include a core made of a magnetic substance and a coil wound around the core. When energized, the coil generates magnetic force. One magnet section 1250 is provided for the upstream grip section 1240. The control circuit 90 activates the magnet section 1250, whereupon the first plate-like section 1242*a* of any one of the first plate-like section units 1242-1 to 1242-9 corresponding to the position of the magnet section 1250 is attracted by the magnetic force. Spacing between the first plate-like section 1242*a* and the second plate-like section 1244 is thus closed. The magnet section 1250 is attached to an upper end of a front surface of a plate-like section 1360*e* in the supporting section 1360 in a direction perpendicular to a back side of the plate section 1341. Specifically, the magnet section 1250 is secured in the direction of the arm 1312.

When the respective first plate-like sections 1242*a* of the first plate-like section units 1242-1 to 1242-9 are viewed from the front, the guide members (first guide members) 1252 are provided above the respective first plate-like section units 1242-1 to 1242-9, and the guide members (first guide members) 1254 are provided below the respective first plate-like section units 1242-1 to 1242-9. As shown in FIG. 32, the guide members 1252 and 1254 are arranged in such a way that the needle thread J diagonally passes on the back side of each of the first plate-like sections. Each of the guide members 1252 is provided at an upper left point above each of the first plate-like sections when viewed from the front. Each of the guide members 1254 is provided at a lower right point below each of the first plate-like sections when viewed from the front. A longer path can be assured for the needle thread J that is at the back side of each of the first plate-like sections, so that the needle thread J can be caught between the first plate-like sections and the second plate-like section 1244 in a more reliable manner.

The downstream grip section 1260 is placed on a lower area of the plate section 1341; namely, an area below the turning section 1280. The downstream grip section 1260 has the grip section main body (a downstream grip section main body) 1261 and the magnet section (a downstream actuation section or a downstream magnet section) 1270 provided at the back side of the grip section main body 1261.

The grip section main body 1261 has the same structure as that of the grip section main body 1241. The grip section main body 1261 has the first plate-like section units 1262-1 to 1262-9 provided for the respective needle bars and the second plate-like section (a downstream second plate-like section) 1264 that is provided at the back side of the first plate-like sections 1262*a* of the respective first plate-like section units 1262-1 to 1262-9 and on the front side of the needle bar case 1314 (specifically, the plate section 1341).

The first plate-like section units 1262-1 to 1262-9 are structurally similar to the first plate-like section units 1242-1 to 1242-9. As shown in FIG. 36, each of the first plate-like sections 1262*a* of the first plate-like section units 1262-1 to 1262-9 includes the first plate-like section (a downstream first plate-like section) 1262*a* assuming the shape of a square-shaped plate and a retaining section (a mounting member) 1262*b* formed so as to project from an upper end of the first plate-like section 1262*a* to the back. The retaining section 1262*b* assumes the shape of an approximately-L-shaped plate. Specifically, each of the first plate-like section units 1262-1 to 1262-9 is formed from a material which is attracted by the magnet (a material to which the magnet adheres); that is, a magnetic substance (or a ferromagnetic substance instead). The respective first plate-like section units are formed in (or approximately) a same size and a same shape. As a result of the retaining sections 1262*b* being engaged with retaining holes 1342*e* formed in the plate section 1341, the first plate-like section units 1262-1 to 1262-9 are arranged at spacing (specifically uniform intervals) side by side along the horizontal direction. Specifically, spacing exists between two adjacent first plate-like section units. The plurality of (specifically, a total of nine) retaining holes 1342*e* are arranged at spacings (specifically uniform intervals) side by side along the horizontal direction and at an area on the plate section 1341 above the opening section 1342*c* (and below the opening section 1342*b*). The first plate-like sections are suspended by means of the plate section 1341 (or may hang from the plate section) as a result of the retaining sections 1262*b* being engaged with the respective retaining holes 1342*e*. The first plate-like section 1262*a* slides in the vertical direction with respect to the front surface of the second plate-like section 1264, whereby spacing between the first plate-like section 1262*a* and the second plate-like section 1264 varies. In relation to the first plate-like section units 1242-1 to 1242-9 and the first plate-like section units 1262-1 to 1262-9, the first plate-like section units assigned to the same needle thread are placed at the same position with reference to the horizontal direction.

The second plate-like section 1264 is structurally similar to the second plate-like section 1244. The second plate-like section 1264 is a single plate-like member that is provided on the back side of the first plate-like sections 1262*a* of the respective first plate-like section units 1262-1 to 1262-9. Specifically, the second plate-like section 1264 is formed so as to become, in the horizontal direction, longer than a distance from a left lateral side of the first plate-like section 1262*a* of the first plate-like section unit 1262-1 provided at a left end to a right lateral side of the first plate-like section 1262*a* of the first plate-like section unit 1262-9 provided at a right end when viewed from the front. In addition, the second plate-like section 1264 is formed so as to have, in the vertical direction, (or approximately) the same width as a vertical width of each of the first plate-like sections 1262*a* of the first plate-like section units 1262-1 to 1262-9. The left end of the second plate-like section 1264 when viewed from the front is situated more left than the left lateral side of the first plate-like section 1262*a* of the first plate-like section unit 1262-1 and fixed to the plate section 1341 by means of the presser plate 1348*b*. The right end of the second plate-like section 1264 when viewed from the front is situated more right than the right lateral side of the first plate-like section 1262*a* of the first plate-like section unit 1262-9 and fixed to the plate section 1341 by means of the presser plate 1348*b*. Specifically, the second plate-like section 1264 is present at a back side of each of the first plate-like sections of the respective first plate-like section units 1262-1 to 1262-9 and in parallel with the respective first plate-like sections of the respective first plate-like section units 1262-1 to 1262-9. The second plate-like section 1264 is formed from a material unattracted by the magnet (a material to which the magnet does not adhere); that is, a non-magnetic substance.

The second plate-like section 1264 is made larger than the opening section 1342*c* and provided so as to cover the opening section 1342*c* from the front.

Like the magnet section 1250, the magnet section 1270 is formed from an electromagnet, and a leading end of the magnet section is formed so as to be placed in the opening section 1342*c* and contact the back side of the second plate-like section 1264. A surface (facing the second plate-like section 1264) of the leading end of the magnet section 1270 works as an attracting surface. One magnet section 1270 is provided for the downstream grip section 1260 and formed in (or approximately) the same size and the same shape as that of the magnet section 1250. The control circuit 90 activates the magnet section 1270, whereupon the first plate-like section 1262*a* of any one of the first plate-like section units 1262-1 to 1262-9 corresponding to the position of the magnet section 1270 is attracted by the magnetic force. Spacing between the first plate-like section 1262*a* and the second plate-like section 1264 is thus closed. The magnet section 1270 is attached to a lower end of a front surface of the plate-like section 1360*e* in the supporting section 1360 in a direction perpendicular to a back side of the plate section 1341, thereby being secured in the direction of the arm 1312.

The magnet section 1250 and the magnet section 1270 are placed at the same position with reference to the horizontal direction. When the magnet section 1250 and the magnet section 1270 are activated, the magnet sections grip the same needle thread. For instance, in the example shown in FIG. 30, FIG. 31, FIG. 33, FIG. 34, and FIG. 35, the magnet section 1250 is situated at the back side of the first plate-like section of the first plate-like section unit 1242-8, and the magnet section 1270 is situated at the back side of the first plate-like section of the first plate-like section unit 1262-8. Therefore, the magnet sections 1250 and 1270 grip the same thread.

When the respective first plate-like sections 1262*a* of the first plate-like section units 1262-1 to 1262-9 are viewed from the front, the guide members (second guide members) 1272 are provided above the respective first plate-like section units 1262-1 to 1262-9, and the guide members (second guide members) 1274 are provided below the respective first plate-like section units 1262-1 to 1262-9. As shown in FIG. 32, the guide members 1272 and 1274 are arranged in such a way that the needle thread J diagonally passes at the back side of each of the first plate-like sections. Each of the guide members 1272 is provided at an upper left point above each of the first plate-like sections when viewed from the front. Each of the guide members 1274 is provided at a lower right point below each of the first plate-like sections when viewed from the front. A longer path can be assured for the needle thread J that is at the back side of each of the first plate-like sections, so that the needle thread J can be caught between the first plate-like sections and the second plate-like section 1264 in a more reliable manner.

The turning section 1280 is placed at an intermediate position between the upstream grip section 1240 and the downstream grip section 1260 along the vertical direction. More specifically, the turning section 1280 is disposed at a downstream position in the direction in which the upstream grip section 1240 feeds a needle thread and an upstream position in the direction in which the downstream grip section 1260 feeds a needle thread. The turning section 1280 is for turning the needle thread between the grip section main body 1241 and the grip section main body 1261 (or an area (a position) of the needle thread located between the grip section main body 1241 and the grip section main body 1261).

The turning section 1280 has the turning arm 1281 and a needle thread motor 1286 for rotating the turning arm 1281. As shown in FIG. 31, FIG. 33, FIG. 34, and FIG. 35, the turning arm 1281 has a rod-shaped main body section 1282 and a hook section 1289 provided at one leading end of the main body section 1282. An output shaft 1286*a* of the needle thread motor 1286 is fastened to the other leading end of the main body section 1282. Specifically, when viewed sideways, the output shaft is arranged in such a way that the center axis of the output shaft 1286*a* of the needle thread motor 1286 passes through the center axis of the main body section 1282. The hook section 1284 assumes a (or approximately) circular-arc rod shape and is arranged so as to enable the hook section 1284 to hook the needle thread J as a result of turning of the turning arm 1281. Specifically, the hook section 1284 is structured so as to be able to contact and retain the needle thread J laid in parallel to the axis line of the output shaft 1286*a* of the needle thread motor 1286 as a result of the turning arm 1281 being upwardly turned around the output shaft 1286*a* (more specifically, an axis line (a rotating center) of the output shaft 1826*a*) of the needle thread motor 1286. The turning arm 1281 is interposed between the magnet section 1250 and the magnet section 1270 and at the same position where the magnet sections 1250 and 1270 are placed with reference to the horizontal direction; and can retain a selected needle thread.

The needle thread motor 1286 is secured to L-shaped hardware 1360*f*, thereby being secured in the direction of the arm 1312. When the needle thread motor 1286 rotates, the turning arm 1281 is turned upward from the receded position (a position 1281(B) shown in FIG. 34 and FIG. 35) that is obliquely downward on the front, to thus project to the front from the opening section 1342*b* of the plate section 1341. A direction of the output shaft 1286*a* of the needle thread motor 1286 (a direction of an axis line of the output shaft 1286*a*) lies in a horizontal direction (namely, a direction parallel with the back surface of the plate section 1341 and along the horizontal direction). The needle thread motor is configured in such a way that, when the turning arm 1281 is situated at the receded position, the turning arm 1281 will not contact the plate section 1341 or any member provided on the plate section 1341 (e.g., the needle thread supporting member 1288, the guide member 1346*b*, or the like) even if the needle bar case 1314 slides in the horizontal direction. Specifically, the receded position is a position where the turning arm 1281 will not contact the needle bar case 1314 (in particular, the plate section 1341 and any member provided on the plate section 1341) even if the needle bar case 1314 slides in the horizontal direction; at least, a position achieved as a result of the turning arm 281 having turned lower than a position where the turning arm 1281 contacts the needle thread supported by the needle thread supporting member 1288 and also a position where the leading end of the turning arm 1281 will not reach the opening section 1342*b*.

The needle thread supporting members 1288 are placed on both sides of each of the opening sections 1342*b* of the plate section 1341 so as to front on both interior sides of the opening section. Specifically, each of the needle thread supporting members 1288 is made by folding back a wire into a circular-arc shape. The pair of needle thread supporting members 1288 assume the same structure.

Each of the needle thread supporting members 1288 includes a base end section 1288*a*; a circular-arc member 1288*b* formed so as to extend continually from a lower end of the base end section 1288*a*; a connecting member 1288*c* formed so as to extend continually from an end of the circular-arc member 1288*b* that is on its other side with respect to the base end section 1288*a*; and a circular-arc member 1288*d* formed so as to extend continually from an end of the connecting member 1288*c* that is on its other side with respect to the circular-arc member 1288*b*. The needle thread supporting member 1288 is formed integrally from a wire.

The base end section 1288*a* is formed into a vertically-oriented straight line. An upper end of the base end section 1288*a* is attached to a position above the opening section 1342*b* on the back side of the plate section 1341. The circular-arc member 1288*b* is formed (or approximately) concentrically with the rotating center of the needle thread motor 1286 so as to face the opening section 1342*b*. The circular-arc member 1288*b* except its portion is provided in the opening section 1342*b*. The connecting member 1288*c* is formed into an approximately circular-arc shape. A front-side end of the connecting member 1288*c* projects to the front side with reference to the front surface of the plate section 1341. A remaining portion of the connecting member 1288*c* is provided in the opening section 1342*b*. The circular-arc member 1288*d* is formed on a side of the circular-arc member 1288*b* that is on its other side with respect to the axis line (an axis line passing through the rotating center) of the output shaft of the needle thread motor 1286, approximately in parallel with the circular-arc member 1288*b*, and (approximately) concentrically with the rotating center of the needle thread motor 1286. An upper end of the circular-arc member 1288*d* is curved to the front. The circular-arc section 1288*d* projects to the front with reference to the front surface of the plate section 1341. When viewed sideways, the circular-arc member 1288*b* and the circular-arc member 1288*d* are formed concentrically with the rotating center of the needle thread motor 1286. In one of the needle thread supporting members 1288, the circular-arc member 1288*b* and the circular-arc member 1288*d* are formed along a plane perpendicular to an axis line of the output shaft of the needle thread motor 1286 (i.e., an axis line passing through the rotating center) while spaced apart from each other in a direction perpendicular to the axis line of the output shaft. In one needle thread supporting member 1288, the circular-arc member 1288*b* and the circular-arc member 1288*d* are formed at the same position with reference to the horizontal direction. Further, the pair of needle thread supporting members 1288 provided for one needle thread are provided while spaced apart from each other in the horizontal direction. The connecting member 1288*c* connects a lower end of the circular-arc member 1288*b* and a lower end of the circular-arc member 1288*d*.

A needle thread is inserted into spacing between the circular-arc member 1288*b* and the circular-arc member 1288*d* from above the pair of needle thread supporting members 1288, to thus be positioned between the pair of connecting members 1288*c*. The needle thread J can thereby be placed between the pair of connecting members 1288*c* with respect to the horizontal direction. Even when the turning arm 1281 upwardly draws the needle thread J, the needle thread J stays at the spacing between the circular-arc member 1288*b* and the circular-arc member 1288*d*. Namely, the needle thread supporting members 1288 support the needle thread at the position of the opening section 1342*b* [namely, the position of the opening section 1342*b* in both the vertical and horizontal directions (specifically, a position beneath the opening section 1342*b*)] in the horizontal direction; more specifically, toward the front side of the opening section 1342*b* (or "a position on the front side of the opening section 1342*b*") in the horizontal direction when viewed from the front. The needle thread supporting members 1288 can also support the needle thread within the opening section 1342*b* with respect to the horizontal direction (namely, a position between the front surface and back surface of the plate section 1341 with respect to the front-back direction).

The rod-shaped guide member (a first needle thread path inverting member) 1290 for guiding the needle thread J fed from above (in other words; from the upstream grip section 1240) to the needle thread supporting member 1288 is secured to a position in the vicinity of a lower side of each of the opening sections 1342*b* and on the front side of the plate section 1341. The guide member 1290 inverts the needle thread guided from above and subsequently leads the needle thread to the needle thread supporting member 1288.

The supporting section 1360 is mounted on the upper surface section 1312*a* of the arm 1312. The supporting section 1360 includes L-shaped hardware 1360*a* mounted on the arm 1312; L-shaped hardware 1360*b* secured to the L-shaped hardware 1360*a*; a rod-shaped plate section 1360*c* secured to the L-shaped hardware 1360*b*; L-shaped hardware 1360*d* secured to the rod-shaped plate section 1360*c*; the plate-like section 1360*e* secured to the L-shaped hardware 1360*d*; and the L-shaped hardware 1360*f* secured to the front surface of the plate-like section 1360*e*.

The plate-like section 1360*e* is provided in (or approximately) parallel with the plate section 1341. One plate-like section 1360*f*-1 of the L-shaped hardware 1360*f* is secured to the plate-like section 1360*e*, whilst another plate-like section 1360*f*-2 standing upright on the plate-like section 1360*f*-1 is provided at right angles to the plate-like section 1360*e*. The plate-like section 1360*f*-2 thereby becomes perpendicular to the plate section 1341. One plate-like section 1360*d*-1 of the L-shaped hardware 1360*d* is secured to the plate-like section 1360*e*. A remaining plate-like section 1360*d*-2 standing on the plate-like section 1360*d*-1 is provided at right angles to the plate section 1341.

There can also be adopted another configuration in which the supporting section 1360 is taken as a portion of constituent elements of the arm 1312; in which the arm 1312 is taken as an arm main body; and in which the arm has an arm main body and the supporting section 1360.

The control circuit 90 is a circuit for controlling operation of the main spindle motor 20, operation of the needle thread motor 1286, operation of the magnet section 1250, and operation of the magnet section 1270. According to the data stored in the memory device 92, the control circuit 90 controls operation of the individual sections. Specifically, the control circuit 90 generates main spindle data (see FIG. 7) according to embroidery data read from the memory device 92 and controls operation of the main spindle motor 20 according to the thus-generated main spindle data.

According to the embroidery data read from the memory device 92, the control circuit 90 generates needle thread control torque data (see FIG. 9). In the torque control zone, the needle thread motor 1286 is subjected to torque control in accordance with the needle thread control torque data. In a position control zone, the control circuit 90 generates angle correspondence data, such as that shown in FIG. 15, and performs position control in accordance with the angle correspondence data.

In a zone ranging from the endpoint of the position control zone to the end point of the torque control zone, the control circuit 90 controls the magnet sections 1250 and 1270 so as to close the upstream grip section 1240 and open the downstream grip section 1260. In the meantime, in a zone ranging from the endpoint of the torque control zone to the end point of the position control zone, the control circuit 90 controls the magnet sections 1250 and 1270 so as to open the upstream grip section 1240 and close the downstream grip section 1260.

Specifically, as shown in FIG. 5, the control circuit 90 has the CPU 90*a*, the PWM circuit 90*b*, and the current sensor 90*c* in the same manner as in the first and second embodiments. The respective sections; namely, the CPU 90*a*, the PWM circuit 90*b*, and the current sensor 90*c*, are structurally analogous to their counterparts described in connection with the first and second embodiments, and hence their repeated detailed descriptions are omitted. In the third embodiment, the solenoid 50 shown in FIG. 5 is replaced by the magnet section 1250, and the solenoid 70 is replaced by the magnet section 1270.

The encoder 21 for detecting an angle of the main spindle motor 20 (the rotational position of the main spindle motor 20) is interposed between the main spindle motor 20 and the control circuit 90. An encoder 1287 for detecting an angle of the needle thread motor 1286 (a rotational position of the needle thread motor 1286) is interposed between the needle thread motor 1286 and the control circuit 90. The control circuit 90 detects angles of the respective motors (the rotational positions of the respective motors) from information output from the respective encoders.

The shuttle 12*c* is placed at a position that is beneath the head 1207 and lower than the upper surface of the sewing machine table; specifically, the shuttle 12*c* is supported by the shuttle base (not shown) disposed below the sewing machine table.

The sewing frame 12*d* is a member for holding the processed fabric in a stretched manner and placed above (or on an upper surface of) the sewing machine table.

The main spindle 22 is rotated by the main spindle motor 20, and rotating force is transmitted by a predetermined power transmission mechanism, thereby actuating respective machine elements, such as the thread take-up levers 12*a*-1 to 12*a*-9, the needle bars 12*b*-1 to 12*b*-9, and presser feet, and the shuttle 12*c*. The main spindle motor 20 is configured so as to rotate in one direction. In the case of a multi-head embroidery sewing machine having a plurality of heads, a main spindle common to the respective heads is provided, and the main spindle motor for rotating the main spindle is provided.

The frame actuator 24 is for actuating the sewing frame 12*d* in both the X-axis direction (direction X1-X2) and the Y-axis direction (direction Y1-Y2) in accordance with a command from the control circuit, and actuates the sewing frame 12*d* in synchronism with vertical movements of the needle bar 12*b*. Specifically, the frame actuator 24 is made up of a servo motor for actuating the sewing frame 12*d* in the X-axis direction, a servo motor for actuating the sewing frame 12*d* in the Y-axis direction, and others.

The memory device 92 stores embroidery data used for performing embroidery. The embroidery data here mean; for instance, data that pertain to a stitch width, a stitching direction, a thread type (which one of a plurality of types of threads is used), and thread attributes (a thread material and a thread thickness), and that are provided for each stitch.

As shown in FIG. 6, the memory device 92 stores data pertaining to the starting point and the endpoint of the torque control zone as information about a main spindle angle in the same manner as in the first embodiment, and also data pertaining to the starting point and the end point of the position control zone as information about a main spindle angle. The starting point and the endpoint of the torque control zone and the starting point and the end point of the position control zone are the same as those described in connection with the first embodiment, and hence their detailed explanations are omitted.

An explanation is now given to the path of the needle threads J. Nine needle threads run along similar paths. Therefore, the needle thread situated at the right end when viewed from the front is taken as an example. The needle thread J guided from a thread roll (not shown) contacts the guide member 1252 by way of the needle thread guide 1300; passes through spacing between the first plate-like section of the first plate-like section unit 1242-9 and the second plate-like section 1244 of the upstream grip section 1240, then contacts the guide member 1254, undergoes inversion on the guide member 1290, and subsequently reaches the needle thread supporting member 1288. The needle thread J passed through the pair of needle thread supporting members 1288 contacts the guide member 1272, passes through spacing between the first plate-like section of the first plate-like section unit 1262-9 and the second plate-like section 1264 of the downstream grip section 1260, then contacts the guide member 1274. In addition, the needle thread J reaches the thread take-up lever 12*a*-9 by way of the needle thread guide 1302 and the tension spring 1337 and further reaches a sewing needle of the needle bar 12*b*-9 from the thread take-up lever 12*a*-9 by way of the needle thread guide 1338. The needle thread travels from the upstream side to the downstream side along the sequence mentioned above.

Operation of the sewing machine 1205 having the above structure is now described. First, operation of the needle thread motor 1286 and operation of the magnet sections 1250 and 1270 are described.

First, the control circuit 90 generates main spindle data (see FIG. 7) for each stitch in accordance with the embroidery data stored in the memory device 92 as in the case of the second embodiment. The method under which the control circuit 90 generates main spindle data is the same as that described in connection with the second embodiment, and hence its detailed explanations are omitted here for brevity.

In accordance with the embroidery data stored in the memory device 92, the control circuit 90 generates for each stitch needle thread control torque data used for controlling torque of the needle thread motor 1286 as in the case of the second embodiment (see FIG. 9). The method for generating the needle thread control torque data is the same as that described in connection with the second embodiment, and hence its detailed explanation is omitted here for brevity.

Operation performed during actual embroidering is analogous to that described in connection with the second embodiment. The sewing machine operates according to a flowchart shown in FIGS. 10 to 13 and FIG. 17. However, in the third embodiment, a plurality of needle bars are provided, and an arbitrary needle bar is selected from the plurality of needle bars (i.e., a thread is selected). Accordingly, a main spindle angle is detected along the flowchart shown in FIG. 10 (S1). When the detected main spindle angle is a main spindle angle corresponding to a start of one stitch (e.g., a zero degree in FIG. 18) (namely, on the occasion of transition to the next stitch) and when a needle thread to be selected is subjected to a change, there is performed the following processing between step S1 and step 32; namely, processing for sliding the needle bar case 1314, to thereby place the magnet sections 1250 and 1270 at the position of the thus-selected thread and letting the turning arm 1281 come to the position of the opening section 1324 corresponding to the selected needle thread so that the turning arm 1281 of the turning section 1280 can retain and pull up the needle thread.

When the needle bar case 1314 slides with respect to the arm 1312, the turning arm 1281 is downwardly turned to the receded position designated by 1281(B) in FIG. 34 and FIG. 35, to thus prevent the turning arm 1281 from contacting the plate section 1314 and a member provided on the plate section 1314.

Even in the torque control subroutine pertaining to step S3 shown in FIG. 10, operation is performed along the flowchart shown in FIG. 11 in the same way as described in connection with the first and second embodiments.

Even in the position control subroutine pertaining to step S5 shown in FIG. 10, operation is performed in the same way as indicated by flowcharts illustrated in FIGS. 12 and 13 as in the case of the first embodiment.

Even in relation to control of switching between the upstream grip section 1240 and the downstream grip section 1260, the following operation is performed in the same manner as in the case of the first and second embodiments as shown in FIG. 17 and FIG. 18. Specifically, the grip section main body 1241 of the upstream grip section 1240 is opened, and the grip section main body 1261 of the downstream grip section 1260 is closed from the end point of the torque control zone to the end point of the position control zone of the needle thread motor 1286. In the meantime, the grip section main body 1241 of the upstream grip section 1240 is closed, and the grip section main body 1261 of the downstream grip section 1260 is opened from the end point of the position control zone to the end point of the torque control zone. When the grip section main bodies 1241 and 1261 are closed, the gripped needle thread is fixed. On the contrary, when the grip section main bodies 1241 and 1261 are opened, the needle thread is released from the gripped state.

As a result of activation of the magnet section 1250, the first plate-like section of the first plate-like section unit corresponding to the position of the magnet section 1250, among the first plate-like section main units 1242-1 to 1242-9, is attracted by magnetic force. Spacing between the first plate-like section 1242*a* and the second plate-like section 1244 is thereby closed tightly, and the grip section main body 1241 is also closed. Thus, there is achieved a closed state in which the needle thread J is pinched between the first plate-like section 1242*a* and the second plate-like section 1244. As shown in; for instance, FIGS. 31, 34, and 35, when the magnet section 1250 is situated on the back side of the first plate-like section 1242*a* of the first plate-like section unit 1242-8, the magnet section 1250 is activated, whereby the spacing between the first plate-like section 1242*a* and the second plate-like section 1244 is tightly closed. Thus, the needle thread is gripped between the first plate-like section 1242*a* and the second plate-like section 1244. When the magnet section 1250 is not activated, the spacing between the first plate-like section 1242*a* and the second plate-like section 1244 is not tightly closed (namely, the first plate-like section and the second plate-like section remain in simple contact with each other). Hence, the grip section main body 1241 is opened, thereby achieving an open state in which the needle thread is released. As above, the magnet section 1250 acting as the upstream drive section switches between the closed state in which the grip section main body 1241 grips the needle thread and the open state in which the needle thread is released.

Likewise, as a result of activation of the magnet section 1270, the first plate-like section of the first plate-like section unit corresponding to the position of the magnet section 1270, among the first plate-like sections 1262-1 to 1262-9, is attracted by magnetic force. Spacing between the first plate-like section 1262*a* and the second plate-like section 1264 is thereby tightly closed, and the grip section main body 1261 is also closed. Thus, there is achieved a closed state in which the needle thread J is pinched between the first plate-like section 1262*a* and the second plate-like section 1264. As shown in; for instance, FIG. 31, FIG. 34, and FIG. 35, when the magnet section 1270 is situated on the back side of the first plate-like section 1262*a* of the first plate-like section unit 1262-8, the magnet section 1270 is activated, whereby the spacing between the first plate-like section 1262*a* and the second plate-like section 1264 is tightly closed. Thus, the needle thread is gripped between the first plate-like section 1262*a* and the second plate-like section 1264. When the magnet section 1270 is not activated, the spacing between the first plate-like section 1262*a* and the second plate-like section 1264 is not tightly closed (specifically, the first plate-like section and the second plate-like section remain in simple contact with each other). Hence, the grip section main body 1261 is opened, thereby achieving an open state in which the needle thread is released. As above, the magnet section 1270 acting as the upstream drive section switches between the closed state in which the grip section main body 1261 grips the needle thread and the open state in which the needle thread is released.

Specifically, an explanation is given to operation of the needle thread control section 1230. When the main spindle angle is at the end point of the position control zone, the turning arm 1281 assumes a position of the top dead center (the initial position). Specifically, the hook section 1284 of the turning arm 1281 is situated at an obliquely upward position (a position designated by 1281(A) shown in FIG. 34 and FIG. 35). The leading end of the turning arm 1281 is exposed to the front side of the plate section 1341 from the opening section 1342*b* at the initial position. When a change is made to the needle thread to be selected, the turning arm 1281 is receded. Therefore, the turning arm 1281 is turned to the receded position. On this occasion, the turning arm 1281 is downwardly turned, thereby turning the needle thread to the receded position.

When entered the torque control zone, the needle thread motor 1286 is subjected to torque control while the grip section main body 1241 is closed and while the grip section main body 1261 is opened, whereby the needle thread motor 1286 imparts upward rotating force to the turning arm 1281. Thereby, the thread take-up lever 12*a*-1, or the like, turns upwardly while the turning arm 1281 is pulling the needle thread J against a direction (a pulling direction) in which the thread take-up lever 12*a*-1, or the like, pulls the needle thread J, thereby pulling the needle thread J with respect to the processed fabric. As the thread take-up lever 12*a*-1, or the like, pulls the needle thread J (i.e., the thread take-up lever 12*a* shifts to the top dead center (the other dead center)), the turning arm 1281 turns in the direction (the downward direction) in which the thread take-up lever 12*a*-1, or the like, pulls the needle thread J.

As in the case of the first and second embodiments, a torque value set in the needle thread control torque data is set to a value such that, as the thread take-up lever 12*a*-1, or the like, pulls the needle thread J, the turning arm 1281 turns in the direction (the downward direction) in which the thread take-up lever 12*a*-1, or the like, pulls the needle thread J and does not hinder the thread take-up lever 12*a* from pulling the needle thread J.

When the main spindle angle enters the position control zone, the needle thread motor 1286 is subjected to position control while the grip section main body 1241 is opened and while the grip section main body 1261 is closed, whereupon the turning arm 1281 turns in a direction (an upward direction) in which the needle thread J is pulled. Reference numeral 1281(A) shown in FIG. 34 and FIG. 35 shows a state where the turning arm 1281 turned to its initial position (or a position of origin) as a result of the needle thread motor 1286 having returned to the initial position at the end point of the position control zone.

When the torque value is large, the needle thread J is hardly pulled during torque control, so that a stitch is tightly sewn. On the contrary, when the torque value is small, the needle thread J is weakly pulled, so that a corresponding stitch is softly sewn.

As above, in connection with a control zone for each stitch, in a torque control zone including at least a portion of an area from the bottom dead center to the top dead center of the thread take-up lever 12*a*-1, or the like, that is a zone during which the thread take-up lever 12*a*-1, or the like, pulls the needle thread with respect to the processed fabric to be sewn with the needle thread, there is performed torque control for imparting rotating force to the turning arm 1281 in accordance with the torque value in such a way that tension is imparted to the needle thread against the direction in which the thread take-up lever 12*a*-1, or the like, pulls the needle thread, while the grip section main body 1241 is closed and while the grip section main body 1261 is opened, in the meantime, in a position control zone that is at least a portion of the zone other than the torque control zone, there is performed position control for imparting rotating force to the turning arm 1281 in accordance with angular position data pertaining to the needle thread motor 1286 in such a way that the angle of the needle thread motor 1286 returns to its initial angular position which is a rotational position of the needle thread motor 1286, while the grip section main body 1241 is opened and while the grip section main body 1261 is closed, thereby drawing the needle thread from upstream.

Control of the main spindle motor 20 is analogous to that described in connection with the first embodiment. The main spindle motor 20 operates along the flowcharts shown in FIGS. 21 and 22. However, in the third embodiment, a plurality of needle bars are provided, and an arbitrary needle bar is selected from the plurality of needle bars (i.e., a thread is selected) as in the case of the second embodiment. On the occasion of the main spindle angle being read from the main spindle data in step S51 of the flowchart shown in FIG. 21, when the main spindle angle corresponds to the start of one stitch (e.g., zero degree in FIG. 18) and when a needle thread to be selected is changed, there is performed the following processing between steps S51 and S52; namely, processing for sliding the needle bar case 1314, to thereby place the magnet sections 1250 and 1270 at the position of the thus-selected thread, and letting the turning arm 1281 come to the position of the opening section 1342*b* corresponding to the selected needle thread so that the turning arm 1281 of the turning section 1280 can retain and pull up the thus-selected thread.

Control of the main spindle motor 20 is analogous to that described in connection with the first embodiment except that control of sliding operation of the needle bar case 1314 is provided and, therefore, its detailed explanations are omitted.

As mentioned above, in the sewing machine of the third embodiment, the needle thread is subjected to torque control in the torque control zone. Accordingly, the magnitude of tension on the needle thread can be controlled. In particular, torque control can be performed on a per-stitch basis in the torque control zone by means of the needle thread control torque data (FIG. 9). Hence, tension on the needle thread can be controlled on a per-stitch basis, so that seam hardness can be controlled on a per-stitch basis.

In the case of the multi-needle head, even when a stitch is formed from a different needle thread, a torque value in the needle thread control torque data is made constant, whereby tension on the needle thread can be equally controlled. In the case of a multi-head embroidery sewing machine, the needle thread control torque data used for a torque control zone are made common to the heads, whereby tension on the needle threads exerted by the respective heads can be made equal.

Further, the needle thread control section 1230 is provided in place of the tension disc and the rotary tension component in the related-art sewing machine (see FIG. 47). In the position control zone where the needle thread J is drawn, the grip section main body 1241 becomes open, and only the needle thread guide 1300 is present at an upstream position with respect to the turning arm 1281 of the turning section 1280. Frictional resistance does not exist between the tension disc and the rotary tension component. Further, the grip section main body 1261 becomes closed. Hence, movements of the thread take-up lever 12*a* will not pose any problem when the needle thread is drawn. Consequently, the needle thread can be smoothly drawn from the thread roll, thereby reducing the risk of occurrence of a thread break.

Figure 48:
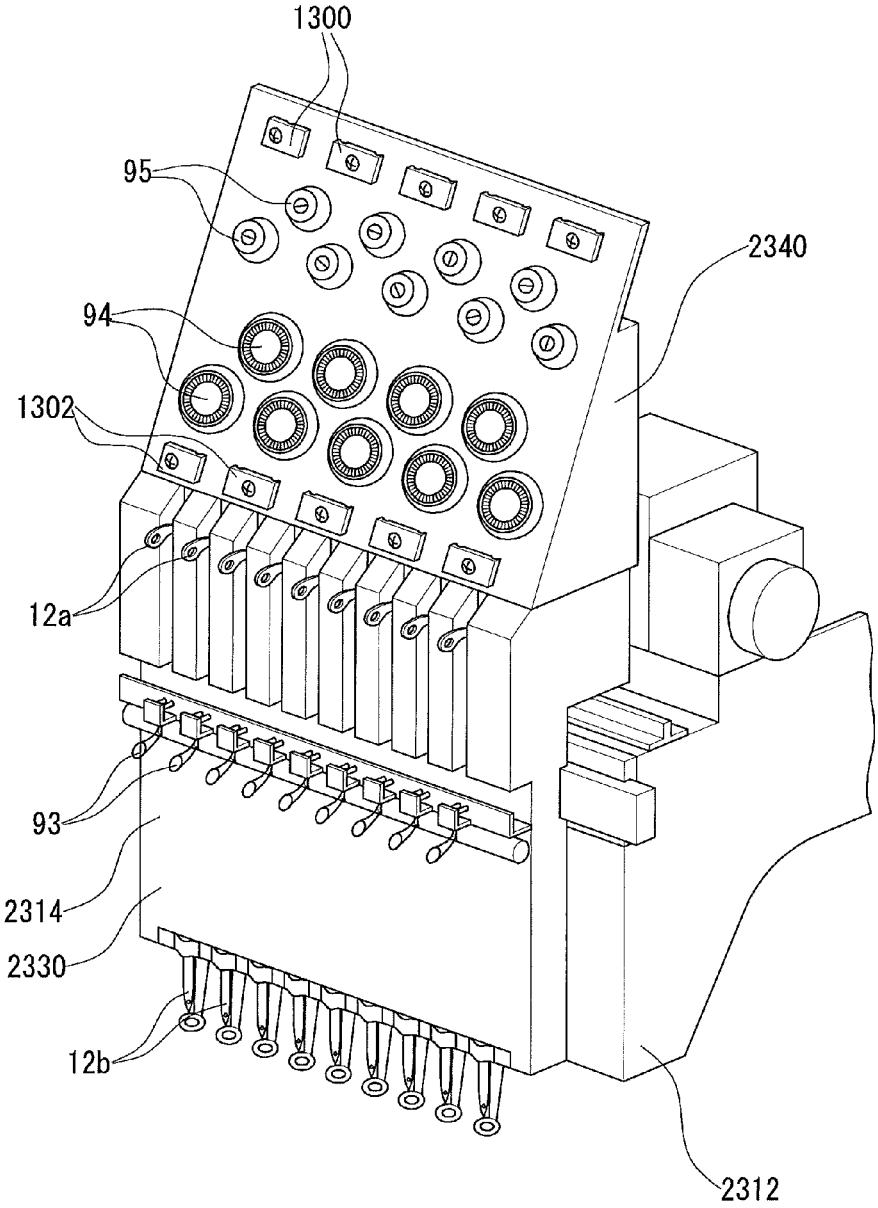
FIG. 48 It is a forward perspective view showing the related-art sewing machine.

In contrast to the related-art sewing machine shown in FIG. 48, the sewing machine 1205 can be configured as follows. Namely, the needle thread control mounting section 1340 having the grip section main bodies 1241 and 1261 and the needle thread supporting member 1288 is provided on the needle bar case main body 1330 in place of the needle thread adjustment member mounting section 2340 having the tension disc 95, the rotary tension component 94, and the needle thread guides 1300 and 1302. The magnet sections 1250 and 1270 and the turning section 1280 are attached to the arm 1312 by way of the supporting section 1360. The configuration of the present embodiment is adopted as the configuration of the control circuit 90 and that of the memory section 92. The configuration of the related-art sewing machine can be employed for the configuration of the head except its members to be replaced with their counterpart members in the related-art sewing machine; in particular, the arm 1312 and its internal configuration and the needle bar case main body 1330 and its internal configuration. Therefore, manufacturing cost can be curtailed.

If a break has occurred in a needle thread, the turning arm 1281 will not turn downwardly in the torque control zone. Specifically, the turning arm 1281 will not pulled in the downward direction that is opposite to the direction in which the rotating force of the needle thread motor 1286 is imparted. A thread break can be detected by detecting that the turning arm

1281 does not turn downwardly. Further, when there are not any thread breaks, the turning arm 1281 downwardly turns in the torque control zone. Hence, occurrence of a thread break can be detected accurately.

In the position control zone, the current position (angle) of the needle thread motor 1286 is detected. There are generated angle correspondence data for controlling the position of the needle thread motor 1286 to its initial angle position. There is performed control for returning the needle thread motor 1286 to its initial position in accordance with the angle correspondence data through position control. Accordingly, the needle thread can be drawn by only the amount corresponding to a quantity of thread consumed as a result of pulling of the turning arm 1281 in the torque control zone. Hence, an excess or deficiency of the quantity of accumulated thread, which would otherwise be caused by pulling a needle thread, will not occur.

When the structure including the upstream grip section 1240, the downstream grip section 1260, and the turning section 1280 is applied to the multi-needle head, the sewing machine can be configured by providing only one each of the magnet section 1250 of the upstream grip section 1240, the magnet section 1270 of the downstream grip section 1260, and the turning section 1280. Accordingly, the sewing machine can be provided with an efficient structure while its manufacturing cost is curtailed.

Fourth Embodiment

A sewing machine of a fourth embodiment is now described. Although the sewing machine of the fourth embodiment has a similar structure as that of the sewing machine described in connection with the third embodiment, they differ from each other in a configuration that supports the magnet sections 1250 and 1270 and the turning section 1280.

Figure 37:
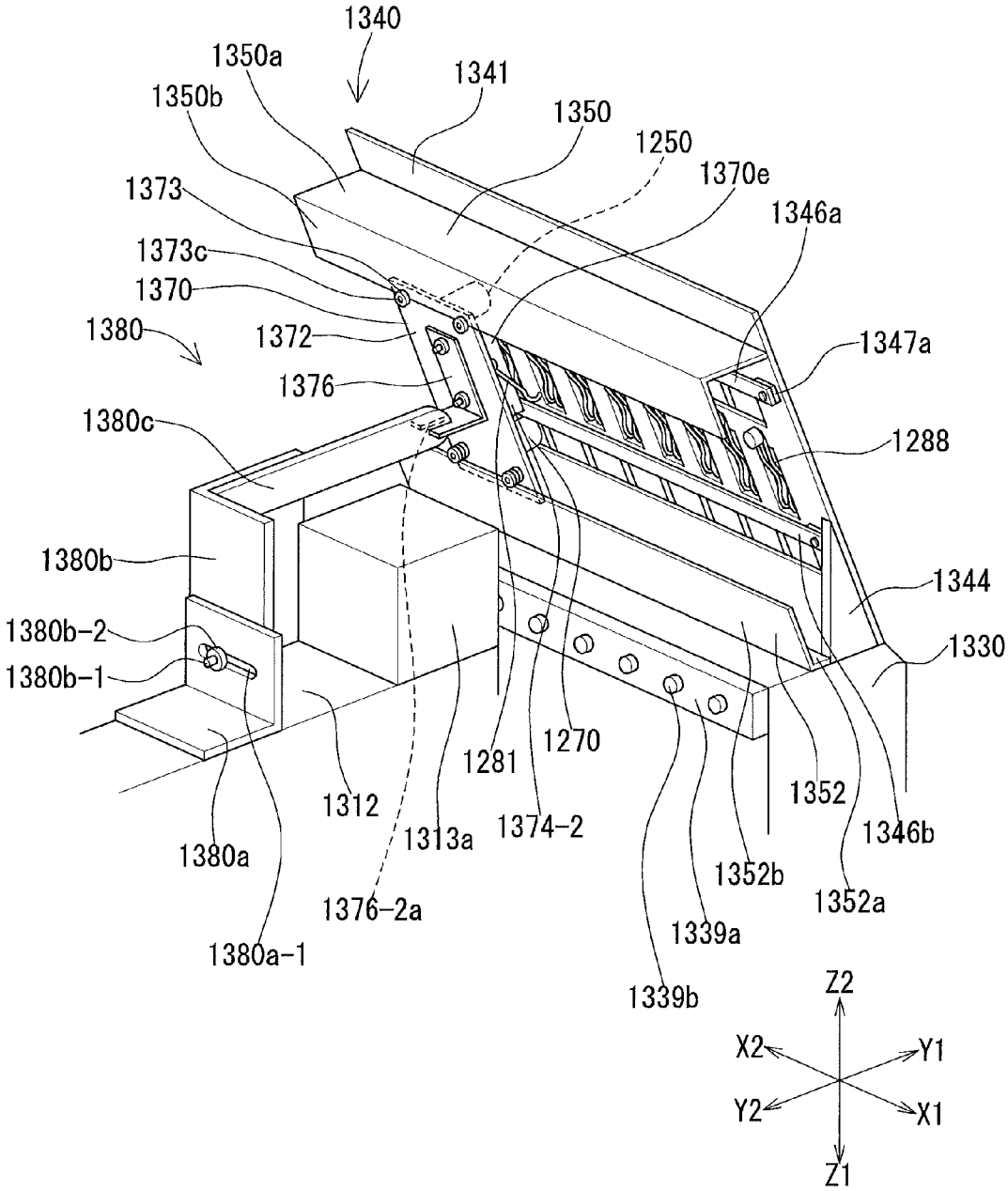
FIG. 37 It is a backward perspective view showing a head of a sewing machine of a fourth embodiment.
Figure 38:
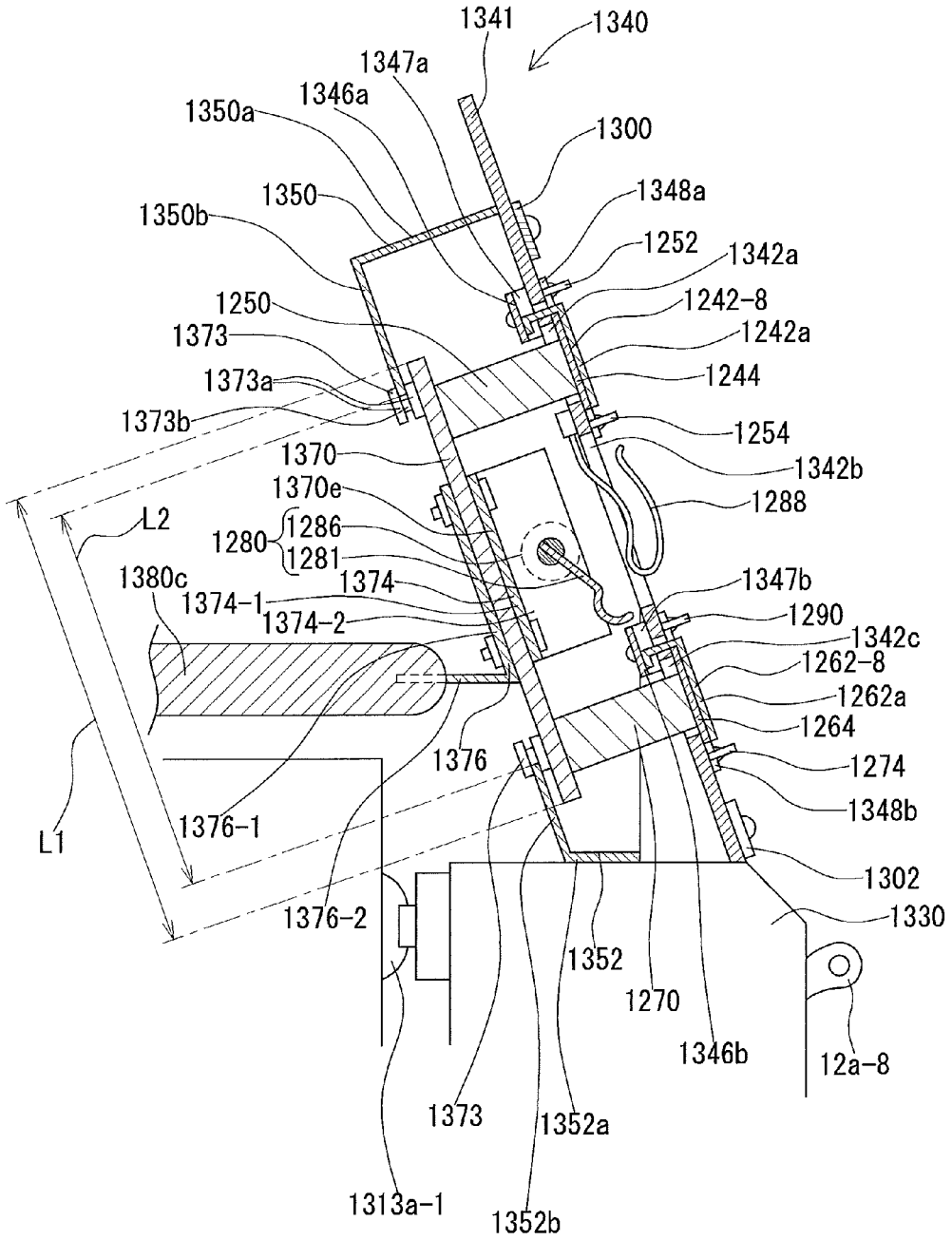
FIG. 38 It is a fragmentary left-side cross sectional view showing a principal part of the head of the sewing machine of the fourth embodiment.

The sewing machine of the fourth embodiment is described by reference to FIG. 37 and FIG. 38. A slide assist member 1350 is secured to a back surface of the plate section 1341 in the needle thread control mounting section 1340. A slide assist member 1352 is secured to an upper surface of the needle bar case main body, 1330. FIG. 38 is a principal cross sectional view in which only the needle thread control mounting section 1340 and the needle thread control section 1230 are fractured at position P-P shown in FIG. 32. FIG. 38 shows them while omitting needle threads.

Specifically, the slide assist member 1350 is disposed at an upper end area on the back surface of the plate section 1341 and made up of an L-shaped plate-like section. Specifically, the slide assist member 1350 has a plate-like section 1350*a* that forms a right angle with the back surface of the plate section 1341 and that is provided in the horizontal direction and a plate-like section 1350*b* that is downwardly formed so as to extend continually from an end of a back side of the plate-like section 1350*a*. Both the plate-like section 1350*a* and the plate-like section 1350*b* assume a rectangular shape, and the plate-like section 1350*b* is provided in parallel with the plate section 1341.

The slide assist member 1352 has a plate-like section 1352*a* that is secured to the upper surface of the needle bar case main body 1330 in the horizontal direction and a plate-like section 1352*b* formed at an end on a back side of the plate-like section 1352*a* in an obliquely upward direction. Both the plate-like section 1352*a* and the plate-like section 1352*b* assume a rectangular shape, and the plate like section 1352*b* is disposed in parallel with the plate like section 1341. A distance between the plate-like section 1352*b* and the plate section 1341 and a distance between the plate-like section 1350*b* and the plate section 1341 are formed so as to become equal to each other. Aback surface of the plate-like section 1350*b* and a back surface of the plate-like section 1352*b* lie in the same plane. The plate-like section 1350*a*, the plate-like section 1350*b*, the plate-like section 1352*a*, and the plate-like section 1352*b* are formed to the same thickness.

A lower-end side of the plate-like section 1350*b* and an upper-end side of the plate-like section 1352*b* act as rails along which a supporting section 1370 slides in the horizontal direction.

The slide assist member 1352 is placed on the upper surface of the needle bar case main body 1330. However, the mount position of the slide assist member 1352 is not limited to the upper surface but can also be secured to the back surface of the plate section 1341. Alternatively, side surface sections for connecting the slide assist member 1350 to the slide assist member 1352 can also be provided on both sides of each of the slide assist members 1350 and 1352, thereby integrating the slide assist members 1350 and 1352 into one. The thus-integrated slide assist members 1350 and 1352 can also be provided on an upper surface of the needle bar case main body 1330.

The supporting section (a magnet section/motor supporting member) 1370 is a member for supporting the magnet sections 1250 and 1270 and the turning section 1280. The supporting section 1370 includes a plate-like section 1372, L-shaped hardware 1374 secured to a front surface of the plate-like section 1372, and L-shaped hardware 1376 secured to a back surface of the plate-like section 1372.

Specifically, the plate-like section 1372 assumes the shape of a rectangular plate. A vertical length L1 of the plate-like section 1372 is made longer than a length L2 from a lower end of the plate-like section 1350*b* to an upper end of the plate-like section 1352*b*. Wheel sections 1373 are provided respectively at four corners of a back surface of the plate-like section 1372 so as to be rotatable with respect to the plate-like section 1372. Each of the wheel sections 1373 has a pair of disc sections 1373*a* spaced apart from each other and a cylindrical section 1373*b* placed between the pair of disc sections 1373*a*. The cylindrical section 1373*b* is formed so as to be rotatable with respect to a shaft section 1373*c* secured to the plate-like section 1372. A lower end of the plate-like section 1350*b* is situated between the pair of disc sections 1373*a* of the upper two wheel sections 1373. A lower end of the plate-like section 1350*b* remains in contact with the cylindrical section 1373*b*. An upper end of the plate-like section 1352*b* is situated between the pair of disc sections 1373*a* of the lower two wheel sections 1373, and an upper end of the plate-like section 1352*b* remains in contact with the cylindrical section 1373*b*. As a result of the plate-like section 1372 being slid in the horizontal direction, the wheel sections 1373 rotate along the plate-like sections 1350*b* and 1352*b*, and the supporting section 1370 smoothly slides in the horizontal direction. The plate-like section 1372 is in parallel with the plate section 1341.

One plate-like section 1374-1 of the L-shaped hardware 1374 is secured to the plate-like section 1372. Another plate-like section 1374-2 provided upright on the plate-like section 1374-1 is provided at right angles to the plate-like section 1374-1. The plate-like section 1374-2 is at right angles to the plate section 1341. One plate-like section 1376-1 of the L-shaped hardware 1376 is secured to the plate-like section 1372, and another plate-like section 1376-2 standing upright on the plate-like section 1376-1 extends continually from a lower end of the plate-like section 1376-1 and is provided on the level. A groove section 1376-2*a* to be engaged with a rod-shaped plate section 1380*c* is formed in the plate-like section 1376-2.

A slide regulation section 1380 is provided on the upper surface section 1312*a* of the arm 1312. The slide regulation section 1380 has L-shaped hardware 1380*a* attached onto the arm 1312, L-shaped hardware 1380*b* secured to the L-shaped hardware 1380*a*, and a rod-shaped section 1380*c* secured to the L-shaped hardware 1380*b*. As shown in FIG. 37, a horizontally elongated hole 1380*a*-1 is formed in the plate-like upright section of the L-shaped hardware 1380*a*. A bolt 1380*b*-1 attached to the L-shaped hardware 1380*b* is inserted into the elongated hole 1380*a*-1. A nut 1380*b*-2 is screw-engaged with the bolt 1380*b*-1, whereby the L-shaped hardware 1380*b* is fixed to the L-shaped hardware 1380*a*. Since the bolt 1380*b*-1 is inserted into the elongated hole 1380*a*-1, a position where the L-shaped hardware 1380*b* is attached to the L-shaped hardware 1380*a* can be adjusted in the horizontal direction. Further, a front edge of the rod-shaped plate section 1380*c* is engaged with the groove section 1376-2*a* of the L-shaped hardware 1376. As above, the rod-shaped plate section 1380*c* is engaged with the groove of the plate-like section 1376-2, whereby the slide regulation section 1380 regulates horizontal sliding action of the supporting section 1370, to thus position the supporting section 1370 in its horizontal direction. As a result of the rod-shaped plate section 1380*c* being engaged with the groove of the plate-like section 1376-2, the magnet sections 1250 and 1270 and the turning section 1280 are secured in the direction of the arm 1312.

The slide regulation section 1380 is taken as a part of the constituent elements of the arm 1312, and the arm 1312 is taken as an arm main body. The arm can also be configured so as to include an arm main body and the slide regulation section 1380.

Since the sewing machine described in connection with the fourth embodiment is analogous to that described in connection with the third embodiment except the configuration described above, its detailed explanations are omitted here.

In the sewing machine described in connection with the fourth embodiment, the supporting section 1370 is formed so as to be slidable with respect to the slide assist members 1350 and 1352. Hence, when the supporting section 1370 is placed at the back side of the plate section 1341, the horizontal position of the supporting section 1370 can be finely adjusted. Thus, the upstream magnet section, the downstream magnet section, and the horizontal position of the turning arm can be finely adjusted. Specifically, after the supporting section 1370 is slid in the horizontal direction to an appropriate position, the rod-shaped plate section 1380*c* is engaged with the L-shaped hardware 1376. Subsequently, the nut 1380*b*-2 is fastened, thereby fixing the L-shaped hardware 1380*b* to the L-shaped hardware 1380*a*. Incidentally, the rod-shaped plate section 1380*c* may be engaged with the L-shaped hardware 1376 while the nut 1380*b*-2 is loosened with respect to the bolt 1380*b*-1, and the L-shaped hardware 1380*b* may be moved in the horizontal direction with respect to the L-shaped hardware 1380*a*, whereby the supporting section 1370 is slid with respect to the slide assist members 1350 and 1352, to thus adjust the position of the supporting section 1370. Subsequently, the nut 1380*b*-2 can also be fastened.

Operation of the sewing machine described in connection with the fourth embodiment is analogous to that described in connection with the second and third embodiments, and hence its detailed explanation is omitted here.

Fifth Embodiment

A sewing machine of a fifth embodiment is now described. The swing machine of the fifth embodiment is approximately similar to the sewing machine described in connection with the third embodiment in terms of a structure. However, they differ from each other in connection with a structure of the grip section main bodies 1241 and 1261.

Figure 39:
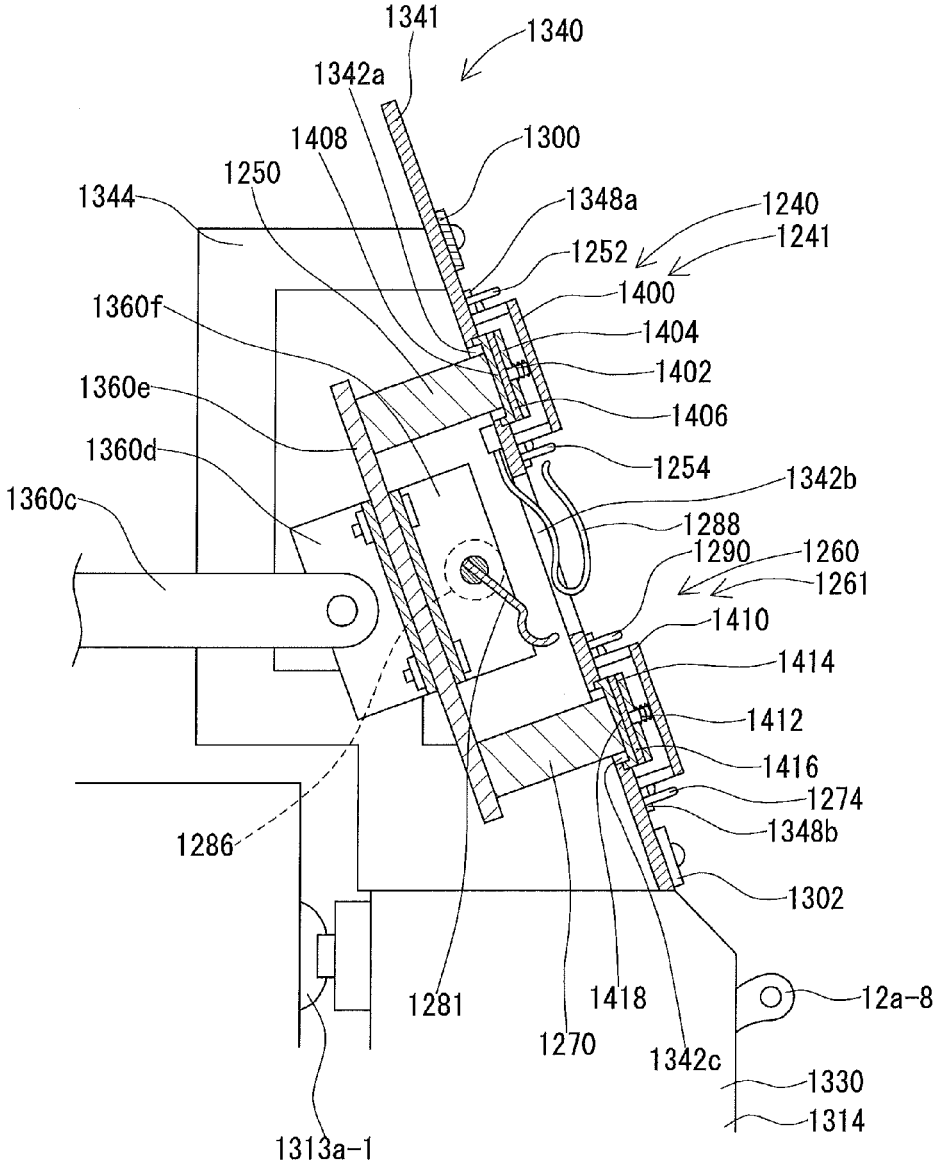
FIG. 39 It is a fragmentary left-side cross sectional view showing a principal part of a head of a sewing machine of a fifth embodiment.
Figure 40:
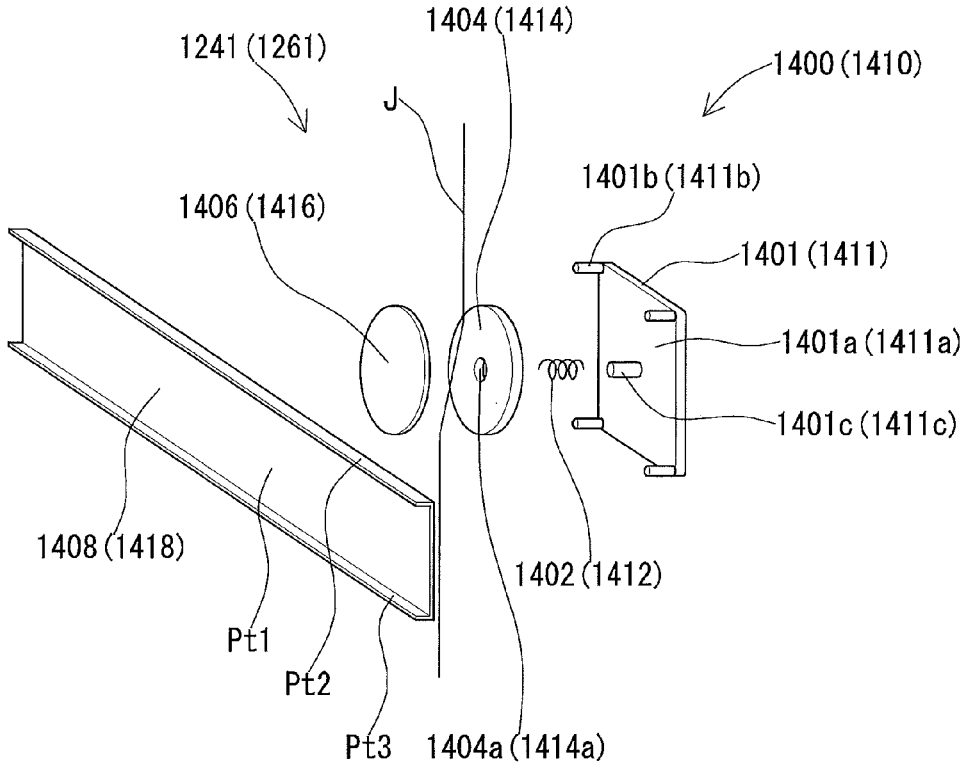
FIG. 40 It is an exploded perspective view showing a grip section main body of the sewing machine of the fifth embodiment.
Figure 41:
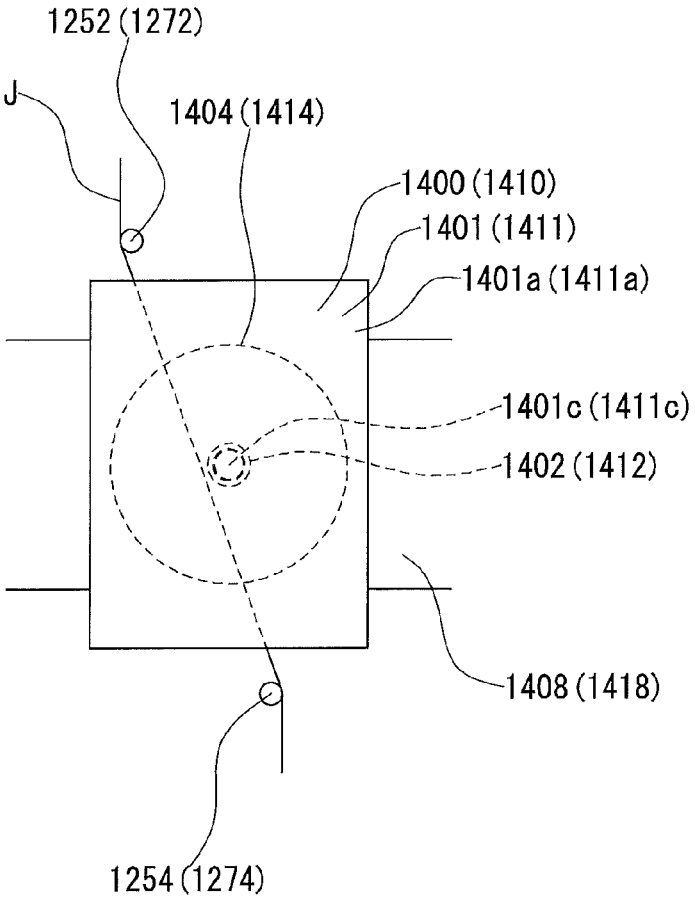
FIG. 41 It is a front view of a principal part showing the grip section main body of the sewing machine of the fifth embodiment.

Specifically, as shown in FIG. 39 to FIG. 41, the grip section main body 1241 of the upstream grip section 1240 has a first plate-like section unit 1400 and a second plate-like section 1408. The first plate-like section unit 1400 is provided for each of the needle threads. FIG. 39 is a principal cross sectional view in which only the needle thread control mounting section 1340 and the needle thread control section 1230 are fractured. FIG. 39 shows them while omitting needle threads.

The first plate-like section unit 1400 includes a supporting member (an upstream first plate-like section supporting member) 1401 attached to the position of the opening section 1342*a* on the front side of the plate section 1341; a coiled spring (an upstream coiled spring) 1402 into which a shaft section 1401*c* of the supporting member 1401 is to be inserted; a first plate-like section (an upstream first plate-like section) 1404 into which the shaft section 1401*c* is to be inserted so as to become closer to the back with reference to the coiled spring 1402 along the shaft section 1401*c*; and a protective plate-like section (an upstream protective plate-like section) 1406 fixed to a leading end of the shaft section 1401*c*.

The supporting member 1401 has a square-shaped (rectangular) plate-like section 1401*a*, cylindrical sections 1401*b* projecting from respective four corners of the plate-like section 1401*a* toward the back, and the shaft section (a first shaft section) 1401*c* protruding from a center area on a back surface of the plate-like section 1401*a* toward the back. The upper two cylindrical sections 1401*b* are secured to an upper side of the opening section 1342*a* of the plate section 1341, and the lower two cylindrical sections 1401*b* are secured to a lower side of the opening section 1342*a* of the plate section 1341. The length of the cylindrical section 1401*b* and the length of the shaft section 1401*c* are set such that a back surface of the protective plate-like section 1406 contacts a front surface of the second plate-like section 1408.

The coiled spring 1402 is secured to the shaft section 1401*c* by means of inserting the shaft section 1401*c* into the coiled spring 1402, thereby forcing the first plate-like section 1404 toward the protective plate-like section 1406. Driving force of the coiled spring 1402 has such a magnitude that a back surface of the first plate-like section 1404 and a front surface of the protective plate-like section 1406 overlap one another and the back surface of the protective plate-like section 1406 and a front surface of the second plate-like section 1408 overlap one another while the first plate-like section 1404 remains unattracted by the magnet section 1250 and that the needle thread is not fixed by the first plate-like section 1404 and the protective plate-like section 1406.

The first plate-like section 1404 assumes a circular plate shape, and a hole section 1404*a* into which the shaft section 1401*c* is to be inserted is made in a center of the first plate-like section 1404. The first plate-like section 1404 is attached to the shaft section 1401*c* by inserting the shaft section 1401*c* to the hole section 1404*a*. The first plate-like section 1404 thereby remains hanging on the plate section 1341 by way of the supporting member 1401. The first plate-like section 1404 slides in the vertical direction with respect to a front surface of the second plate-like section 1408, whereby spacing between the first plate-like section 1404 and the protective plate-like section 1406, the second plate-like section 1408 varies. The diameter of the hole section 1404*a* is formed so as to become smaller than the diameter of the coiled spring 1402, thereby preventing the coiled spring 1402 from dropping off from the hole section 1404*a* to the back. The first plate-like section 1404 is formed from metal attracted by a magnet, like iron.

The protective plate-like section 1406 is a member for preventing the second plate-like section 1408 from being worn by a needle thread; assumes the shape of a circular plate; and is secured to a leading end of the shaft section 1401*c*. The protective plate-like section 1406 is formed from material unattracted by the magnet (a material to which a magnet does not adhere); that is, a non-magnetic substance. The protective plate-like section 1406 is preferably formed from a nonmagnetic metallic substance (e.g., stainless steel or aluminum).

The second plate-like section 1408 is formed into the shape of a plate having an approximately-C-shaped cross sectional profile and from a synthetic resin film. The second plate-like section 1408 is fitted into a cutout formed on the front side of and along upper and lower sides of the opening section 1342*a*. Specifically, the second plate-like section 1408 includes a second plate-like section main body section Pt-1 assuming a shape of an elongated rectangular plate; a projecting section Pt-2 assuming a shape of an elongated rectangular plate that continually extends toward the back from an upper side which is one longitudinal side of the second plate-like section main body section Pt-1; and a projecting section Pt-3 assuming a shape of an elongated rectangular plate that continually extends toward the back from a lower side which is the other longitudinal side of the second plate-like section main body section Pt-1. The second plate-like section main body section pt-1 grips the needle thread along with the first plate-like section 1404.

The needle thread 3 is situated between the first plate-like section 1404 and the protective plate-like section 1406. As shown in FIG. 41, the needle thread J is arranged diagonally over the plate-like section 1401*a* so as not to contact the shaft section 1401*c* and the coiled spring 1402 (i.e., along a direction from an upper left position on the plate-like section 1401*a* to a lower right position on the same when viewed from the front).

The grip section main body 1241 is configured in the manner as above, the first plate-like section 1404 and the protective plate-like section 1406 are driven toward the second plate-like section 1408 by means of the coiled spring 1402. Even when the magnet section 1205 does not attract the first plate-like section 1404, the first plate-like section 1404 contacts the protective plate-like section 1406, and the protective plate-like section 1406 remains in contact with the second plate-like section 1408. Accordingly, vibration sound, which would otherwise occur as a result of repeated opening/closing of the grip section main body 1241, or vibration sound, which would otherwise be caused by vibrations of a head, can be prevented. Specifically, in the case of the second to fourth embodiments, the first plate-like section stays in a mere hanging state. Therefore, when the first plate-like section is attracted by the magnet section, the first plate-like section contacts the second plate-like section, thereby generating sound. Further, the first plate-like section repeatedly contacts the second plate-like section as a result of repeated opening/closing of the grip section main body, thereby generating sound. The first plate-like section contacts the second plate-like section by means of vibration of a head, thereby generating sound. In the present embodiment, occurrence of such vibration sound can be prevented. Specifically, during actual embroidering, the first plate-like section 1404 and the protective plate-like section 1406 are driven toward the second plate-like section 1408 by means of the coiled spring 1402 in the first plate-like section units 1400 corresponding to unselected needle bars as well as in the first plate-like section unit 1400 corresponding to the selected needle bar. Hence, vibration sound, which would otherwise be caused by repeated opening/closing of the grip section main body 1241, and vibration sound, which would otherwise be caused by vibration of a head, are prevented. Since the protective plate-like section 1406 is interposed between the second plate-like section 1408 and the needle thread, abrasion of the second plate-like section 1408, which would otherwise be caused when the needle thread contacts the second plate-like section 1408, can be prevented. Specifically, in the case of the second to fourth embodiments, the needle thread remains in contact with the second plate-like section. Therefore, when the second plate-like section is made of a synthetic resin film, the second plate-like section may be worn by friction with the needle thread as a result of the needle thread moving along a path. However, abrasion of the second plate-like section 1408 can be prevented by providing the protective plate-like section 1406. Further, as a result of the protective plate-like section 1406 is made of metal, abrasion of the protective plate-like section 1406 itself can be prevented.

The grip section main body 1261 of the downstream grip section 1260 is structurally same to the grip section main body 1241. As shown in FIGS. 39 to 41, the grip section main body 1261 has a first plate-like section units 1410 and a second plate-like section 1418. The first plate-like section unit 1410 is provided for each of the needle threads.

The first plate-like section unit 1410 includes a supporting member (a downstream first plate-like section supporting member) 1411 attached to a position of the opening section 1342*c* on the front surface of the plate section 1341; a coiled spring (a downstream coiled spring) 1412 inserted into a shaft section 1411*c* of the supporting member 1411, a first plate-like section (a downstream first plate-like section) 1414 that is inserted into the shaft section 1411*c* and that is provided at a position on the shaft section 1411*c* closer to the back side with reference to the coiled spring 1412, and a protective plate-like section (a downstream protective plate-like section) 1416 fixed to a leading end of the shaft section 1411.

The supporting member 1411 is structurally identical with the supporting member 1401 and includes a plate-like section 1411*a*, cylindrical sections 1411*b*, and the shaft section (a second shaft section) 1411*c*. The plate-like section 1411*a* is structurally identical with the plate-like section 1401*a*, the cylindrical section 1411*b* is structurally identical with the cylindrical section 1401*b*, and the shaft section 1411*c* is structurally identical with the shaft section 1401*c*, and hence their detailed explanations are omitted here. The upper two cylindrical sections 1411*b* are secured to a position on the plate section 1341 above the opening section 1342*c*. The lower two cylindrical sections 1411*b* are secured to a position on the plate section 1341 below the opening section 1342*c*.

The coiled spring 1412 is identical with the coiled spring 1402 in terms of a configuration, and the protective plate-like section 1416 is structurally identical with the protective plate-like section 1406, and hence their detailed explanations are omitted here.

The first plate-like section 1414 is structurally identical with the first plate-like section 1404, and the second plate-like section 1418 is structurally identical with the second plate-like section 1408, and hence their detailed explanations are omitted here. A hole section 1414*a* into which the shaft section 1411*c* is inserted is made in the first plate-like section 1414.

Like the grip section main body 1241, the grip section main body 1261 is configured as mentioned above, whereby the first plate-like section 1414 and the protective plate-like section 1416 are driven toward the second plate-like section 1418 by means of the coiled spring 1412. Accordingly, it is possible to prevent occurrence of vibration sound, which would otherwise be caused by repeated opening/closing of the grip section main body 1261.

Like the grip section main body 1241, the protective plate-like section 1416 is interposed between the second plate-like section 1418 and the needle thread. Hence, abrasion of the second plate-like section 1418, which would otherwise be caused when the needle thread contacts the second plate-like section 1418, can be prevented.

Since the sewing machine described in connection with the fifth embodiment is analogous to that described in connection with the third embodiment except the configuration described above, its detailed explanations are omitted here. In the above descriptions, the sewing machine of the fifth embodiment has been described on condition that the configuration described in connection with the fifth embodiment is taken as the configuration of the grip section main bodies 1241 and 1261 described in connection with the sewing machine of the third embodiment. However, the configuration described in connection with the fifth embodiment can also be adopted for the configuration of the grip section main bodies 1241 and 1261 described in connection with the sewing machine of the fourth embodiment.

Sixth Embodiment

A sewing machine of a sixth embodiment is now described. In terms of a configuration, the sewing machine described in connection with the sixth embodiment is approximately analogous to the sewing machine described in connection with the third embodiment. However, they differ from each other in relation to the configuration of the grip section main bodies 1241 and 1261. Further, they differ from each other in that the plate-like section 1360*e* in the supporting section 1360 is provided with projecting members 1362 and 1364 for pressing sliding members 1421 and 1431 toward the front.

Figure 42:
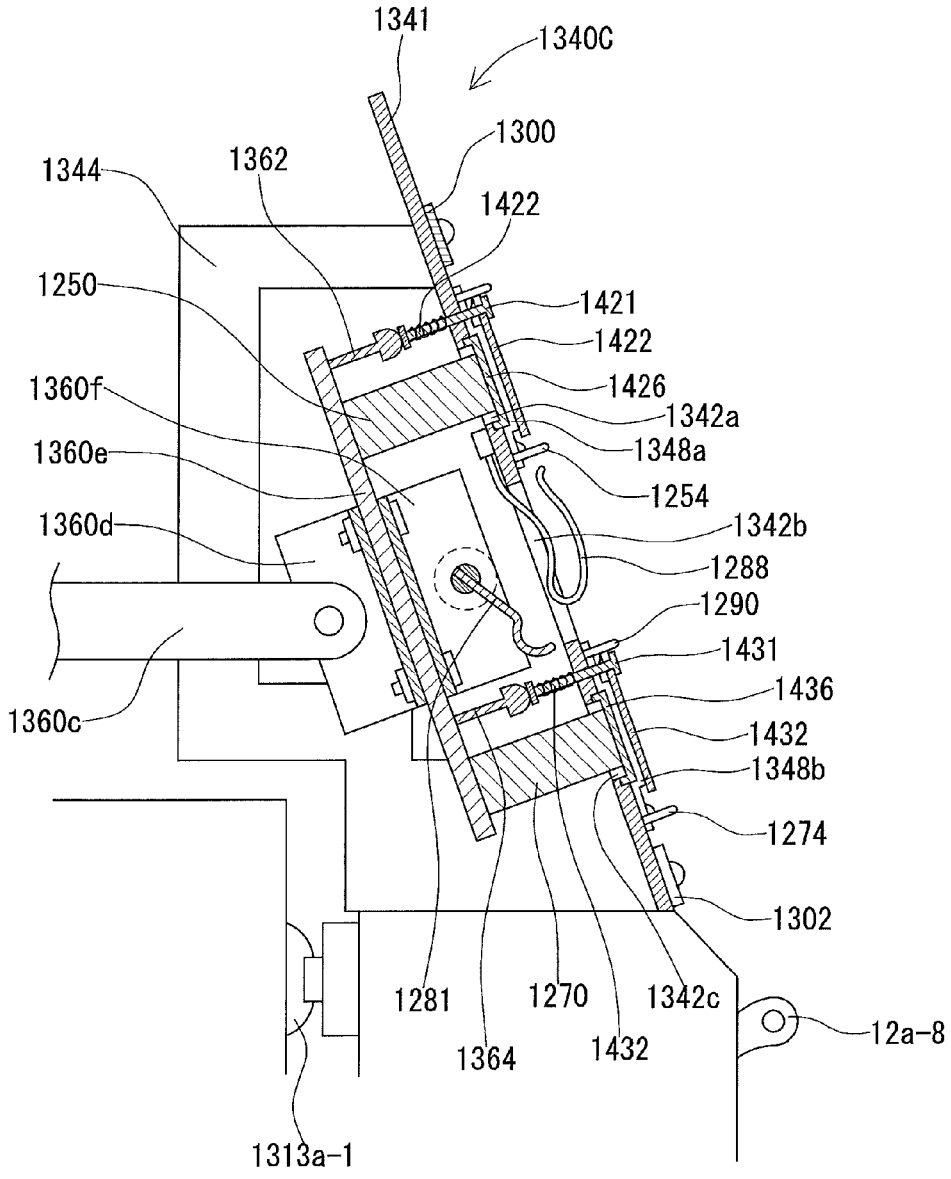
FIG. 42 It is a fragmentary left-side cross sectional view showing a principal part of a head of a sewing machine of a sixth embodiment.
Figure 43:
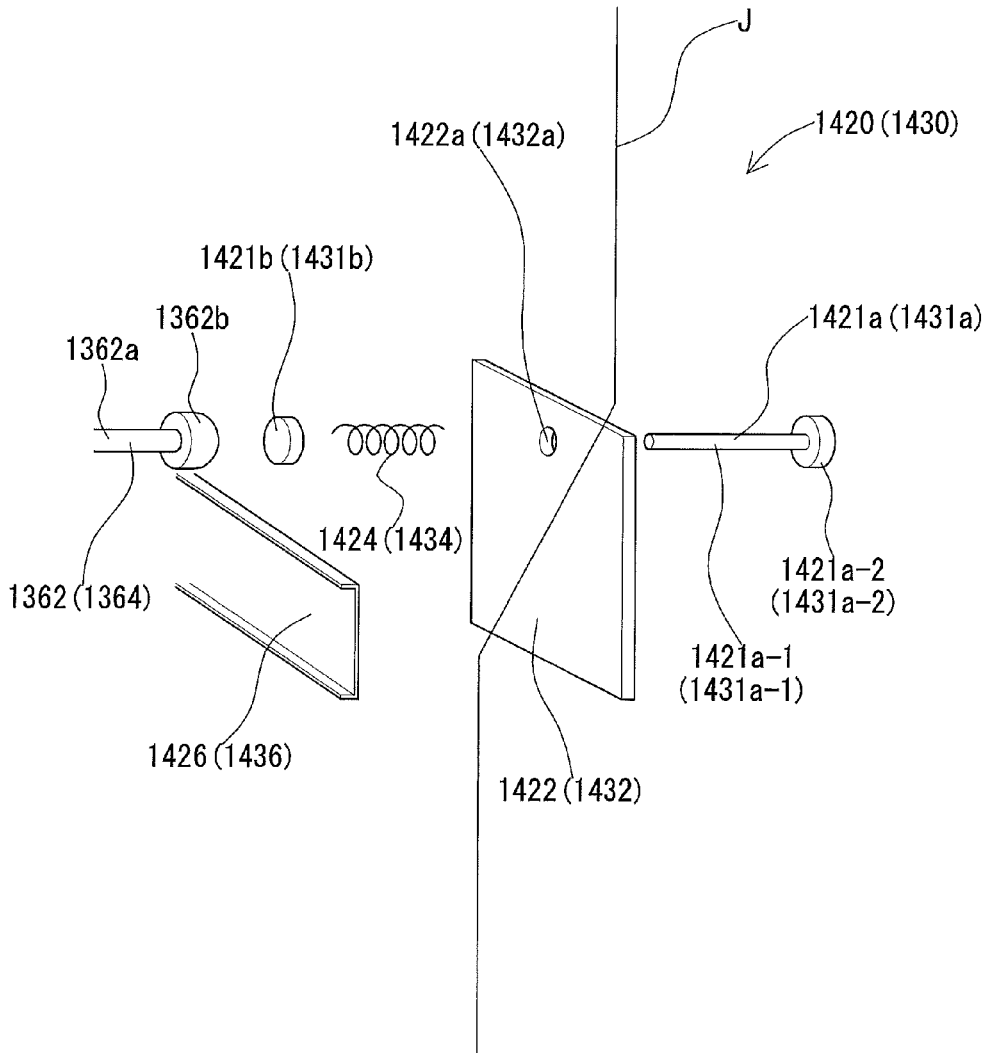
FIG. 43 It is an exploded perspective view showing a grip section main body and a projecting member of the sewing machine of the sixth embodiment.

Specifically, as shown in FIG. 42 to FIG. 45, the grip section main body 1241 of the upstream grip section 1240 has first plate-like section units 1420 and a second plate-like section 1426. The first plate-like section units 1420 are provided for respective needle threads. FIG. 92 is a principal cross sectional view in which only the needle thread control mounting section 1340 and the needle thread control section 1230 remain fractured. FIG. 42 shows them while omitting needle threads.

The first plate-like section unit 1420 includes the sliding member (an upstream sliding member) 1421; a first plate-like section 1422 into which the sliding member 1421 is to be inserted; and a coiled spring (an upstream driving member) 1424 into which the sliding member 1421 is to be inserted and that is provided at a position on the sliding member 1421 closer to the back side with reference to the first plate-like section 1422.

The sliding member 1421 has a sliding member main body 1421*a* and a retaining section 1421*b* secured to a back-side end of the sliding member 1421. The sliding member main body 1421*a* has a linear rod-shaped shaft section 1421*a*-1 and a retaining section 1421*a*-2 placed at a front end of the shaft section 1421*a*-1. The entirety of the sliding member main body 1421*a* is formed into an integrated fashion. Both the retaining section 1421*b* and the retaining section 1421*a*-2 assume the shape of a circular plate and an approximately identical diameter. A circular hole section 1342*f* into which the shaft section 1421*a*-1 is to be inserted is formed for each needle bar at a position on the plate section 1341 above the opening section 1342*a*. The sliding member 1421 is supported by the hole section 1342*f* so as to be slidable along an axis direction of the sliding member 1421 (i.e., a front-back direction of a head).

The first plate-like section (an upstream first plate-like section) 1422 assumes the shape of a rectangular plate. A hole section 1422*a* into which the shaft section 1421*a*-1 is to be inserted is formed at an upper position on the first plate-like section 1422. The diameter of the hole section 1422*a* is made smaller than the diameter of the retaining sections 1421*b* and 1421*a*-2. The first plate-like section 1422 is made of metal attracted by a magnet, like iron. The first plate-like section 1422 is attached to the shaft section 1421*a*-1 by inserting the shaft section 1421*a*-1 into the hole section 1422*a*. As a result, the first plate-like section 1422 stays hanging on the plate section 1341 by way of the sliding member 1421 and is formed so as to be slidable in the front-back direction along the direction of an axis line of the shaft section 1421*a*-1. The first plate-like section 1422 is slidable in a vertical direction with respect to a front surface of the second plate-like section 1426, whereby spacing between the first plate-like section 1422 and the second plate-like section 1426 becomes variable.

The coiled spring 1424 is attached to the shaft section 1421*a*-1 by inserting the shaft section 1421*a*-1 to the coiled spring 1424 and drives the retaining section 1421*b* to the back. When the retaining section 1421*b* is not pressed to the front by the projecting member 1362, the first plate-like section 1422 comes into contact with the second plate-like section 1426. When the sliding member 1421 is not pressed by the projecting member 1362 (a state shown in FIG. 44(*a*)), the driving force of the coiled spring 1424 is such a level that the back surface of the first plate-like section 1422 contacts and overlaps the front surface of the second plate-like section 1426. In a state shown in FIG. 44(*a*), the first plate-like section 1422 is pressed toward the second plate-like section 1426, and the first plate-like section 1422 cannot slide in the front-back direction.

The second plate-like section 1426 is structurally analogous to the second plate-like section 1408 of the fifth embodiment and formed from a synthetic resin film into the shape of a plate having an approximately-C-shaped cross sectional profile. The second plate-like section 1426 is fitted into a cutout formed on the front side of and along upper and lower sides of the opening section 1342*a*.

The projecting member (an upstream press operation member) 1362 fixedly stands upright on a front surface of the plate-like section 1360*e* of the supporting section 1360 and at a center of the magnet section 1250 along its horizontal direction. The projecting member 1362 assumes approximately a shaft shape, and a diameter of its leading end is made large. Specifically, the projecting member 1362 has a shaft section 1362*a* and a head section 1362*b* that is placed at a leading end of the shaft section and that has a diameter (a maximum diameter) larger than the diameter of the shaft section. A front side of the head section 1362*b* is formed into an approximately hemispherical shape so that the sliding member 1421 is easily pressed to the front. Specifically, a front-side leading end of the head section 1362*b* assumes a spherical shape. An axial length ha-1 of the projecting member 1362 is made longer than a length ha-2 between the sliding member 1421 and the plate-like section 1360*e* achieved when the sliding member 1421 is not pressed by the projecting member 1362. When the magnet section 1250 comes to a position on the back side of the first plate-like section 1422 corresponding to the selected needle bar, the projecting member 1362 presses the retaining section 1421*b* of the sliding member 1421 to the front, whereupon the first plate-like section 1422 becomes slidable in the front-back direction.

Figure 44:
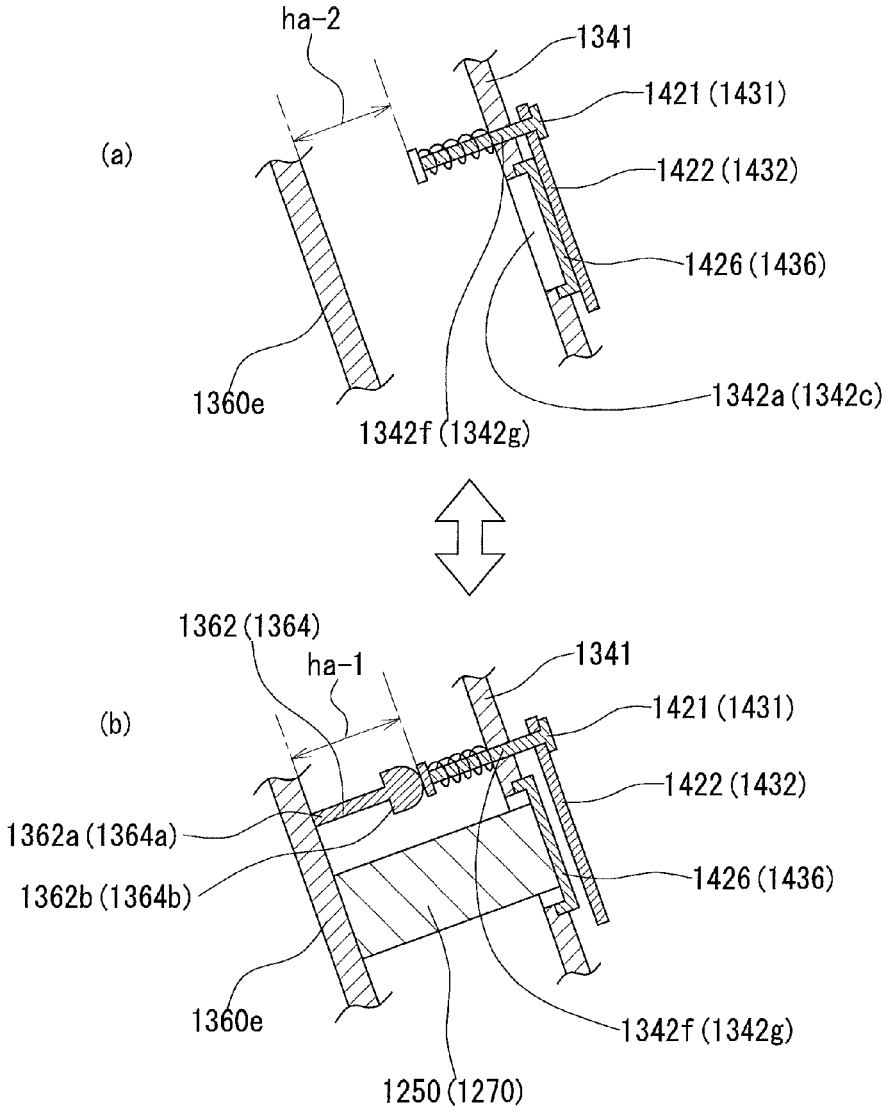
FIG. 44 It is an end view showing operation of the sewing machine of the sixth embodiment.
Figure 45:
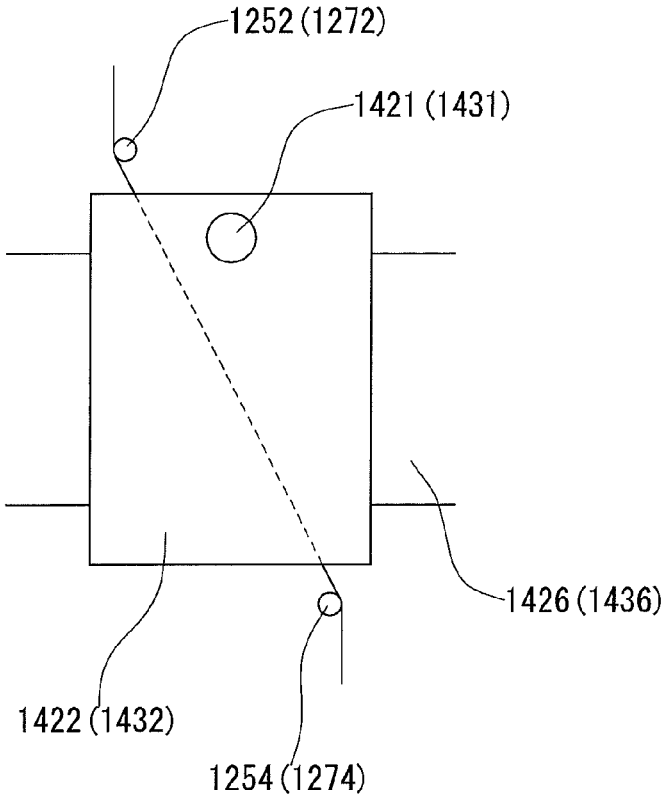
FIG. 45 It is a front view of a principal part showing the grip section main body of the sewing machine of the sixth embodiment.

In the configuration of the sixth embodiment, the magnet section 1250 does not exist on the back side of the first plate-like section 1422 as shown in FIG. 44(*a*) in connection with the first plate-like sections 1422 corresponding to needle bars other than the selected needle bar. Since the projecting member 1362 does not press the sliding member 1421, the first plate-like section 1422 is pressed toward the second plate-like section 1426 and cannot slide in its front-back direction.

In the meantime, in connection with the first plate-like section 1422 corresponding to the selected needle bar (namely, the upstream first plate-like section that is an objective of attraction), the magnet section 1250 exists on the back side of the first plate-like section 1422 as shown in FIG. 44(*b*). The projecting member 1362 presses the retaining section 1421*b* of the sliding member 1421 to the front, so that the first plate-like section 1422 becomes slidable in the front-back direction. Hence, the first plate-like section 1422 and the second plate-like section 1426 grips the needle thread as a result of the magnet section 1250 attracting the first plate-like section 1422, thereby fixing the needle thread. Further, when the magnet section 1250 does not attract the first plate-like section 1422, the first plate-like section 1422 is not pressed back by the sliding member 1421, so that the needle thread is released from a gripped state.

As a result of adoption of the foregoing configuration, in connection with the first plate-like sections 1422 corresponding to the needle bars except the selected needle bar, the first plate-like sections 1422 are pressed toward the second plate-like section 1426. Hence, sound, which would otherwise be generated when the first plate-like section 1422 contacting the second plate-like section 1426, does not occur, and vibration sound will not also be caused by vibration of a head. Further, the first plate-like section 1422 corresponding to the selected needle bar is not pressed to the back by the sliding member 1421. Hence, the needle thread can be sufficiently released from the gripped state.

In the case of the fifth embodiment, the first plate-like section 1404 (1414) is driven toward the protective plate-like section 1406 (1416) at all times. Hence, even when the first plate-like section is unattracted by the magnet section, the needle thread may not be sufficiently released. However, in the present embodiment, when the magnet section does not attract the first plate-like section, the needle thread can be sufficiently released.

As shown in FIGS. 42 to 45, the grip section main body 1261 of the downstream grip section 1260 has a first plate-like section unit 1430 and a second plate-like section 1436. The first plate-like section unit 1430 is provided for each of needle threads.

Since the first plate-like section unit 1430 is structurally analogous to the first plate-like section unit 1420 and has the sliding member (a downstream sliding member) 1431, a first plate-like section 1432 inserted into the sliding member 1431, and a coiled spring (a downstream driving member) 1434 into which the sliding member 1431 is to be inserted and that is provided at a position on the sliding member 1431 closer to the back side with reference to the first plate-like section 1432.

The sliding member 1431 is structurally similar to the sliding member 1421. The sliding member 1431 has a sliding member main body 1431*a* and a retaining section 1431*b* fixed to an end on the back side of the sliding member 1431. The sliding member main body 1431*a* has a linear rod-shaped shaft section 1431*a*-1 and a retaining section 1431*a*-2 provided at an end on the front side of the shaft section 1431*a*-1. The entirety of the sliding member main body 1431*a* is integrally formed. A circular hole section 1342*g* into which the shaft section 1431*a*-1 is to be inserted is formed at a position on the plate section 1341 above the opening section 1342*c* for each needle bar. The sliding member 1431 is slidably supported by the hole section 1342*g*.

The first plate-like section (a downstream first plate-like section) 1432 is structurally analogous to the plate-like section 1422. A hole section 1432*a* into which the shaft section 1431*a*-1 is to be inserted is formed in the first plate-like section 1432.

The coiled spring 1434 has the same structure as that of the coiled spring 1424. The second plate-like section 1436 has the same structure as that of the second plate-like section 1418 described in connection with the fifth embodiment.

The projecting member (a downstream press operation member) 1364 fixedly stands upright on the front surface of the plate-like section 1360*e* of the supporting section 1360 and at a center of the magnet section 1270 along its horizontal direction. The projecting member 1364 has the same structure as that of the projecting member 1362. When the magnet section 1270 comes to a position on the back side of the first plate-like section 1432 corresponding to the selected needle bar (i.e., the downstream first plate-like section that is an object of attraction), the projecting member 1364 presses the retaining section 1431*b* of the sliding member 1431 to the front, whereupon the first plate-like section 1432 becomes slidable in the front-back direction.

As a result of adoption of the above configuration, the first plate-like sections 1432 corresponding to needle bars other than the selected needle bar are pressed toward the second plate-like section 1436, in the same way as described in the case of the grip section main body 1241. Sound, which would otherwise be caused when the first plate-like section 1432 contacts the second plate-like section 1436, does not occur, and vibration sound will not also be caused by vibration of a head. The first plate-like section 1432 corresponding to the selected needle bar is not pressed to the back by the sliding member 1431, so that the needle thread can be sufficiently released from the pinched and gripped state.

The configuration of the sixth embodiment is analogous to that of the third embodiment except the foregoing configuration, and hence its detailed explanation is omitted. In the descriptions, the sewing machine of the third embodiment has been explained as employing the configuration of the sixth embodiment in connection with the configuration of the grip section main bodies 1241 and 1261. Further, the sewing machine of the fourth embodiment has been explained as employing the configuration of the sixth embodiment in connection with the sliding members 1421 and 1431. However, the sewing machine of the fourth embodiment can additionally include the configuration of the grip section main bodies 1241 and 1261 in connection with the configuration of the sixth embodiment and further include the sliding members 1421 and 1431.

In the second to sixth embodiments, the needle bar case main body 1330 can also be given the name "needle bar case."

In the drawing, direction Y1-Y2 is perpendicular to X1-X2 direction, and Z1-Z2 direction is perpendicular to X1-X2 direction and Y1-Y2 direction.

DESCRIPTIONS OF THE REFERENCE NUMERALS AND SYMBOLS

5, 205, 1205 SEWING MACHINE
7, 207, 1207 HEAD

10 MACHINE ELEMENT GROUP
12*a*, 12*a*-1, 12*a*-2, 12*a*-3, 12*a*-4, 12*a*-5, 12*a*-6, 12*a*-7, 12*a*-8, 12*a*-9 THREAD TAKE-UP LEVER
12*b*, 12*b*-1, 12*b*-2, 12*b*-3, 12*b*-4, 12*b*-5, 12*b*-6, 12*b*-7, 12*b*-8, 12*b*-9 NEEDLE BAR
12*ba* SEWING NEEDLE
12*bb* PIN HOLE
12*c* SHUTTLE
12*d* SEWING FRAME
14*a* NEEDLE BAR CONNECTING STUD
14*b* NEEDLE BAR ACTUATION MEMBER
14*c* BASE NEEDLE BAR
20 MAIN SPINDLE MOTOR
21, 87 ENCODER
22 MAIN SPINDLE
24 FRAME ACTUATOR
30, 230, 1230 NEEDLE THREAD CONTROL SECTION
40, 240, 1240 UPSTREAM GRIP SECTION
41, 61, 241, 261, 1241, 1261 GRIP SECTION MAIN BODY
50, 70 SOLENOID
60, 260, 1260 DOWNSTREAM GRIP SECTION
80, 280, 1280 TURNING SECTION
81, 281, 1281 TURNING ARM
82, 282, 1282 MAIN BODY SECTION
84 TUBULAR PORTION
86, 286, 1286 NEEDLE THREAD MOTOR
90 CONTROL CIRCUIT
92 MEMORY DEVICE
110, 310, 1310 CASE
120, 320 FRAME
242-1, 242-2, 242-3, 242-4, 242-5, 242-6, 262-1, 262-2, 262-3, 262-4, 262-5, 262-6, 1242-1, 1242-2, 1242-3, 1242-4, 1242-5, 1242-6, 1242-7, 1242-8, 1242-9, 1262-1, 1262-2, 1262-3, 1262-4, 1262-5, 1262-6, 1262-7, 1262-8, 1262-9, 1404, 1414, 1422, 1432 FIRST PLATE-LIKE SECTION
244, 264, 1244, 1264, 1408, 1418, 1426, 1436 SECOND PLATE-LIKE SECTION
246, 266 MOUNTING MEMBER
250, 270, 1250, 1270 MAGNET SECTION
252, 254, 272, 274, 1252, 1254, 1272, 1274, 1290, 1336 GUIDE MEMBER
284, 1284 HOOK SECTION
284*a* GROOVE SECTION
288, 1288 NEEDLE THREAD SUPPORTING MEMBER
288*a*, 288*b*, 1288*a*, 1288*b* CIRCULAR-ARC MEMBER
288*c*, 1288*c* CONNECTING MEMBER
290 GUIDE MEMBER
292, 1337 TENSION SPRING
300, 302 NEEDLE THREAD GUIDE
312, 1312 ARM
314, 1314 NEEDLE BAR CASE
314*a* FRONT SECTION
110*a*, 110*b*, 316*a*, 316*b*, 316*c*, 316*d*, 1342*a*, 1342*b*, 1342*c* OPENING SECTION
1330 NEEDLE BAR CASE MAIN BODY
1340 NEEDLE THREAD CONTROL MOUNTING SECTION
1341 PLATE SECTION
1350, 1352 SLIDE ASSIST MEMBER
1335, 1360, 1370 SUPPORTING SECTION
1362, 1364 PROJECTING MEMBER
1380 SLIDE REGULATION SECTION
1400, 1410, 1420, 1430 FIRST PLATE-LIKE SECTION UNIT
1401, 1411 SUPPORTING MEMBER
1401*a*, 1411*a* PLATE-LIKE SECTION
1401*b*, 1411*b* CYLINDRICAL SECTION
1401*c*, 1411*c* SHAFT SECTION
1402, 1412, 1424, 1434 COILED SPRING
1404*a*, 1414*a* HOLE SECTION
1406, 1416 PROTECTIVE PLATE-LIKE SECTION
1421, 1431 SLIDING MEMBER

The invention claimed is:

1. A sewing machine comprising:

a thread take-up lever formed in a swayable manner;

a needle thread control section that is disposed at an upstream position on a needle thread path of the thread take-up lever and that includes an upstream grip section which includes an upstream grip section main body for pinching to thereby grip a needle thread and an upstream actuation section for switching, with respect to the upstream grip section main body, between a closed state in which the needle thread is gripped and an open state in which a needle thread is released from a gripped state, a downstream grip section which is disposed at a downstream position on a needle thread path of the upstream grip section and which includes a downstream grip section main body for pinching to thereby grip a needle thread and a downstream actuation section for switching, with respect to the downstream grip section main body, between a closed state in which the needle thread is gripped and an open state in which the needle thread is released from a gripped state, and a turning section which turns the needle thread existing between the upstream grip section main body and the downstream grip section main body and which has a turning arm to contact the needle thread and a needle thread motor to turn the turning arm; and a control section, in a control zone for each stitch, that—in a torque control zone including at least a portion of a zone from a bottom dead point to a top dead point of the thread take-up lever during which the thread take-up lever draws the needle thread with respect to processed fabric to be sewn with the needle thread—controls the needle thread motor in accordance with a torque value in such a way that tension is imparted to the needle thread against a direction in which the thread take-up lever draws the needle thread while the upstream grip section main body is closed and while the downstream grip section main body is opened, to thus impart rotating force to the turning arm, and that—in a position control zone which is at least a portion of a zone other than the torque control zone achieved while the upstream grip section main body is opened and while the downstream grip section main body is closed—controls the needle thread motor in accordance with angle position data pertaining to the needle thread motor in such a way that an angle of the needle thread motor returns to an initial angle position of the needle thread motor which is a rotational position of the needle thread motor, thereby imparting rotating force to the turning arm to thus draw the needle thread from an upstream position.

2. The sewing machine according to claim 1, further comprising:

an arm making up an enclosure of the sewing machine;

a needle bar case that is provided so as to be slidable in a horizontal direction with respect to the arm and that includes first opening sections made at positions between the upstream grip section main body and the downstream grip section main body in a vertical direction such that a leading end of the turning arm of a turning section can be exposed to the front side, a second opening section which is provided above the first opening section and on which the upstream magnet section fronts, and a third opening section which is provided below the first opening section and on which a downstream magnet section fronts;

a plurality of needle bars provided in the needle bar case; and needle thread supporting members that each is provided in the needle bar case and that each supports the needle thread in its horizontal direction at the position of the first opening section, wherein the thread take-up lever is placed while being exposed from a position in the needle bar case below the downstream grip section to a front;

the turning arm is turned while remaining in contact with the needle thread supported by the needle thread supporting member, thereby turning the needle thread;

the upstream grip section main body is placed on a front side of the needle bar case and, and has a plurality of upstream first plate-like sections which is formed into a shape of a plate from a magnetic substance; that is, a material attracted by the magnet and which is provided in the needle bar case and an upstream second plate-like section which is provided at back side of the upstream first plate-like sections and on a front side of the second opening section and which is formed into a shape of a plate from a non-magnetic substance unattracted by the magnet;

the upstream actuation section is a magnet section serving as the upstream magnet section and secured to the arm-side at a back side of the upstream second plate-like section and switches between a closed state in which the upstream first plate-like section is attracted by magnetic force, to thus pinch and grip the needle thread between the upstream first plate-like section and the upstream second plate-like section and an open state in which attraction caused by the magnetic force is released to thereby release the needle thread from the gripped state;

the downstream grip section main body is placed on a front side of the needle bar case and below the upstream grip section main body and has a plurality of downstream first plate-like sections which are formed from a magnetic substance which is attracted by the magnet into a shape of a plate and which are provided in the needle bar case and a downstream second plate-like section which is provided at back side of the downstream first plate-like sections and on a front side of the second opening section and which is formed into a shape of a plate from a non-magnetic substance unattracted by the magnet; and the downstream actuation section is a magnet section serving as the downstream magnet section and secured to the arm-side at a back side of the downstream second plate-like section and switches between a closed state in which the downstream first plate-like section is attracted by magnetic force, to thus pinch to thereby grip the needle thread between the downstream first plate-like section and the downstream second plate-like section and an open state in which the needle thread is released from the gripped state by means of canceling attraction caused by the magnetic force.

3. The sewing machine according to claim 2, wherein the needle thread is guided downward after passing through spacing between the upstream first plate-like section and the upstream second plate-like section of the upstream grip section main body, reaches the needle thread supporting member while a path of the needle thread is inverted by a first needle thread path inverting member provided on the needle bar case, is guided downwardly from the needle thread supporting member and subsequently passes through spacing between the downstream first plate-like section and the downstream second plate-like section in the downstream grip section main body, reaches the thread take-up lever while a path of the needle thread is inverted by a second needle thread path inverting member provided in the needle bar case, and reaches the sewing needle attached to the needle bar while being guided downward from the thread take-up lever.

4. The sewing machine according to claim 3, wherein the first needle thread path inverting member has a main body section having a cylindrical peripheral and a base end section which continually extends from a base end of the main body section and which is formed so as to have a diameter smaller than a diameter of the main body section; an indentation section used for inserting an end section of the base-end section side of the main body section and a hole section which continually extends from the indentation section and which is used for inserting the base end section are formed at positions on the needle bar case where the first needle thread path inverting member and the second needle thread path inverting member are to be attached; the base end section is inserted into the hole section; and an end section of the base-end section side of the main body section is inserted into the indentation section.

5. The sewing machine according to claim 2, wherein first guide members set above and below the upstream first plate-like section on the needle bar case are placed at positions that differ from each other in a horizontal direction in the upstream grip section main body; each of the needle thread paths existing between the upstream first plate-like section and the upstream second plate-like section is formed obliquely with respect to a vertical direction; second guide members set above and below the downstream first plate-like section on the needle bar case are placed at positions that differ from each other in a horizontal direction in the downstream grip section main body; and each of the needle thread paths existing between the downstream first plate-like section and the downstream second plate-like section is formed obliquely with respect to a vertical direction.

6. The sewing machine according to claim 5, wherein each of the first guide members and the second guide members has a main body section having a cylindrical peripheral and a base end section which continually extends from a base end of the main body section and which is formed so as to have a diameter smaller than a diameter of the main body section; an indentation section used for inserting an end section on the base-end section side of the main body section and a hole section which continually extends from the indentation section and which is used for inserting the base end section are formed at positions on the needle bar case where the first guide members and the second guide members are to be attached; the base end section is inserted into the hole section; and an end section on the base-end section side of the main body section is inserted into the indentation section.

7. The sewing machine according to claim 2, wherein the needle bar case has a needle bar case main body that is provided with the thread take-up levers and the needle bars and that is provided so as to be slidable with respect to the arm and a plate-like plate section provided on an upper surface of the needle bar case main body; and the plate section has the first opening section, the second opening section, the third opening section, the upstream grip section, the downstream grip section, and the needle thread supporting member.

8. The sewing machine according to claim 2, wherein a magnet section/motor supporting member that supports the upstream magnet section, the downstream magnet section, the needle thread motor is secured to the arm.

9. The sewing machine according to claim 2, further comprising a magnet section/motor supporting member that supports the upstream magnet section, the downstream magnet section, and the needle thread motor, a sliding support member that is provided in the needle bar case and that slidably supports the magnet section/motor supporting member in a horizontal direction and a slide regulation member that is secured to the arm and that regulates horizontal sliding action of the magnet section/motor supporting member to horizontally position the magnet section/motor supporting member, wherein horizontal sliding action of the magnet section/motor supporting member is regulated by the slide regulation member, whereby the upstream magnet section, the downstream magnet section, and the needle thread motor are fixedly placed on the arm side.

10. The sewing machine according to claim 2, further comprising an upstream first plate-like section supporting members that each has a first shaft section to be inserted into a hole section of the upstream first plate-like section and that is provided on a front side of the needle bar case, an upstream coiled springs into each of which the first shaft section is to be inserted, and an upstream protective plate-like sections that each is secured to a leading end of the first shaft section and that is formed from a non-magnetic substance unattracted by the magnet, wherein the upstream first plate-like section is provided with the hole section used for inserting the first shaft section; the upstream second plate-like section remains in contact with a surface of the upstream protective plate-like section that is on the other side with respect to the upstream first plate-like section; the upstream first plate-like section is provided between the upstream coiled spring and the upstream protective plate-like section while the first shaft section remains inserted into the hole section; and the upstream first plate-like section is driven toward the upstream protective plate-like section by means of the upstream coiled spring; and further comprising a downstream first plate-like section supporting members that each has a second shaft section to be inserted into a hole section of the downstream first plate-like section and that is provided on a front side of the needle bar case, a downstream coiled springs into which the second shaft section is to be inserted, and a downstream protective plate-like sections that each is secured to a leading end of the second shaft section and that is formed from a non-magnetic substance unattracted by the magnet, wherein the downstream first plate-like section is provided with the hole section used for inserting the second shaft section; the downstream second plate-like section remains in contact with a surface of the downstream protective plate-like section that is on the other side with respect to the downstream first plate-like section; the downstream first plate-like section is provided between the downstream coiled spring and the downstream protective plate-like section while the second shaft section remains inserted into the hole section; and the downstream first plate-like section is driven toward the downstream protective plate-like section by means of the downstream coiled spring.

11. The sewing machine according to claim 2, further comprising an upstream sliding members that each is inserted into a position above the second opening section on the needle bar case and that each is provided so as to be slidable along a direction of an axis line of the upstream sliding member and an upstream driving members that each drives the upstream sliding member to a back side of the needle bar case, wherein the upstream first plate-like section is provided while hanging on the upstream sliding member, and an upstream press operation member for pressing the upstream sliding member corresponding to the upstream first plate-like section which is attracted by the upstream magnet section in a direction opposite to a driving direction of the upstream driving member is provided on the arm side; and further comprising a downstream sliding members that each is inserted into a position above the third opening section on the needle bar case and that each is provided for each of the upstream first plate-like sections so as to be slidable in an axial direction of the downstream sliding member and a downstream driving members that each drives the downstream sliding member to the back side of the needle bar case, wherein the downstream first plate-like section is provided while hanging on the downstream sliding member, and a downstream press operation member for pressing the downstream sliding member corresponding to the downstream first plate-like section which is attracted by the downstream magnet section in a direction opposite to a driving direction of the downstream driving member is provided on the arm side.

12. The sewing machine according to claim 2, wherein the needle thread supporting member supports a needle thread on the front side of the first opening section.

13. The sewing machine according to claim 1, wherein the control section performs control operation in accordance with torque data whose torque value is specified for each stitch in the torque control zone and detects, at a starting point of the position control zone, a current angle position of the needle thread motor in the position control zone, generates angle correspondence data which specify an angle of the needle thread motor from the current angle position to an initial angle position of the needle thread motor for each angle of a main spindle motor representing a rotational position of the main spindle motor which rotates a main spindle for transmitting power to the thread take-up lever, and controls a position of the needle thread motor to its angle of the needle thread motor corresponding to the angle of the main spindle motor as the angle of the main spindle motor changes as a result of rotation of the main spindle motor.

14. The sewing machine according to claim 13, wherein, during torque control performed in the torque control zone, a value of a torque deviation is calculated from a torque value in the torque data and a torque value based on a current value fed to the needle thread motor, and an electric current is fed to the needle thread motor in accordance with the calculated torque deviation.

15. The sewing machine according to claim 13, further comprising a motor angle detection section for detecting a rotational position of the needle thread motor, wherein position control is performed during position control performed in the position control zone along operation control steps including:

a reading step of reading an angle of the needle thread motor from the angle correspondence data, a speed data calculation step of calculating an amount of change per unit time in angle data read in the reading step, to thus calculate speed data, a torque data calculation step of detecting an amount of change per unit time in the speed data calculated in the speed data calculation step, to thus calculate torque data;

a location deviation calculation step of calculating a value of a location deviation from the angle data read in the reading step and the motor angle data read by the motor angle detecting section, a speed deviation calculation step of calculating a value of a speed deviation from the calculated value of the location deviation, the calculated speed data, and the amount of change per unit time in motor angle detected by the angle detection section, a torque deviation calculation step of calculating a value of a torque deviation from the calculated value of the speed deviation, the calculated torque data, and a value of torque based on a current value fed to the motor, and a current feeding step of feeding an electric current to the motor in accordance with the calculated value of the toque deviation.

16. A sewing machine comprising:

an arm making up an enclosure of the sewing machine;

a needle bar case that is provided so as to be slidable in a horizontal direction with respect to the arm and that includes first opening sections made at positions between an upstream grip section main body and a downstream grip section main body in a vertical direction such that a leading end of a turning arm of a turning section can be exposed to the front side, a second opening section which is provided above the first opening section and on which an upstream magnet section fronts, and a third opening section which is provided below the first opening section and on which a downstream magnet section fronts;

a plurality of thread take-up levers that are provided on a front side of the needle bar case in an exposed fashion and that are provided at downstream positions on needle thread paths with respect to a downstream grip section in a swayable manner;

a plurality of needle bars provided in the needle bar case;

an upstream grip section that has an upstream grip section main body that is placed on a front side of the needle bar case, that pinches to thereby grip the needle thread, and that has upstream first plate-like sections which is formed from a magnetic substance that is a material attracted by the magnet, and which is provided for the respective needle bars and an upstream second plate-like section which is provided at back side of the upstream first plate-like sections and on a front side of the second opening section and which is formed from a non-magnetic substance unattracted by the magnet, and an upstream magnet section that is secured to the arm side and that switches between a closed state in which the needle thread is pinched to thereby grip between the upstream first plate-like section and the upstream second plate-like section by means of attracting the upstream first plate-like section from a back side of the upstream second plate-like section by means of magnetic force and an open state in which the needle thread is released from the gripped state by canceling attraction caused by magnetic force;

the downstream grip section that is placed at a downstream position along a needle thread path of the upstream grip section and that has the downstream grip section main body which is placed on a front surface side of the needle bar case and below the upstream grip section main body, which pinches to thereby grip the needle thread, and which has a downstream first plate-like sections which is formed from a magnetic substance that is a material attracted by a magnet and which is provided for each of the needle bars and a downstream second plate-like section that is provided at back side of the downstream first plate-like sections and on a front side of the second opening section and that is formed from a non-magnetic substance unattracted by the magnet, and a downstream magnet section that is secured to the arm side and that switches between a closed state in which the needle thread is pinched to thereby grip between the downstream first plate-like section and the downstream second plate-like section by means of attracting the downstream first plate-like section from a back side of the downstream second plate-like section by magnetic force and an open state in which the needle thread is released from a gripped state by canceling attraction caused by the magnetic force;

needle thread supporting members that each is provided in the needle bar case and that each supports the needle thread in its horizontal direction at the position of the first opening section;

a turning section that turns the needle thread existing between the upstream grip section main body and the downstream grip section main body and that has the turning arm which contacts the needle thread supported by the needle thread supporting member and a needle thread motor which is secured to the arm side and which turns the turning arm; and a control section, in a control zone for each stitch, that—in a torque control zone including at least a portion of a zone from a bottom dead point to a top dead point of the thread take-up lever during which the thread take-up lever draws the needle thread with respect to processed fabric to be sewn with the needle thread—controls the needle thread motor in accordance with a torque value in such a way that tension is imparted to the needle thread against a direction in which the thread take-up lever draws the needle thread in accordance with torque data which are generated from embroidery data and whose torque value is specified for each stitch, while the upstream grip section main body is closed and while the downstream grip section main body is opened, thereby imparting rotating force to the turning arm in an upward direction and that—in a position control zone which is at least a portion of a zone other than the torque control zone achieved while the upstream grip section main body is opened and while the downstream grip section main body is closed detects at a starting point of the position control zone a current angle position of the needle thread motor which is a rotational position of the needle thread motor, generates angle correspondence data which specify an angle of the needle thread motor from the current angle position to an initial angle position of the needle thread motor for each angle of a main spindle motor representing a rotational position of the main spindle motor which rotates a main spindle for transmitting power to the thread take-up levers and the needle bars, controls a position of the needle thread motor to its angle of the needle thread motor corresponding to the angle of the main spindle motor as the angle of the main spindle motor changes as a result of rotation of the main spindle motor in such a way that the angle of the needle thread motor returns to an initial angle position of the needle thread motor, to thus impart rotating force to the turning arm in an upward direction and draw a needle thread from an upstream position, turns the turning arm downward so as to recede to a receded position and slide the needle bar case when processing proceeds to control of a next stitch and when a needle thread to be selected is changed, thereby letting the upstream magnet section, the downstream magnet section, and the turning arm come to a position of the selected needle thread.

17. A sewing machine comprising:

an arm making up an enclosure of the sewing machine;

a needle bar housing case that is disposed so as to be slidable in a horizontal direction with respect to the arm and that houses a plurality of needle bars;

a tabular plate section that is disposed on an upper surface of the needle bar housing case and that is provided with first opening sections made at positions between an upstream grip section main body and a downstream grip section main body in a vertical direction such that a leading end of a turning arm of a turning section can be exposed to the front side, a second opening section which is provided above the first opening section and on which an upstream magnet section fronts, and a third opening section that is placed below the first opening section and on which a downstream magnet section fronts;

a plurality of thread take-up levers that are axially supported by the needle bar housing case in a swayable manner, that are provided on a front side of the needle bar housing case in an exposed fashion, and that are provided at downstream positions on needle thread paths with respect to a downstream grip section;

an upstream grip section that has the upstream grip section main body that is placed on a front side of the plate section, that pinches to thereby grip a needle thread, and that has upstream first plate-like sections which is formed from a magnetic substance that is a material attracted by the magnet, and which is provided for the respective needle bars and an upstream second plate-like section which is provided at back side of the upstream first plate-like sections and on a front side of the second opening section and which is formed from a non-magnetic substance unattracted by the magnet, and the upstream magnet section that is secured to the arm side and that switches between a closed state in which the needle thread is pinched and gripped between the upstream first plate-like section and the upstream second plate-like section by means of attracting the upstream first plate-like section from a back side of the upstream second plate-like section by magnetic force and an open state in which the needle thread is released from the gripped state by canceling attraction caused by magnetic force;

the downstream grip section that is placed at a downstream position along a needle thread path of the upstream grip section and that has the downstream grip section main body which is placed below the upstream grip section main body on a front side of the plate section, which pinches to thereby grip the needle thread, and which has downstream first plate-like sections which is formed from a magnetic substance that is a material attracted by the magnet and provided for respective needle bars and a downstream second plate-like section which is provided at back side of the downstream first plate-like sections and on a front side of the second opening section and formed from a non-magnetic substance unattracted by the magnet, and the downstream magnet section that is secured to the arm side and that switches between a closed state in which the needle thread is pinches to thereby grip between the downstream first plate-like section and the downstream second plate-like section by means of attracting the downstream first plate-like section from a back side of the downstream second plate-like section by magnetic force and an open state in which the needle thread is released from a gripped state by canceling attraction caused by the magnetic force;

needle thread supporting members that each is provided in the plate section and that each supports the needle thread in its horizontal direction at the position of the first opening section;

the turning section that turns the needle thread existing between the upstream grip section main body and the downstream grip section main body and that has the turning arm which contacts the needle thread supported by the needle thread supporting member and a needle thread motor which is secured to the arm side and which turns the turning arm; and a control section, in a control zone for each stitch, that—in a torque control zone including at least a portion of a zone from a bottom dead point to a top dead point of the thread take-up lever during which the thread take-up lever draws the needle thread with respect to processed fabric to be sewn with the needle thread—controls the needle thread motor in accordance with a torque value in such a way that tension is imparted to the needle thread against a direction in which the thread take-up lever draws the needle thread in accordance with torque data which are generated from embroidery data and whose torque value is specified for each stitch, while the upstream grip section main body is closed and while the downstream grip section main body is opened, thereby imparting rotating force to the turning arm in an upward direction and that—in a position control zone which is at least a portion of a zone other than the torque control zone achieved while the upstream grip section main body is opened and while the downstream grip section main body is closed detects at a starting point of the position control zone a current angle position of the needle thread motor which is a rotational position of the needle thread motor, generates angle correspondence data which specify an angle of the needle thread motor from the current angle position to an initial angle position of the needle thread motor for each angle of a main spindle motor representing a rotational position of the main spindle motor which rotates a main spindle for transmitting power to the thread take-up levers and the needle bars, controls a position of the needle thread motor to its angle of the needle thread motor corresponding to the angle of the main spindle motor as the angle of the main spindle motor changes as a result of rotation of the main spindle motor in such a way that the angle of the needle thread motor returns to an initial angle position of the needle thread motor, to thus impart rotating force to the turning arm in an upward direction and draw a needle thread from an upstream position, turns the turning arm downward so as to recede to a receded position and slides the needle bar housing case when a needle thread to be selected is changed on occasion of processing proceeding to control a next stitch, thereby letting the upstream magnet section, the downstream magnet section, and the turning arm come to a position of the selected needle thread.

18. The sewing machine according to claim 1, wherein the control section detects a main spindle angle in accordance with zone data in which a starting point and an end point of the torque control zone and a starting point and an end point of the position control zone are specified as information about a main spindle angle that is a rotational position of the main spindle motor, thereby determining the torque control zone and the position control zone.

19. The sewing machine according to claim 1, wherein the starting point of the position control zone corresponds to any location in a zone from the other dead point to the one dead point of the thread take-up lever and is in front of a top dead point of a shuttle, and the end point of the position control zone corresponds to any location in a zone from the one dead point to the other dead point of the thread take-up lever.

20. The sewing machine according to claim 1, wherein a zone in which an electric current is not fed to the needle thread motor is set between the end point of the torque control zone and the starting point of the position control zone; a zone during which an electric current is not fed to the needle thread motor is set between the end point of the position control zone and the starting point of the torque control zone; the upstream grip section main body is switched to a closed state, and the downstream grip section main body is switched to an open state at the end point of the position control zone; and the upstream grip section main body is switched to an open state, and the downstream grip section main body is switched to a closed state at the end point of the torque control zone.

* * * * *